US008097394B2

(12) United States Patent
Hirose et al.

(10) Patent No.: US 8,097,394 B2
(45) Date of Patent: Jan. 17, 2012

(54) ELECTROPHOTOGRAPHIC PHOTORECEPTOR, METHOD OF PREPARING THE PHOTORECEPTOR, AND IMAGE FORMING METHOD, IMAGE FORMING APPARATUS AND PROCESS CARTRIDGE THEREFOR USING THE PHOTORECEPTOR

(75) Inventors: Mitsuaki Hirose, Numazu (JP); Yoshiaki Kawasaki, Susono (JP)

(73) Assignee: Ricoh Company, Ltd., Tokyo (JP)

( * ) Notice: Subject to any disclaimer, the term of this patent is extended or adjusted under 35 U.S.C. 154(b) by 657 days.

(21) Appl. No.: 11/939,239

(22) Filed: Nov. 13, 2007

(65) Prior Publication Data

US 2008/0124638 A1 May 29, 2008

(30) Foreign Application Priority Data

Nov. 28, 2006 (JP) ..... 2006-319985

(51) Int. Cl.
*G03G 5/00* (2006.01)

(52) U.S. Cl. ..... 430/132; 430/56; 430/58.05; 430/60; 430/130

(58) Field of Classification Search ..... 430/56, 430/58.05, 58.7, 60, 130, 132
See application file for complete search history.

(56) References Cited

U.S. PATENT DOCUMENTS

| | | | | |
|---|---|---|---|---|
| 5,989,638 | A * | 11/1999 | Nielsen | 427/331 |
| 6,521,387 | B2 | 2/2003 | Kawasaki | |
| 6,558,863 | B2 | 5/2003 | Rokutanzono et al. | |
| 6,641,964 | B2 | 11/2003 | Ikuno et al. | |
| 6,844,124 | B2 | 1/2005 | Ikuno et al. | |
| 7,449,272 | B2 * | 11/2008 | Kawasaki et al. | 430/66 |
| 2003/0049555 | A1 * | 3/2003 | Sakon et al. | 430/124 |
| 2004/0234875 | A1 | 11/2004 | Toda et al. | |
| 2005/0141919 | A1 | 6/2005 | Kitajima et al. | |
| 2005/0158641 | A1 | 7/2005 | Yanagawa et al. | |
| 2005/0158644 | A1 | 7/2005 | Kondo et al. | |
| 2005/0181291 | A1 | 8/2005 | Kami et al. | |
| 2005/0266325 | A1 | 12/2005 | Yanagawa et al. | |
| 2005/0287452 | A1 | 12/2005 | Tamura et al. | |
| 2006/0110668 | A1 * | 5/2006 | Kawasaki et al. | 430/58.7 |
| 2006/0199092 | A1 | 9/2006 | Sugino et al. | |
| 2007/0009818 | A1 | 1/2007 | Yanagawa et al. | |

FOREIGN PATENT DOCUMENTS

| | | |
|---|---|---|
| JP | 56-48637 | 5/1981 |
| JP | 64-1728 | 1/1989 |
| JP | 4-281461 | 10/1992 |
| JP | 6-308757 | 11/1994 |
| JP | 2000-66425 | 3/2000 |
| JP | 3194392 | 6/2001 |
| JP | 3262488 | 12/2001 |
| JP | 2002-268246 A | 9/2002 |
| JP | 2002-268257 A | 9/2002 |
| JP | 2002-341571 A | 11/2002 |
| JP | 2003-241404 A | 8/2003 |
| JP | 2004-302450 | 10/2004 |
| JP | 2004-302451 | 10/2004 |
| JP | 2004-302452 | 10/2004 |

(Continued)

*Primary Examiner* — Thorl Chea
(74) *Attorney, Agent, or Firm* — Oblon, Spivak, McClelland, Maier & Neustadt, L.L.P.

(57) ABSTRACT

A method of preparing an electrophotographic photoreceptor, including forming a photosensitive layer on an electroconductive substrate; and forming a surface layer on the photosensitive layer, wherein the surface layer is formed by a spray coating comprising a spray droplet having an average diameter ($D_{50}$) not greater than 10 μm.

10 Claims, 4 Drawing Sheets

FOREIGN PATENT DOCUMENTS

| | | | |
|---|---|---|---|
| JP | 2005-315963 | A | 11/2005 |
| JP | 2006-30329 | A | 2/2006 |
| JP | 2006-217667 | A | 8/2006 |
| JP | 2006-227179 | A | 8/2006 |
| JP | 2006-276806 | A | 10/2006 |
| JP | 3871304 | | 10/2006 |

* cited by examiner

ELECTROPHOTOGRAPHIC PHOTORECEPTOR, METHOD OF PREPARING THE PHOTORECEPTOR, AND IMAGE FORMING METHOD, IMAGE FORMING APPARATUS AND PROCESS CARTRIDGE THEREFOR USING THE PHOTORECEPTOR

BACKGROUND OF THE INVENTION

1. Field of the Invention

The present invention relates to an electrophotographic photoreceptor and a method of preparing the photoreceptor, and to an image forming method, an image forming apparatus and a process cartridge therefor using the photoreceptor.

2. Discussion of the Background

Recently, organic photoreceptors (OPCs) have been widely used instead of inorganic photoreceptors for copiers, facsimiles, laser printers and their complex machines because of their good performances and advantages. Specific examples of the reasons include (i) optical properties such as a wide range of light absorbing wavelength and a large amount of absorbing light; (ii) electrical properties such as high sensitivity and stable chargeability; (iii) choice of the materials; (iv) good manufacturability; (v) low cost; (vi) non-toxicity, etc.

On the other hand, as image forming apparatuses become smaller, photoreceptors have smaller diameters recently. In addition, photoreceptors are required to have high durability as image forming apparatuses produce images at a higher speed and are free from maintenance. In this respect, the organic photoreceptor typically has a soft surface layer mainly formed from a low-molecular-weight charge transport material and an inactive polymer, and therefore the organic photoreceptor typically has a drawback of being mechanically abraded with an image developer and a cleaner with ease when repeated used in the electrophotographic process. In addition, as toner particles has smaller particle diameters due to requirements for high-quality images, cleaning blades need to have higher rubber hardness and higher contact pressure for the purpose of increasing cleanability, and which also accelerates abrading photoreceptors. Such abrasions of photoreceptors deteriorate electrical properties thereof such as sensitivities and chargeabilities, and cause abnormal images such as image density deterioration and background fouling. When a photoreceptor is locally abraded, images having black stripes due to defective cleaning are produced. At present, photoreceptors are exchanged because of these abrasions and damages.

Therefore, it is indispensable to decrease the abrasion amount of the organic photoreceptor so as to have high durability. This is the most pressing issue to solve in this field.

As methods of improving the abrasion resistance of a photoreceptor, (1) Japanese Published Unexamined Patent Application No. 56-48637 discloses a photoreceptor using a hardening binder in its surface layer; (2) Japanese Published Unexamined Patent Application No. 64-1728 discloses a photoreceptor using charge transport polymer material; and (3) Japanese Published Unexamined Patent Application No. 4-281461 discloses a photoreceptor having a surface layer wherein an inorganic filler is dispersed. The photoreceptor using a hardening binder of (1) tends to increase a residual potential and decrease image density because of a poor solubility of the binder with a charge transport material and impurities such as a polymerization initiator and an unreacted residual group. The photoreceptor using charge transport polymer material of (2) and the photoreceptor having a surface layer wherein an inorganic filler is dispersed of (3) have abrasion resistance to some extent, but which is not fully satisfactory. Further, the photoreceptor having a surface layer wherein an inorganic filler is dispersed of (3) tends to increase a residual potential and decrease image density because of a trap present on the surface of the inorganic filler. Any of the photoreceptors of (1) to (3) does not have fully satisfactory integrated durability such as electrical durability and mechanical durability.

To improve the abrasion resistance of the photoreceptor of (1), Japanese Patent No. 3262488 discloses a photoreceptor including hardened urethane acrylate. However, although disclosing that the photosensitive layer includes the hardened urethane acrylate, Japanese Patent No. 3262488 only discloses that a charge transport material may be included therein and does not disclose specific examples thereof. When a low-molecular-weight charge transport material is simply included in a photosensitive layer, the low-molecular-weight charge transport material is not soluble with the hardened urethane acrylate and the low-molecular-weight charge transport material separates out, and which causes deterioration of mechanical strength of the resultant photoreceptor such as a crack. In addition, Japanese Patent No. 3262488 discloses that a polycarbonate resin is included in the photosensitive layer to improve the solubility. However, a content of the hardened urethane acrylate decreases, resulting in insufficient abrasion resistance of the photoreceptor. A photoreceptor not including a charge transport material in its surface layer, which is thin against deterioration of potential of the irradiated part, has a short life. In addition, the charged potential thereof has poor stability against environment.

As an abrasion resistance technology of a photosensitive layer in place of these technologies, Japanese Patent No. 3194392 discloses a method of forming a charge transport layer using a coating liquid formed from a monomer having a carbon-carbon double bond, a charge transport material having a carbon-carbon double bond and a binder resin. The binder resin includes a binder resin having a carbon-carbon double bond and a reactivity with the charge transport material, and a binder resin having neither a carbon-carbon double bond nor a reactivity with the charge transport material. The photoreceptor has good abrasion resistance and electrical properties. However, when a binder resin not having a reactivity with a charge transport material, such as an acrylic polymer, a styrene polymer, an acrylic styrene copolymer, a polyester resin, a polycarbonate resin and an epoxy resin, a bonding amount between the monomer having a carbon-carbon double bond and the charge transport material having a carbon-carbon double bond decreases, resulting in insufficient crosslink density of the photosensitive layer. Further, since the binder resin itself does not have toughness, the resultant photosensitive layer does not have satisfactory abrasion resistance.

Japanese Published Unexamined Patent Application No. 2000-66425 discloses a photosensitive layer including a hardened positive hole transport compound having two or more chain polymerizable functional groups in the same molecule. However, since the photosensitive layer includes a bulky positive hole transport material having two or more chain polymerizable functional groups, a distortion appears in the hardened compound and an internal stress increases to cause a roughness and a crack of the surface layer, resulting in insufficient durability of the resultant photoreceptor.

Japanese Published Unexamined Patent Applications Nos. 2004-302450, 2004-302451 and 2004-302452 disclose across linked charge transport layer in which a tri- or more functional radical polymerizable monomer having no charge transportable structure and a monofunctional radical polymerizable compound having a charge transportable structure are hardened, wherein the monofunctional radical polymerizable compound having a charge transportable structure improves mechanical and electrical durability of the layer and prevents the layer from being cracked. Such a crosslinked surface layer is typically coated on a photosensitive layer, and constituents of the photosensitive layer are occasionally dissolved in the surface layer when coated on photosensitive layer and prevents the surface layer from being crosslinked. Such a dissolution causes a poorly hardened surface layer and deteriorates the abrasion resistance and electrical properties due to an unreacted residual group of the resultant photoreceptor. These depend on the interfacial state of the surface layer and the photosensitive layer, and can be improved by methods of coating a surface layer disclosed in Japanese Published Unexamined Patent Applications Nos. 6-308757 and 2003-98695. However, Japanese Published Unexamined Patent Applications Nos. 2004-302450, 2004-302451 and 2004-302452 do not disclose a detailed method of coating a surface layer. Japanese Published Unexamined Patent Application No. 6-308757 discloses a method of using a solvent insoluble in a photosensitive layer for a surface layer coating liquid to prevent dissolution of the photosensitive layer. However, the surface layer and the photosensitive layer are not at all dissolved with each other by this method and the adhesiveness therebetween is weak, resulting in possible increase of the abrasion of the resultant photoreceptor when used for long periods. Japanese Published Unexamined Patent Application No. 2003-98695 discloses a method of regulating spray coating speed for forming a surface layer to improve the adhesiveness thereof and stabilize electrical properties of the resultant photoreceptor. However, this surface layer is not crosslinked cannot be expected to have high abrasion resistance.

Because of these reasons, a need exists for an electrophotographic photoreceptor having high durability and satisfactory electrical properties.

SUMMARY OF THE INVENTION

Accordingly, an object of the present invention is to provide an electrophotographic photoreceptor having high abrasion resistance, good and stable electrical properties and good durability for long periods.

Another object of the present invention is to provide a method of preparing the photoreceptor.

A further object of the present invention is to provide an image forming method using the photoreceptor.

Another object of the present invention is to provide an image forming apparatus using the photoreceptor.

A further object of the present invention is to provide a process cartridge therefor, using the photoreceptor.

These objects and other objects of the present invention, either individually or collectively, have been satisfied by the discovery of a method of preparing an electrophotographic photoreceptor, comprising:

forming a photosensitive layer on an electroconductive substrate; and forming a surface layer on the photosensitive layer, wherein the surface layer is formed by a spray coating comprising a spray droplet having an average diameter ($D_{50}$) not greater than 10 μm.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
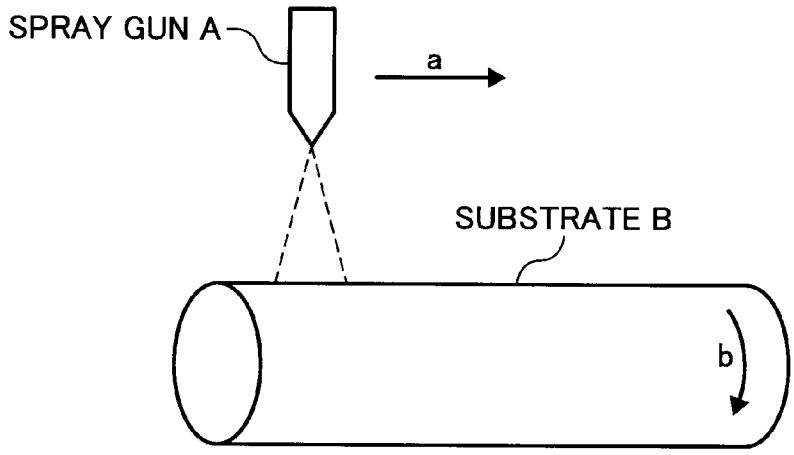
FIG. 1 is a schematic view for explaining a spray coating for forming a surface layer of the electrophotographic photoreceptor of the present invention.

The present invention provides an electrophotographic photoreceptor having high abrasion resistance, good and stable electrical properties and good durability for long periods. More particularly, the present invention relates to a method of preparing an electrophotographic photoreceptor, comprising:

forming a photosensitive layer on an electroconductive substrate; and forming a surface layer on the photosensitive layer, wherein the surface layer is formed by a spray coating comprising a spray droplet having an average diameter ($D_{50}$) not greater than 10 μm.

When a surface layer is formed on a photosensitive layer while constituents thereof such as a charge transport material and a polymer are dissolved in the surface layer, the abrasion resistance and electrical properties of the resultant photoreceptor deteriorate. This is because the constituents of the photosensitive layer mixed in the surface layer interfere with the crosslinking reaction thereof and deteriorate hardness thereof, and unreacted residual groups increase due to the reaction rate deterioration and the charge transportability deteriorates.

The present inventors discovered that a surface layer having higher curability can be formed by regulating the interfacial state of the surface layer and the photosensitive layer. The surface layer of the photoreceptor of the present invention is formed by a spray coating method spraying droplets having an average diameter $D_{50}$ not greater than 10 μm. This decreases the dissolution of the constituents of the photosensitive layer after a surface layer coating liquid is coated thereon and a surface layer is formed in good condition to have high abrasion resistance. In addition, when the surface layer is crosslinked, the crosslinking reaction is performed in good condition because the dissolution of the constituents of the photosensitive layer decreases and the resultant surface layer has both high abrasion resistance and improved electrical properties because the unreacted residual groups therein decrease.

The photoreceptor of the present invention includes a tri- or more functional radical polymerizable monomer in its surface layer, which develops a three-dimensional network, and therefore the surface layer becomes a very hard crosslinked layer having high crosslink density and high abrasion resistance. The crosslinked surface layer of the present invention including the tri- or more functional radical polymerizable monomer having no charge transportable structure and a radical polymerizable compound having a charge transportable structure, which are hardened at the same time in a short time to form a crosslinked bonding having high hardness, has improved durability. Further, a uniform crosslinked film with less distortion can be formed therein. In addition, including the radical polymerizable compound having a charge transportable structure, the crosslinked layer has stable electrical properties without crack.

Next, the surface layer coating method of the present invention will be explained. The surface layer coating method includes a spray coating method, a ring coat method, a dip coating method, etc. However, the ring coat method and dip coating method are difficult to control the dissolution of the photosensitive layer constituents. The spray coating method can control the dissolution of the photosensitive layer constituents by controlling the coating conditions and forms a good surface layer. The present invention forms a surface layer by spray coating comprising a spray droplet having an average diameter ($D_{50}$) not greater than 10 μm, and more preferably not greater than 8 μm, which decreases the dissolution of the photosensitive layer constituents when coating the surface layer. When greater than 10 μm, the dissolution of the photosensitive layer constituents increases, causing an interference with hardening of the surface layer, the high abrasion resistance and stable electrical properties cannot be expected.

In the present invention, any spray guns such as an air spray gun, an airless spray gun and an electrostatic spray gun can be used. FIG. 1 is a schematic view for explaining a spray coating method of coating a crosslinked surface layer. In FIG. 1, (A) is a spray gun and (B) is a substrate to be coated. The substrate is a cylindrical photoreceptor on which a photosensitive layer is coated. The substrate (B) rotates in the direction of an arrow b, and the spray gun (A) travels in the direction of arrow a atomizing the coating liquid to coat the substrate (B) therewith. In the present invention, spray guns PC308 from OLYMPOS and A100 from Meij i-Machine Co., Ltd. are used. PC308 has a cup including a coating liquid and atomizes the coating liquid with compressed air. The discharge amount of the liquid is controlled by opening of a nozzle. The discharge amount is based on an amount of the liquid discharged for 30 sec. A100 is filled with a coating liquid with a syringe pump and atomizes the liquid. The discharge amount is based on a preset value of the syringe pump.

Figure 2:
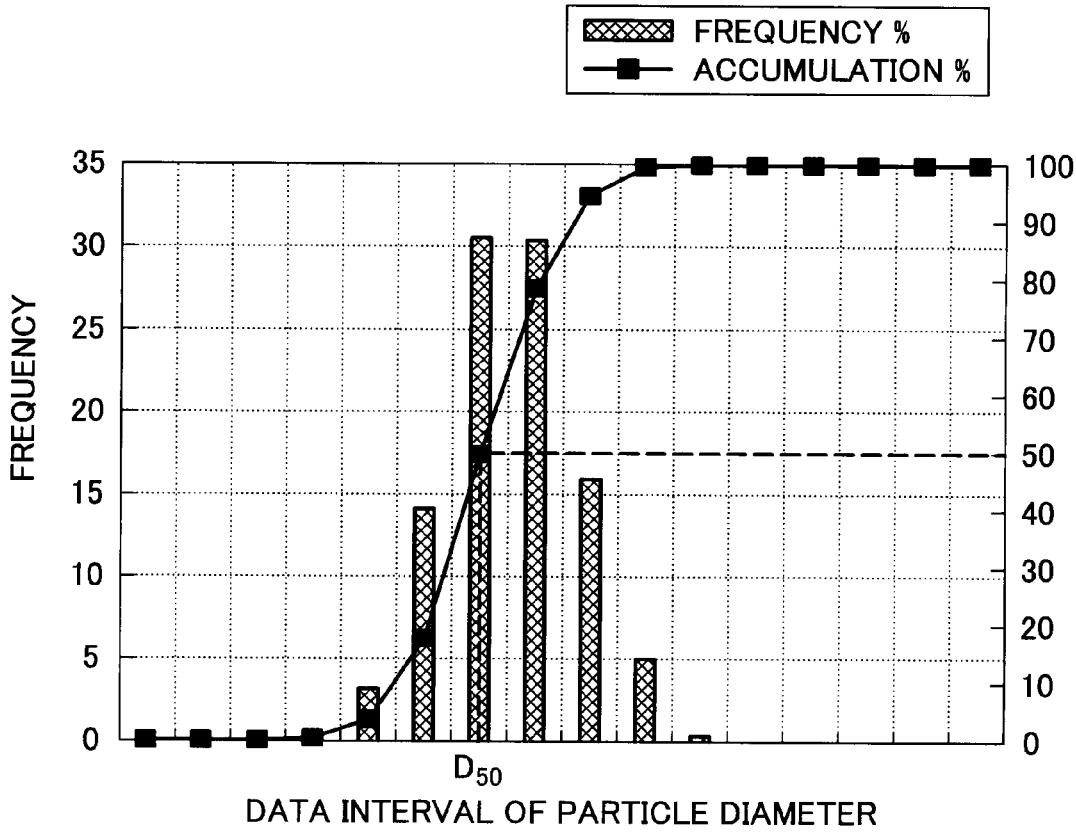
FIG. 2 is a histogram showing a particle diameter distribution of sprayed droplets, which is measured by a laser light scattering particle diameter distribution measurer.

In the present invention, the spray droplet diameter distribution is measured with a laser light scattering particle diameter distribution measurer LDSA-3500A from Tohnichi Computer Applications Co., Ltd., but any measurers having performances equivalent thereto can be used. When measuring the droplet diameter distribution, a distance between the spray gun and the laser is set to have the same distance between the nozzle and the substrate when coating the surface layer, and the droplet diameter when atomized with the spray gun is read by the laser to measure the droplet diameter distribution. The measurement is continuously performed 100 times at an interval of 0.1 sec. FIG. 2 is a droplet diameter distribution histogram. $D_{50}$ is an average of half cumulative curve of 100 droplet diameter distributions.

The spray droplet diameter can be controlled with any of a solvent for the coating liquid, a viscosity thereof, a dilution rate thereof, a discharge amount of the spray gun, an atomizing pressure and a distance between the nozzle and the substrate. The distance between the nozzle and the substrate is from 20 to 100 mm, otherwise the surface layer is irregularly coated and adherence rate thereof to the photosensitive layer largely deteriorates. It is preferable that the spray gun has a traveling speed not faster than 10 mm/s and the substrate has a rotation speed not faster than 80 rpm in terms of preventing irregular coatings although they are optional. The coating liquid preferably has solubility with the photosensitive layer constituents in order to ensure the adhesiveness between the surface layer and the photosensitive layer.

The crosslinked surface layer preferably has a thickness of from 5 to 20 μm. When less than 5 μm, the irregular thickness causes irregular durability of the resultant photoreceptor. When greater than 20 μm, the charge scatters, resulting in deterioration of image reproducibility. The thickness is preferably controlled with the discharge amount and traveling speed of the spray gun although the coating liquid conditions or the spray conditions.

Next, constituents of a surface layer coating liquid for use in the present invention will be explained. In the present invention, a crosslinkable and polymerizable compound is preferably included in the surface layer coating liquid. Particularly, the tri- or more functional radical polymerizable monomer having no charge transportable structure and the radical polymerizable compound having a charge transportable structure are more preferably used. The tri- or more functional monomers having no charge transportable structure mean monomers which have three or more radical polymerizable groups and which do not have a charge transportable structure (such as a positive hole transport structure (e.g., triarylamine, hydrazone, pyrazoline and carbazole structures); and an electron transport structure (e.g., condensed polycyclic quinine structure, diphenoquinone structure, a cyano group and a nitro group)). As the radical polymerizable groups, any radical polymerizable groups having a carbon-carbon double bond can be used. Suitable radical polymerizable groups include the following 1-substituted ethylene groups and 1,1-substituted ethylene groups.

Specific examples of the 1-substituted ethylene groups include functional groups having the following formula (1):

$$CH_2{=}CH{-}X_1{-} \quad (1)$$

wherein $X_1$ represents an arylene group (such as a phenylene group and a naphthylene group), which optionally has a substituent, a substituted or unsubstituted alkenylene group, a —CO— group, a —COO— group, a —CON($R^{10}$) group (wherein $R^{10}$ represents a hydrogen atom, an alkyl group (e.g., a methyl group, and an ethyl group), an aralkyl group (e.g., a benzyl group, a naphthylmethyl group and a phenetyl group) or an aryl group (e.g., a phenyl group and a naphthyl group)), or a —S— group.

Specific examples of the substituents include a vinyl group, a styryl group, 2-methyl-1,3-butadienyl group, a vinyl carbonyl group, acryloyloxy group, acryloylamide, vinyl thioether, etc. Specific examples of the 1,1-substituted ethylene groups include functional groups having the following formula (2):

$$CH_2{=}C(Y){-}X_2{-} \quad (2)$$

wherein Y represents a substituted or unsubstituted alkyl group, a substituted or unsubstituted aralkyl group, a substituted or unsubstituted aryl group (such as phenyl and naphthyl groups), a halogen atom, a cyano group, a nitro group, an alkoxyl group (such as methoxy and ethoxy groups), or a —$COOR_{31}$ group (wherein $R_{31}$ represents a hydrogen atom, a substituted or unsubstituted alkyl group (such as methyl and ethyl groups), a substituted or unsubstituted aralkyl group (such as benzyl and phenethyl groups), a substituted or unsubstituted aryl group (such as phenyl and naphthyl groups) or a —$CONR_{32}R_{33}$ group (wherein each of $R_{32}$ and $R_{33}$ represents a hydrogen atom, a substituted or unsubstituted alkyl group (such as methyl and ethyl groups), a substituted or unsubstituted aralkyl group (such as benzyl, naphthylmethyl and phenethyl groups), a substituted or unsubstituted aryl group (such as phenyl and naphthyl groups); and $X_2$ represents a group selected from the groups mentioned above for use in $X_1$ and an alkylene group, wherein at least one of Y and $X_2$ is an oxycarbonyl group, a cyano group, an alkenylene group or an aromatic group.

Specific examples of the substituents include an α-chloroacryloyloxy group, a methacryloyloxy group, an α-cyanoethylene group, an α-cyanoacryloyloxy group, an α-cyanophenylene group, a methacryloylamino group, etc.

Specific examples of the substituents for use in the groups $X_1$, $X_2$ and Y include halogen atoms, a nitro group, a cyano group, alkyl groups (such as methyl and ethyl groups), alkoxy groups (such as methoxy and ethoxy groups), aryloxy groups (such as a phenoxy group), aryl groups (such as phenyl and naphthyl groups), aralkyl groups (such as benzyl and phenethyl groups), etc.

The acryloyloxy groups and methacryloyloxy groups are preferably used as the radical polymerizable functional groups. Radical polymerizable monomers having three or more radical polymerizable functional groups, i.e., acryloyloxy groups or methacryloyloxy groups are preferably used in terms of improving the abrasion resistance of the resultant surface layer. Compounds having three or more acryloyloxy groups can be prepared by subjecting (meth)acrylic acid (salts), (meth)acrylhalides and (meth)acrylates, which have three or more hydroxyl groups, to an ester reaction or an ester exchange reaction. The three or more radical polymerizable groups included in a radical polymerizable tri- or more functional monomer are the same as or different from the others therein.

Specific examples of the radical polymerizable tri- or more functional monomers include, but are not limited to, trimethylolpropane triacrylate (TMPTA), trimethylolpropane trimethacrylate, trimethylolpropane alkylene-modified triacrylate, trimethylolpropane ethyleneoxy-modified triacrylate, trimethylolpropane propyleneoxy-modified triacrylate, trimethylolpropane caprolactone-modified triacrylate, trimethylolpropane alkylene-modified trimethacrylate, pentaerythritol triacrylate, pentaerythritol tetraacrylate (PETTA), glycerol triacrylate, glycerol epichlorohydrin-modified triacrylate, glycerol ethyleneoxy-modified triacrylate, glycerol propyleneoxy-modified triacrylate, tris(acryloxyethyl)isocyanurate, dipentaerythritol hexaacrylate (DPHA), dipentaerythritol caprolactone-modified hexaacrylate, dipentaerythritol hydroxypentaacrylate, alkylated dipentaerythritol tetraacrylate, alkylated dipentaerythritol triacrylate, dimethylolpropane tetraacrylate (DTMPTA), pentaerythritol ethoxytriacrylate, ethyleneoxy-modified triacryl phosphate, 2,2,5,5-tetrahydroxymethylcyclopentanone tetraacrylate, etc. These monomers are used alone or in combination. These are modified because the viscosities thereof are decreased to be easily handled.

In order to form a dense crosslinked network in the crosslinked surface layer, the ratio (Mw/F) of the molecular weight (Mw) of the tri- or more functional monomer to the number of functional groups (F) included in a molecule of the monomer is preferably not greater than 250. When the number is too large, the resultant protective becomes soft and thereby the abrasion resistance of the layer slightly deteriorates. In this case, it is not preferable to use only one monomer having a functional group having a long chain group such as ethylene oxide, propylene oxide and caprolactone.

The content of the unit obtained from the tri- or more functional monomers in the crosslinked surface layer is preferably from 20 to 80% by weight, and more preferably from 30 to 70% by weight based on the total weight of the surface layer. When the content is too low, the three dimensional crosslinking density is low, and thereby good abrasion resistance cannot be imparted to the surface layer. In contrast, when the content is too high, the content of the charge transport compound decreases, good charge transport property cannot be imparted to the surface layer. In order to balance the abrasion resistance and charge transport property of the crosslinked surface layer, the content of the unit obtained from the tri- or more functional monomers in the surface layer is preferably from 30 to 70% by weight.

The radical polymerizable compound having a charge transportable structure for use in the present invention is a compound which has a positive hole transport structure such as triarylamine, hydrazone, pyrazoline and carbazole or an electron transport structure such as condensed polycyclic quinone, diphenoquinone, a cyano group and an electron attractive aromatic ring having a nitro group, and has a radical polymerizable functional group. Specific examples of the radical polymerizable functional group include the above-mentioned radical polymerizable monomers, and particularly the acryloyloxy groups and methacryloyloxy groups are effectively used. In addition, a triarylamine structure is effectively used as the charge transportable structure.

Further, when a compound having the following formula (3) or (4), electrical properties such as a sensitivity and a residual potential are preferably maintained.

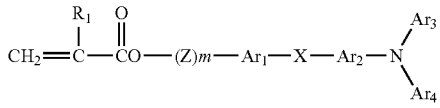

(3)

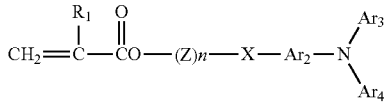

(4)

wherein $R_1$ represents a hydrogen atom, a halogen atom, a substituted or an unsubstituted alkyl group, a substituted or an unsubstituted aralkyl group, a substituted or an unsubstituted aryl group, a cyano group, a nitro group, an alkoxy group, —$COOR_2$ wherein $R_2$ represents a hydrogen atom, a halogen atom, a substituted or an unsubstituted alkyl group, a substituted or an unsubstituted aralkyl group and a substituted or an unsubstituted aryl group and a halogenated carbonyl group or $CONR_3R_4$ wherein $R_3$ and $R_4$ independently represent a hydrogen atom, a halogen atom, a substituted or an unsubstituted alkyl group, a substituted or an unsubstituted aralkyl group and a substituted or an unsubstituted aryl group; $Ar_1$ and $Ar_2$ independently represent a substituted or an unsubstituted arylene group; $Ar_3$ and $Ar_4$ independently represent a substituted or an unsubstituted aryl group; X represents a single bond, a substituted or an unsubstituted alkylene group, a substituted or an unsubstituted cycloalkylene group, a substituted or an unsubstituted alkylene ether group, an oxygen atom, a sulfur atom and vinylene group; Z represents a substituted or an unsubstituted alkylene group, a substituted or an unsubstituted alkylene ether group and alkyleneoxycarbonyl group; and m and n represent 0 and an integer of from 1 to 3.

In the formulae (3) and (4), among substituted groups of $R_1$, the alkyl groups include methyl groups, ethyl groups, propyl groups, butyl groups, etc.; the aryl groups include phenyl groups, naphtyl groups, etc.; aralkyl groups include benzyl groups, phenethyl groups, naphthylmethyl groups, etc.; and alkoxy groups include methoxy groups, ethoxy groups, propoxy groups, etc. These may be substituted by alkyl groups such as halogen atoms, nitro groups, cyano groups, methyl groups and ethyl groups; alkoxy groups such as methoxy groups and ethoxy groups; aryloxy groups such as phenoxy groups; aryl groups such as phenyl groups and naphthyl groups; aralkyl groups such as benzyl groups and phenethyl groups. The substituted group of $R_1$ is preferably a hydrogen atom and a methyl group.

$Ar_3$ and $Ar_4$ independently represent a substituted or an unsubstituted aryl group, and specific examples thereof include condensed polycyclic hydrocarbon groups, non-condensed cyclic hydrocarbon groups and heterocyclic groups.

The condensed polycyclic hydrocarbon group is preferably a group having 18 or less carbon atoms forming a ring such as a fentanyl group, a indenyl group, a naphthyl group, an azulenyl group, a heptalenyl group, a biphenylenyl group, an As-indacenyl group, a fluorenyl group, an acenaphthylenyl group, a praadenyl group, an acenaphthenyl group, a phenalenyl group, a phenantolyl group, an anthryl group, a fluoranthenyl group, an acephenantolylenyl group, an aceanthrylenyl group, a triphenylel group, a pyrenyl group, a crycenyl group and a naphthacenyl group.

Specific examples of the non-condensed cyclic hydrocarbon groups and heterocyclic groups include monovalent groups of monocyclic hydrocarbon compounds such as benzene, diphenylether, polyethylenediphenylether, diphenylthioether, and diphenylsulfone; monovalent groups of non-condensed hydrocarbon compounds such as biphenyl, polyphenyl, diphenylalkane, diphenylalkene, diphenylalkine, triphenylmethane, distyrylbenzene, 1,1-diphenylcycloalkane, polyphenylalkane and polyphenylalkene; and monovalent groups of ring gathering hydrocarbon compounds such as 9,9-diphenylfluorene.

Specific examples of the heterocyclic groups include monovalent groups such as carbazole, dibenzofuran, dibenzothiophene, oxadiazole and thiadiazole.

Specific examples of the substituted or unsubstituted aryl group represented by $Ar_3$ and $Ar_4$ include the following groups:

(1) a halogen atom, a cyano group and a nitro group;

(2) a straight or a branched-chain alkyl group having 1 to 12, preferably from 1 to 8, and more preferably from 1 to 4 carbon atoms, and these alkyl groups may further include a fluorine atom, a hydroxyl group, a cyano group, an alkoxy group having 1 to 4 carbon atoms, a phenyl group or a halogen atom, an alkyl group having 1 to 4 carbon atoms or a phenyl group substituted by an alkoxy group having 1 to 4 carbon atoms. Specific examples of the alkyl groups include methyl groups, ethyl groups, n-butyl groups, i-propyl groups, t-butyl groups, s-butyl groups, n-propyl groups, trifluoromethyl groups, 2-hydroxyethyl groups, 2-ethoxyethyl groups, 2-cyanoethyl groups, 2-methocyethyl groups, benzyl groups, 4-chlorobenzyl groups, 4-methylbenzyl groups, 4-phenylbenzyl groups, etc.

(3) alkoxy groups (—$OR_2$) wherein $R_2$ represents an alkyl group specified in (2). Specific examples thereof include methoxy groups, ethoxy groups, n-propoxy groups, 1-propoxy groups, t-butoxy groups, s-butoxy groups, 1-butoxy groups, 2-hydroxyethoxy groups, benzyloxy groups, trifluoromethoxy groups, etc.

(4) aryloxy groups, and specific examples of the aryl groups include phenyl groups and naphthyl groups. These aryl group may include an alkoxy group having 1 to 4 carbon atoms, an alkyl group having 1 to 4 carbon atoms or a halogen atom as a substituent. Specific examples of the aryloxy groups include phenoxy groups, 1-naphthyloxy groups, 2-naphthyloxy groups, 4-methoxyphenoxy groups, 4-methylphenoxy groups, etc.

(5) alkyl mercapto groups or aryl mercapto groups such as methylthio groups, ethylthio groups, phenylthio groups and p-methylphenylthio groups.

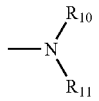

(6)

wherein $R_{10}$ and $R_{11}$ independently represent a hydrogen atom, an alkyl groups specified in (2) and an aryl group, and specific examples of the aryl groups include phenyl groups, biphenyl groups and naphthyl groups, and these may include an alkoxy group having 1 to 4 carbon atoms, an alkyl group having 1 to 4 carbon atoms or a halogen atom as a substituent, and $R_{10}$ and $R_{11}$ may form a ring together. Specific examples of the groups having this formula include amino groups, diethylamino groups, N-methyl-N-phenylamino groups, N,N-diphenylamino groups, N—N-di(tolyl)amino groups, dibenzylamino groups, piperidino groups, morpholino groups, pyrrolidino groups, etc.

(7) a methylenedioxy group, an alkylenedioxy group such as a methylenedithio group or an alkylenedithio group.

(8) a substituted or an unsubstituted styryl group, a substituted or an unsubstituted β-phenylstyryl group, a diphenylaminophenyl group, a ditolylaminophenyl group, etc.

The arylene group represented by $Ar_1$ and $Ar_2$ are derivative divalent groups from the aryl groups represented by $Ar_3$ and $Ar_4$.

The above-mentioned X represents a single bond, a substituted or an unsubstituted alkylene group, a substituted or an unsubstituted cycloalkylene group, a substituted or an unsubstituted alkyleneether group, an oxygen atom, a sulfur atom and vinylene group.

The substituted or unsubstituted alkylene group is a straight or a branched-chain alkylene group having 1 to 12, preferably from 1 to 8, and more preferably from 1 to 4 carbon atoms, and these alkylene groups may further includes a fluorine atom, a hydroxyl group, a cyano group, an alkoxy group having 1 to 4 carbon atoms, a phenyl group or a halogen atom, an alkyl group having 1 to 4 carbon atoms or a phenyl group substituted by an alkoxy group having 1 to 4-carbon atoms. Specific examples of the alkylene groups include methylene groups, ethylene groups, n-butylene groups, i-propylene groups, t-butylene groups, s-butylene groups, n-propylene groups, trifluoromethylene groups, 2-hydroxyethylene groups, 2-ethoxyethylene groups, 2-cyanoethylene groups, 2-methocyethylene groups, benzylidene groups, phenylethylene groups, 4-chlorophenylethylene groups, 4-methylphenylethylene groups, 4-biphenylethylene groups, etc.

The substituted or unsubstituted cycloalkylene group is a cyclic alkylene group having 5 to 7 carbon atoms, and these alkylene groups may include a fluorine atom, a hydroxyl group, a cyano group, an alkoxy group having 1 to 4 carbon atoms. Specific examples thereof include cyclohexylidine groups, cyclohexylene groups and 3,3-dimethylcyclohexylidine groups, etc.

Specific examples of the substituted or unsubstituted alkyleneether groups include ethylene oxy, propylene oxy, ethylene glycol, propylene glycol, diethylene glycol, tetraethylene glycol and tripropylene glycol. The alkylene group of the alkyleneether group may include a substituent such as a hydroxyl group, a methyl group and an ethyl group. The vinylene group has the following formula:

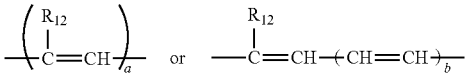

wherein $R_{12}$ represents a hydrogen atom, an alkyl group (same as those specified in (2)), an aryl group (same as those represented by $Ar_3$ and $Ar_4$); a represents 1 or 2; and b represents 1, 2 or 3.

Z represents a substituted or an unsubstituted alkylene group, a substituted or an unsubstituted divalent alkyleneether group and a divalent alkyleneoxycarbonyl group. Specific examples of the substituted or unsubstituted alkylene group include those of X. Specific examples of the substituted or unsubstituted divalent alkyleneether group include those of X. Specific examples of the divalent alkyleneoxycarbonyl group include caprolactone-modified groups.

In addition, the radical polymerizable compound having a charge transportable structure of the present invention is more preferably a compound having the following formula (5):

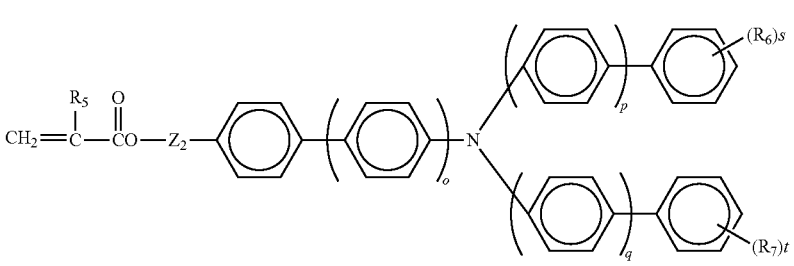

(5)

wherein o, p and q independently represent 0 or 1; $R_5$ represents a hydrogen atom or a methyl group; each of $R_6$ and $R_7$ represents a substituent besides a hydrogen atom and an alkyl group having 1 to 6 carbon atoms, and may be different from each other when having plural carbon atoms; s and t represent 0 or an integer of from 1 to 3; Za represents a single bond, a methylene group, ethylene group,

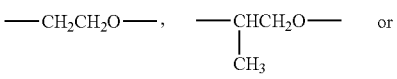

-continued

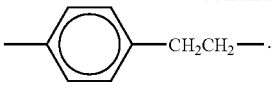

The compound having the formula (5) are preferably a compound having an methyl group or a ethyl group as a substituent of $R_6$ and $R_7$.

The monofunctional radical polymerizable compound having a charge transportable structure of the formulae (3), (4) and particularly (5) for use in the present invention does not become an end structure because a double bonding between the carbons is polymerized while opened to the both sides, and is built in a chain polymer. In a crosslinked polymer polymerized with a radical polymerizable monomer having three or more functional groups, the compound is present in a main chain and in a crosslinked chain between the main chains (the crosslinked chain includes an intermolecular crosslinked chain between a polymer and another polymer and an intramolecular crosslinked chain wherein a portion having a folded main chain and another portion originally from the monomer, which is polymerized with a position apart therefrom in the main chain are polymerized). Even when the compound is present in a main chain or a crosslinked chain, a triarylamine structure suspending from the chain has at least three aryl groups radially located from a nitrogen atom, is not directly bonded with the chain and suspends through a carbonyl group or the like, and is sterically and flexibly fixed although bulky. The triarylamine structures can spatially be located so as to be moderately adjacent to one another in a polymer, and has less structural distortion in a molecule. Therefore, it is assumed that the monofunctional radical polymerizable compound having a charge transportable structure in a surface layer of an electrophotographic photoreceptor can have an intramolecular structure wherein blocking of a charge transport route is comparatively prevented.

Further, in the present invention, a specific acrylic acid ester compound having the following formula (6) is preferably used as the monofunctional radical polymerizable compound having a charge transportable structure as well:

$$B_1—Ar_5—CH=CH—Ar_6—B_2 \quad (6)$$

wherein $Ar_5$ represents a substituted or an unsubstituted monovalent group or bivalent group formed of an aromatic hydrocarbon skeleton. Specific examples of the monovalent group or bivalent group formed of an aromatic hydrocarbon skeleton include monovalent or bivalent groups such as benzene, naphthalene, phenanthrene, biphenyl and 1,2,3,4-tetrahydronaphthalene.

Specific examples of substituents of the aromatic hydrocarbon skeleton include an alkyl group having 1 to 12 carbon atoms, an alkoxy group having 1 to 12 carbon atoms, a benzyl group and a halogen atom. The alkyl group and alkoxy group may further have a halogen atom or a phenyl group as a substituent.

$Ar_6$ represents a monovalent group or a bivalent group formed of an aromatic hydrocarbon skeleton or heterocyclic compound skeleton having one or more tertiary amino group. The aromatic hydrocarbon skeleton having a tertiary amino group has the following formula (7):

(7)

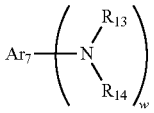

wherein $R_{13}$ and $R_{14}$ represent an acyl group, a substituted or an unsubstituted alkyl group, a substituted or an unsubstituted aryl group or a substituted or an unsubstituted alkenyl group; $Ar_7$ represents an aryl group; and h represents an integer of from 1 to 3.

Specific examples of the acyl group include an acetyl group, a propionyl group, benzoyl group, etc. Specific examples of the substituted or unsubstituted alkyl group include an alkyl group having 1 to 12 carbon atoms. Specific examples of the substituted or unsubstituted aryl group include a phenyl group, a naphthyl group, a biphenylyl group, a terphenylyl group, pyrenyl group, a fluorenyl group, 9,9-dimethyl-fluorenyl group, azulenyl group, an anthryl group, a triphenylenyl group, a chrysenyl group and groups having the following formula (8):

(8)

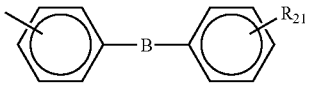

wherein B represents —O—, —S—, —SO—, —$SO_2$—, —CO— and the following bivalent groups; and R represents a hydrogen atom, an alkyl group having 1 to 12 carbon atoms, an alkoxy group, a halogen atom, the above-mentioned substituted or unsubstituted aryl groups, an amino group, a nitro group and a cyano group;

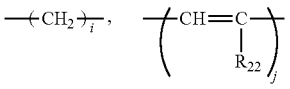

wherein $R^{22}$ represents a hydrogen atom, an alkyl group having 1 to 12 carbon atoms and the above-mentioned substituted or unsubstituted aryl groups; i represents an integer of from 1 to 12; and j represents an integer of from 1 to 3.

Specific examples of the alkoxy group include a methoxy group, an ethoxy group, a n-propoxy group, an i-propoxy group, a n-butoxy group, an i-butoxy group, a s-butoxy group, a t-butoxy group, a 2-hydroxyethoxy group, 2-cyanoethoxy group, a benzyloxy group, a 4-methylbenzyloxy group, a trifluoromethoxy group, etc.

Specific examples of the halogen atom include a fluorine atom, a chlorine atom, a bromine atom and an iodine atom.

Specific examples of the amino group include a diphenylamino group, a ditolylamino group, a dibenzylamino group, a 4-methylbenzyl group, etc.

Specific examples of the aryl group include a phenyl group, a naphthyl group, a biphenylyl group, a terphenylyl group, pyrenyl group, a fluorenyl group, 9,9-dimethyl-fluorenyl group, azulenyl group, an anthryl group, a triphenylenyl group and a chrysenyl group.

$Ar_7$, $R_{13}$ and $R_{14}$ may have an alkyl group having 1 to 12 carbon atoms, an alkoxy group and a halogen atom as a substituent.

Specific examples of the heterocyclic compound skeleton having one or more tertiary amino group include heterocyclic compounds having an amine structure such as pyrrole, pyrazole, imidazole, triazole, dioxazole, indole, isoindole, indoline, benzimidazole, benzotriazole, benzoisoxadine, carbazole and phenoxadine. These may have an alkyl group having 1 to 12-carbon atoms, an alkoxy group and a halogen atom as a substituent.

At least $B_1$ or $B_2$ is a hydrogen atom, and the other is an acryloyloxy group; a methacryloyloxy group; a vinyl group; an alkyl group having an acryloyloxy group, a methacryloyloxy group or a vinyl group; or an alkoxy group having an acryloyloxy group, a methacryloyloxy group or a vinyl group.

The acrylic acid ester compound having formula (6) is preferably a compound having the following formula (9):

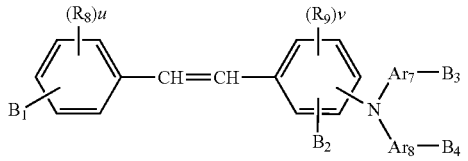

wherein $R_8$ and $R_9$ represent a substituted or an unsubstituted alkyl group, a substituted or an unsubstituted alkoxy group and a halogen atom; and $Ar_7$ and $Ar_8$ represent a substituted or an unsubstituted aryl group or arylene group, and a substituted or an unsubstituted benzyl group; $B_1$ to $B_4$ are the same groups as $B_1$ and $B_2$ in the formula (1), and only one of them is present; u represents 0 or an integer of from 1 to 5; and v represents 0 or an integer of from 1 to 4.

The acrylic acid ester compound has the following characteristics. The acrylic acid ester compound is a tertiary amine compound having a developed stilbene conjugate structure. Such a charge transport compound having a developed conjugate structure very much improves charge injection at an interface of the crosslinked layer. Further, even when fixed between crosslinked bond, intermolecular interactions are difficult to impair and has good charge transportability. Having a highly radical-polymerizable acryloyloxy group or a methacryloyloxy group, the ester acrylic acid ester compound quickly gelates when radical-polymerized and does not have an excessive crosslink distortion. The double-bonding of the stilbene conjugate structure partially participates in the polymerization, and less polymerizes than the acryloyloxy group or methacryloyloxy group, which causes a time difference in the crosslinking reaction and the strain is not maximized. In addition, the double-bonding participating in the polymerization can increase the number of crosslinking reactions per a molecular weight, resulting in higher crosslink density. Further, the double-bonding can control the polymerization with the crosslinking conditions, and can easily form a most suitable crosslinked film. Such a reaction can be performed with the esteracrylate compound of the present invention, but cannot be performed with e.g., an α-phenylstilbene double bonding.

The charge transport compound having a radical polymerizable functional group and formula (6), particularly formula (9), can form a highly-crosslinked film maintaining good electrical properties without being cracked, which prevents particulate materials such as silica from sticking to a photoreceptor and decreases defective white-spotted images.

The number of radical polymerizable functional groups is preferably less for the uniformity of a crosslinked structure, and preferably more for the abrasion resistance. In the present invention, the number thereof is determined in consideration of the balance.

Specific examples of the radical polymerizable compound having a charge transporting structure for use in the present invention include, but are not limited to, compounds having the following formulae Nos. 1 to 185.

NO. 1

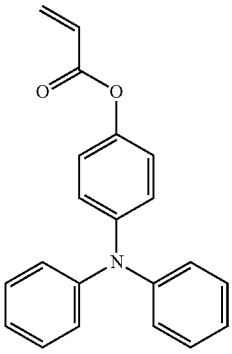

NO. 2

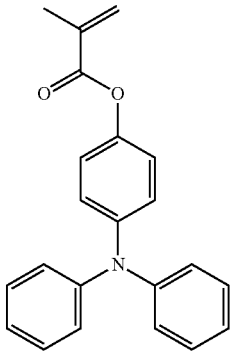

NO. 3

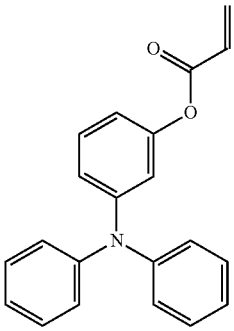

NO. 4

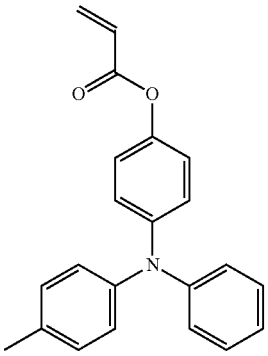

NO. 5

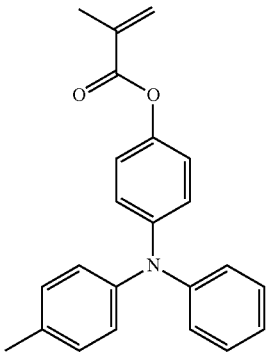

NO. 6

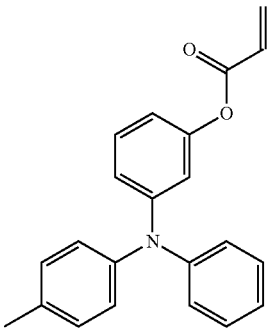

NO. 7

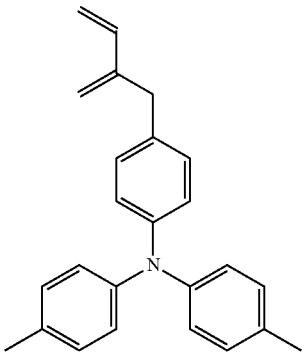

NO. 8

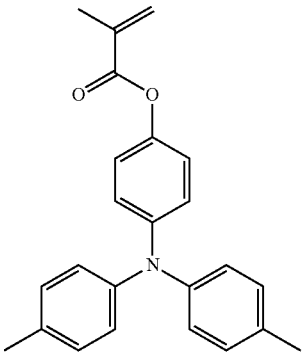

-continued
NO. 9
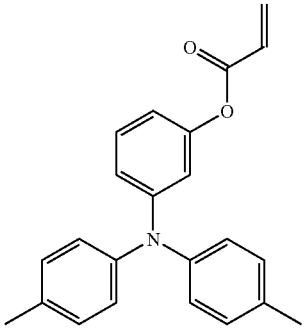
NO. 10
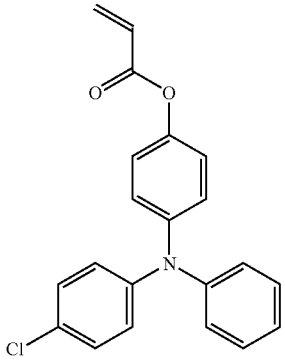
NO. 11
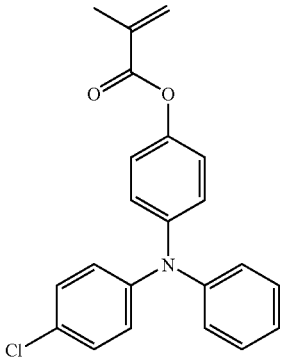
NO. 12
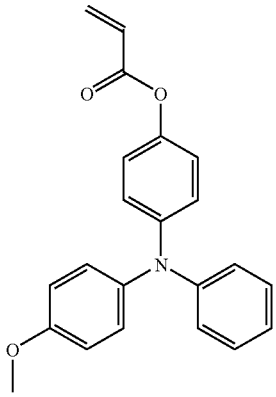
NO. 13
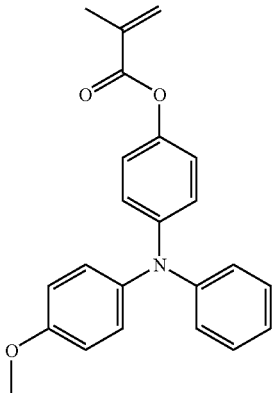
NO. 14
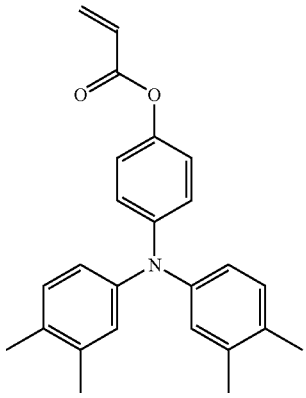
NO. 15
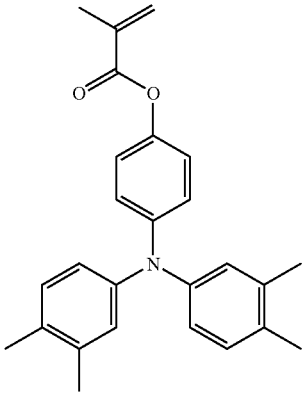
NO. 16
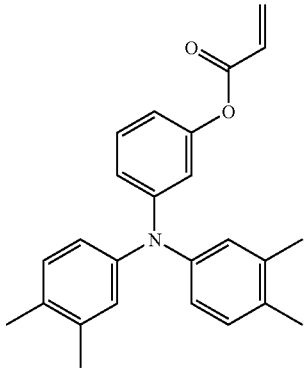

-continued
NO. 17
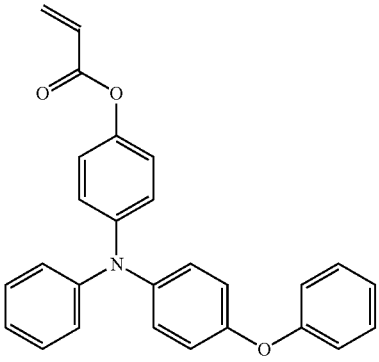
NO. 18
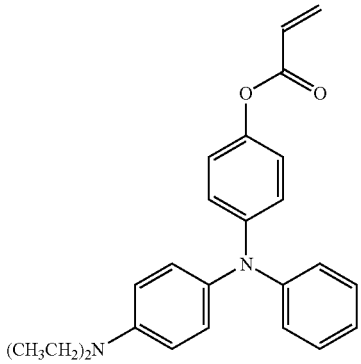
NO. 19
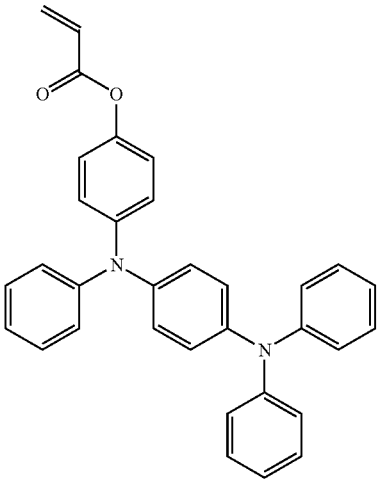
NO. 20
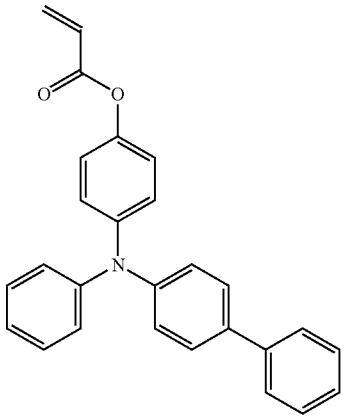
NO. 21
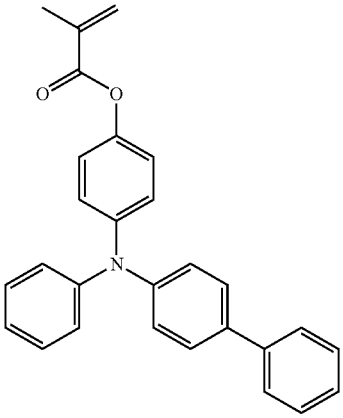
NO. 22
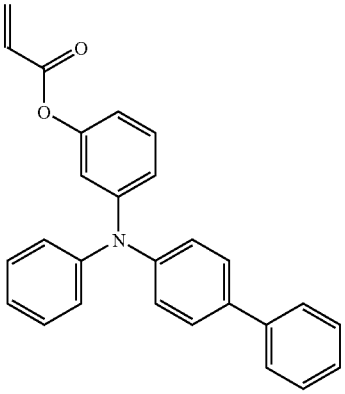

-continued
NO, 23
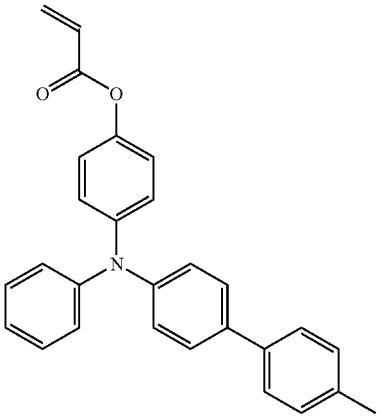
NO. 24
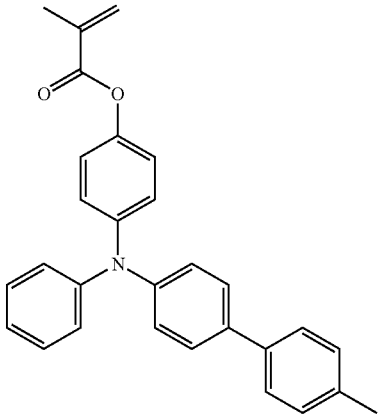
NO. 25
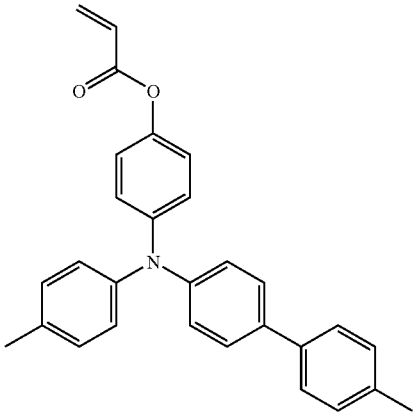
NO. 26
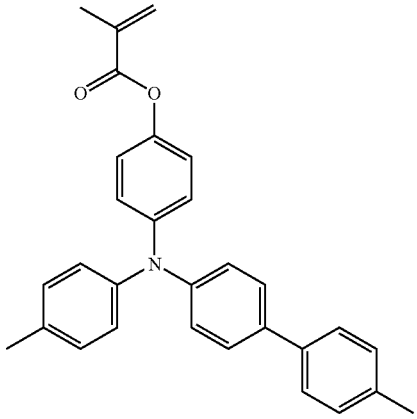
NO. 27
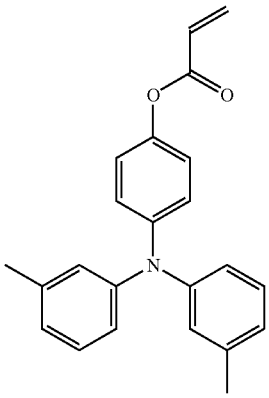
NO. 28
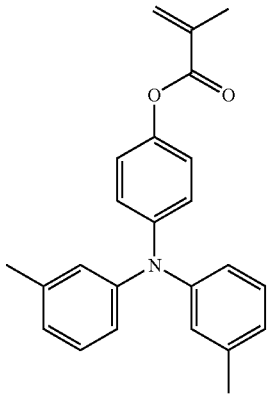
NO. 29
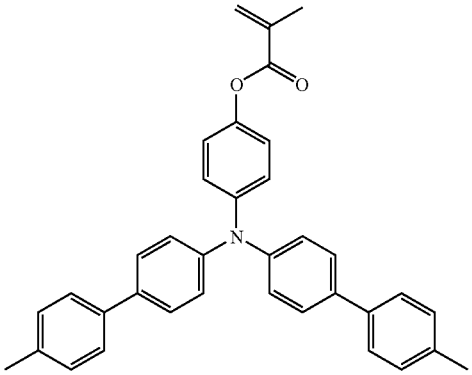
NO. 30
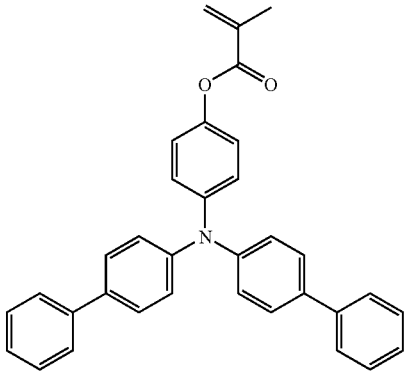

-continued
NO. 31
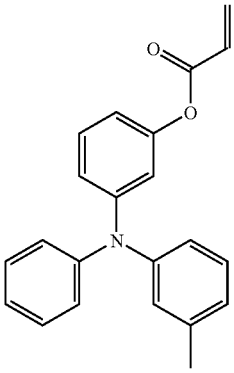
NO. 32
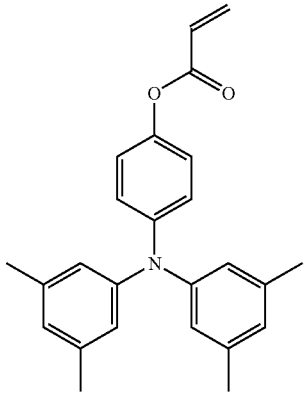
NO. 33
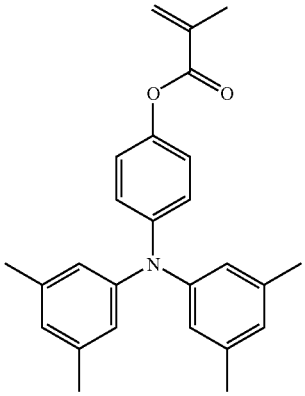
NO. 34
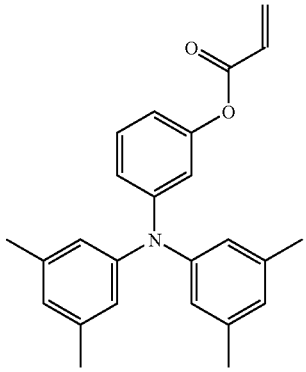
NO. 35
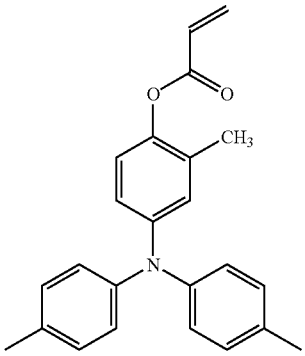
NO. 36
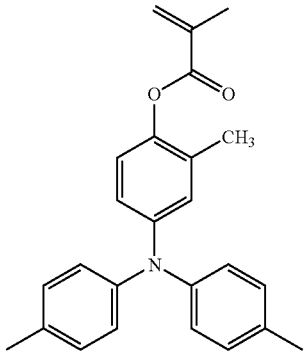
NO. 37
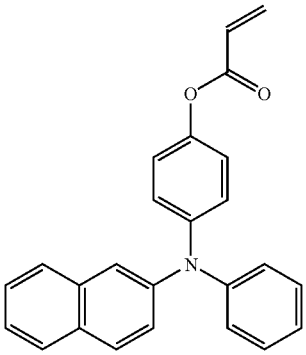
NO. 38
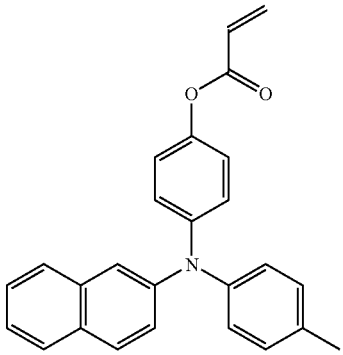

-continued
NO. 39
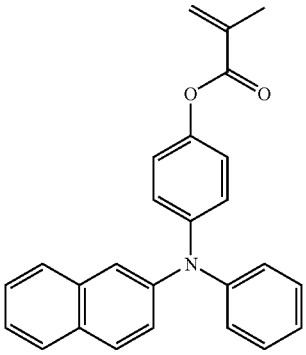
NO. 40
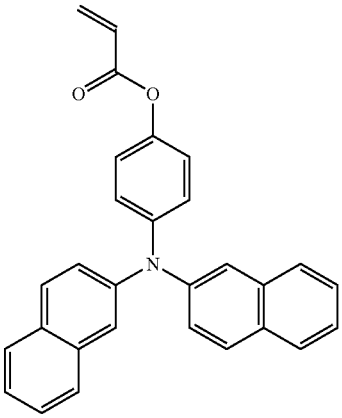
NO. 41
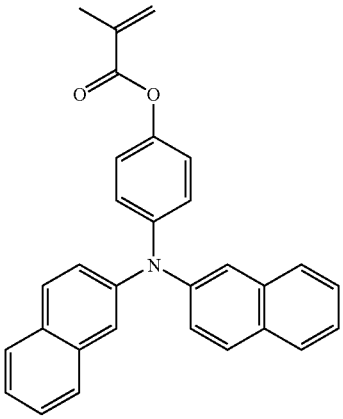
NO. 42
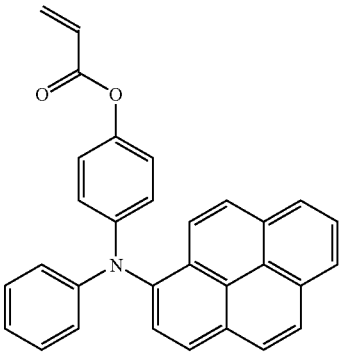
NO. 43
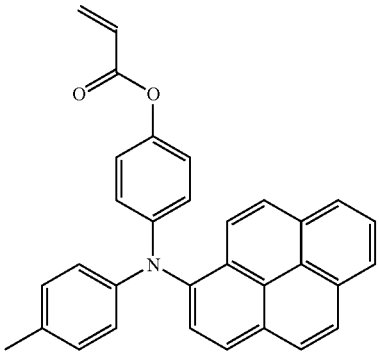
NO. 44
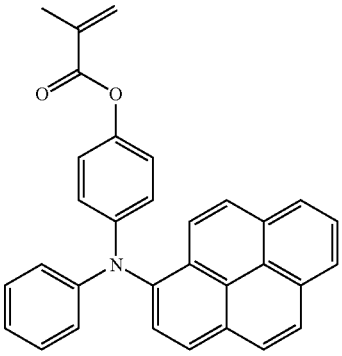

-continued
NO. 45
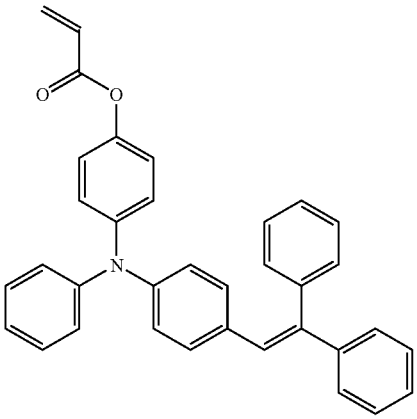
NO. 46
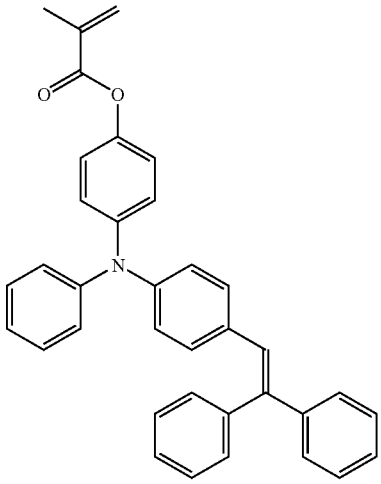
NO. 47
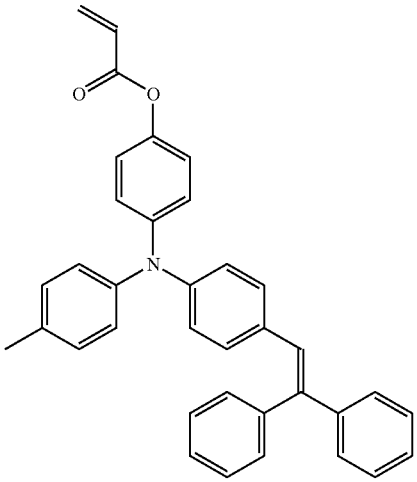
NO. 48
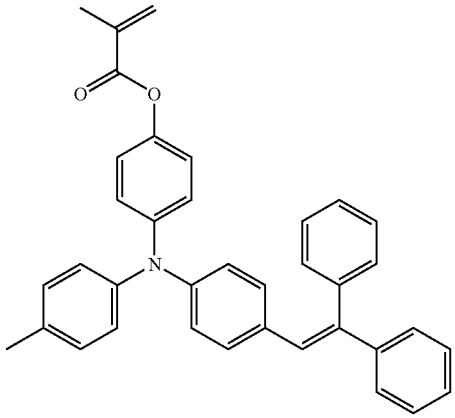
NO. 49
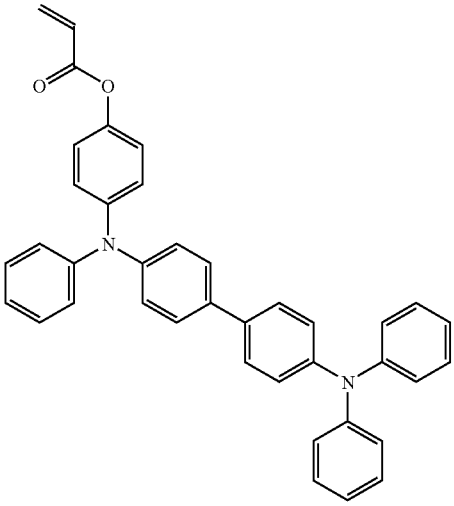
NO. 50
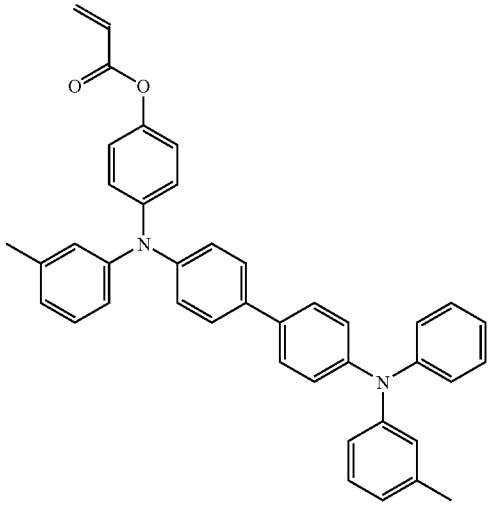

-continued
NO. 51
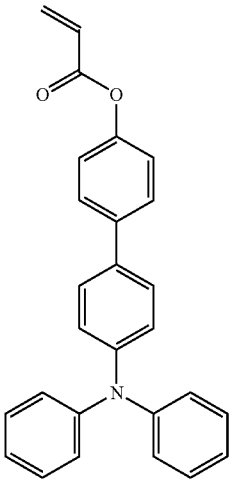
NO. 52
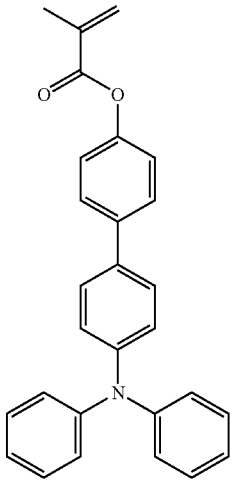
NO. 53
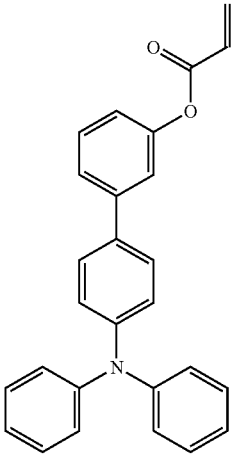
NO. 54
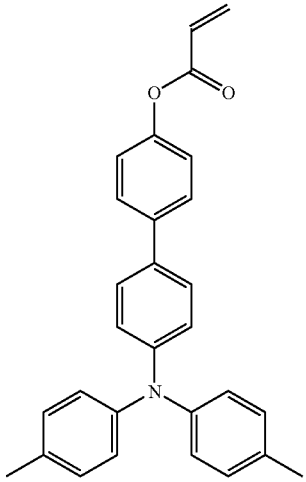
NO. 55
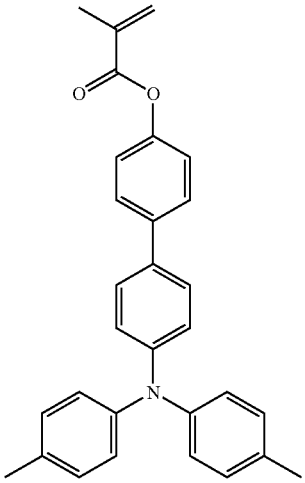
NO. 56
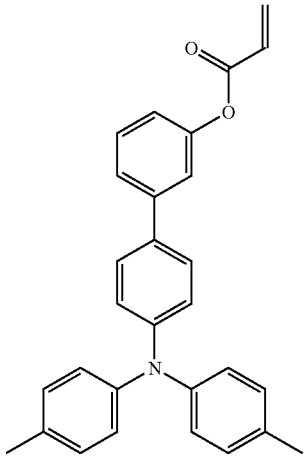

-continued
NO. 57
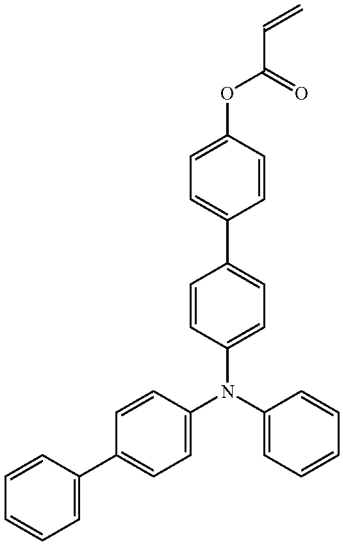
NO. 58
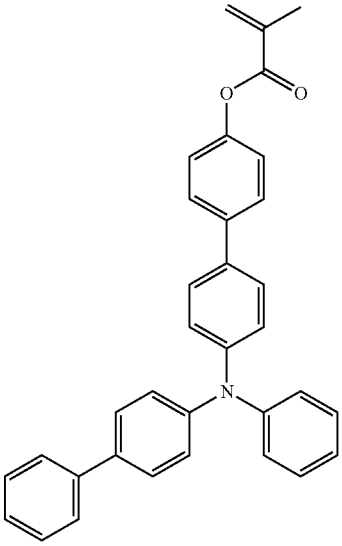
NO. 59
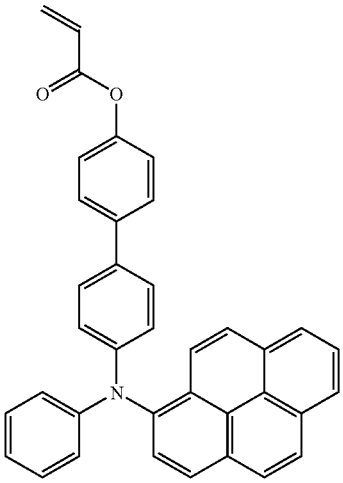
NO. 60
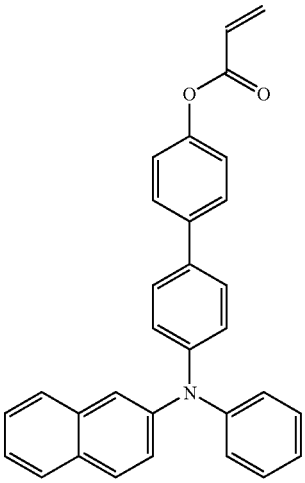
NO. 61
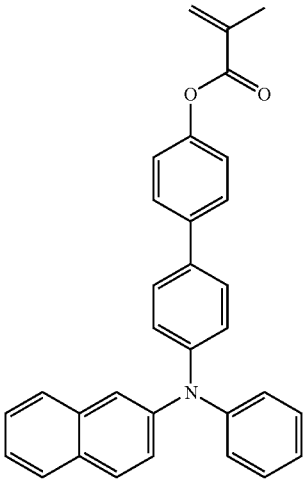
NO. 62
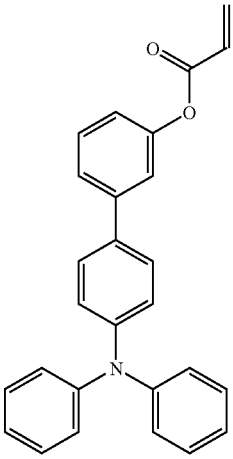

-continued
NO. 63
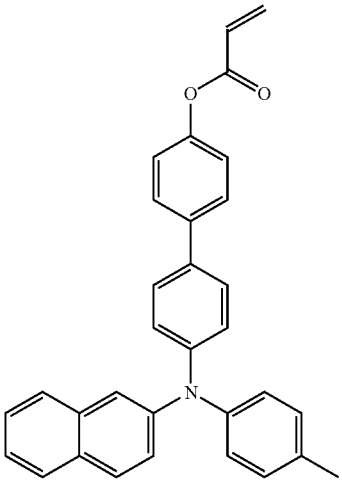
NO. 64
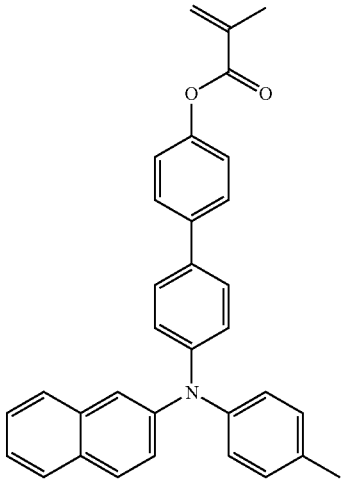
NO. 65
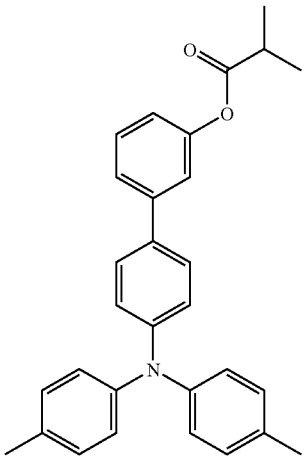
NO. 66
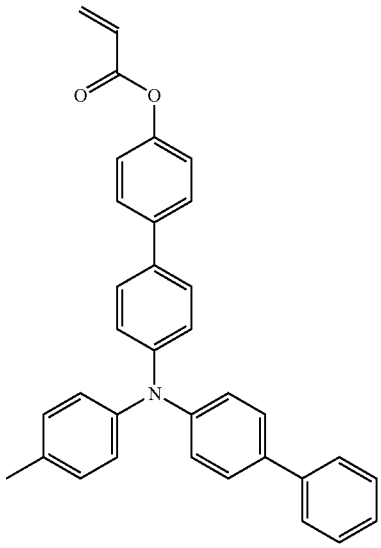
NO. 67
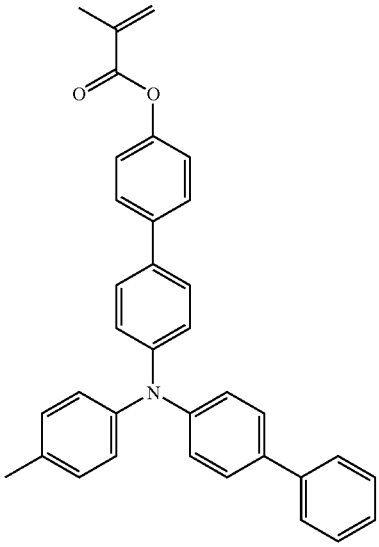
NO. 68
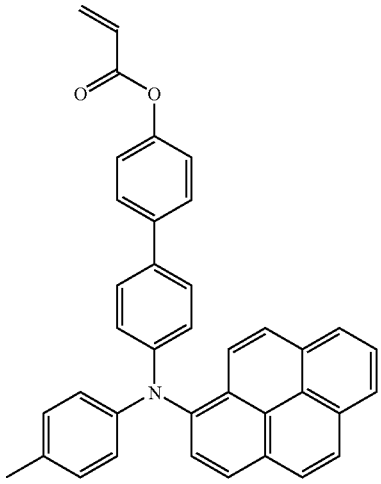

-continued
NO. 69
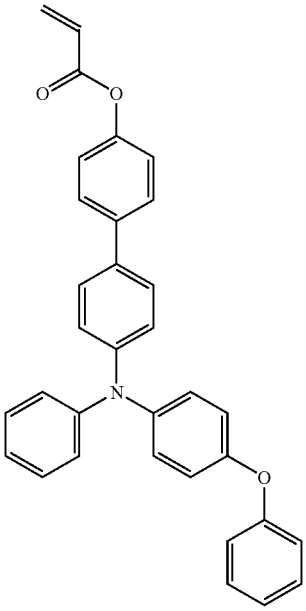
NO. 70
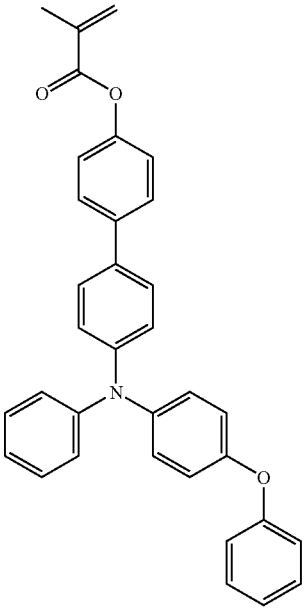
NO. 71
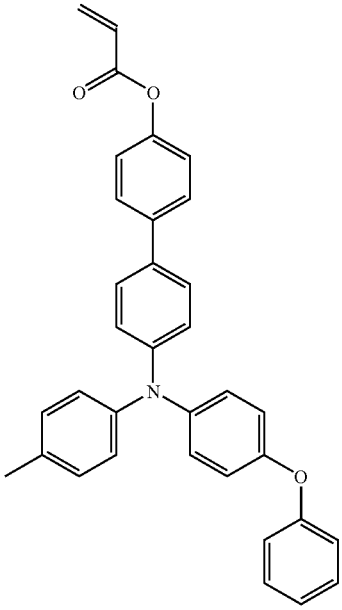
NO. 72
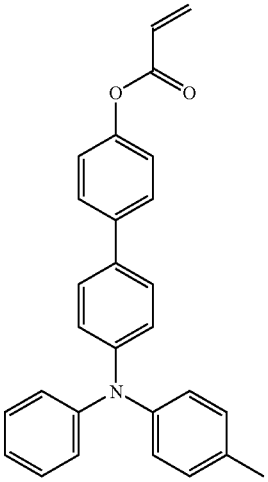

-continued
NO. 73
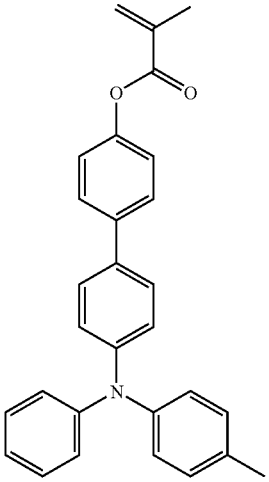
NO. 74
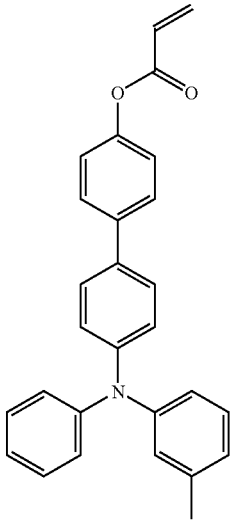
NO. 75
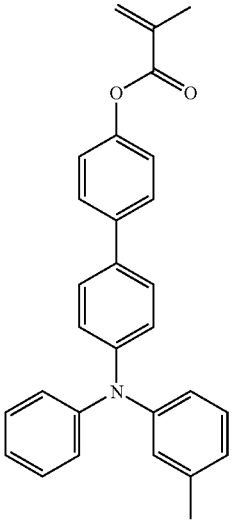
NO. 76
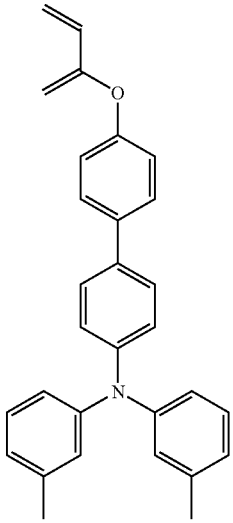
NO. 77
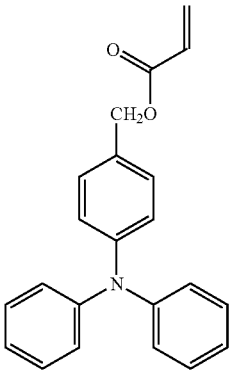
NO. 78
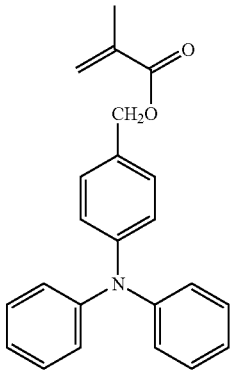

-continued
NO. 79
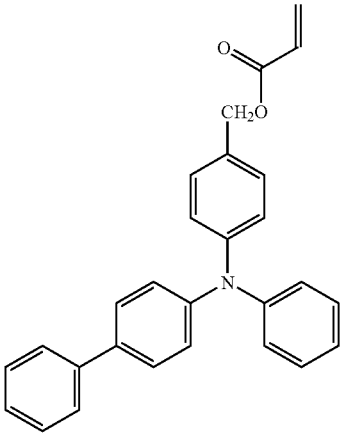
NO. 80
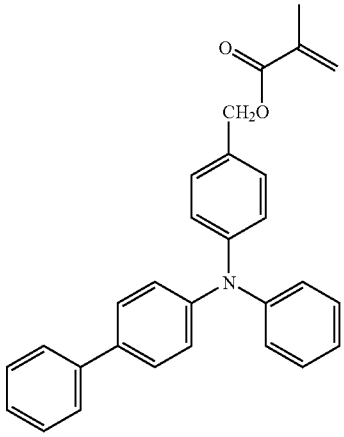
NO. 81
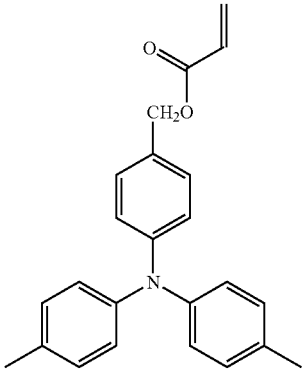
NO. 82
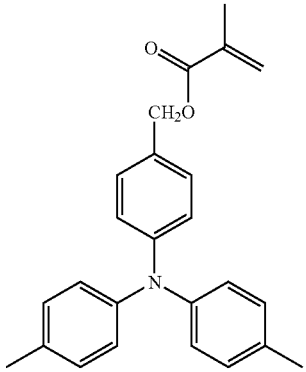
NO. 83
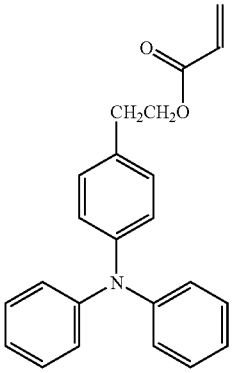
NO. 84
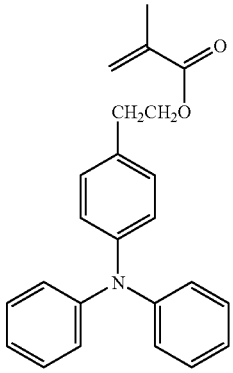
NO. 85
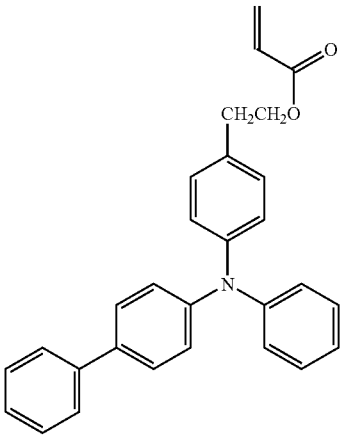
NO. 86
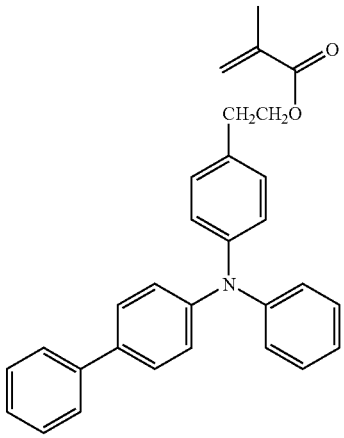

-continued
NO. 87
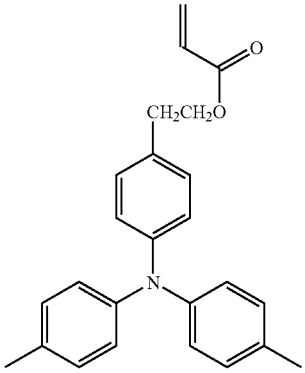
NO. 88
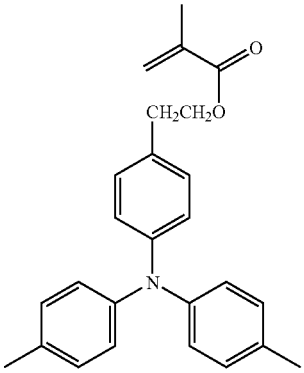
NO. 89
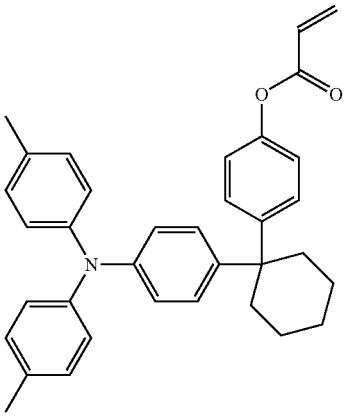
NO. 90
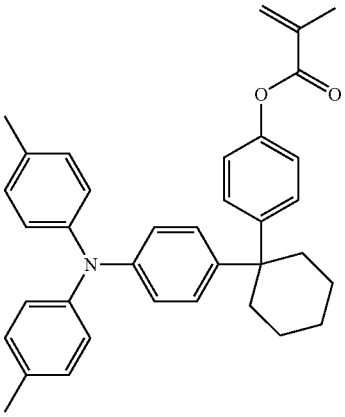
NO. 91
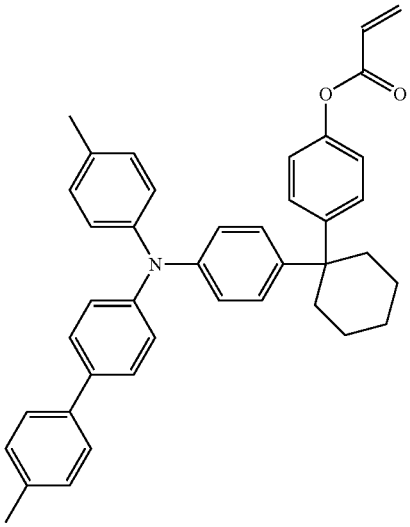
NO. 92
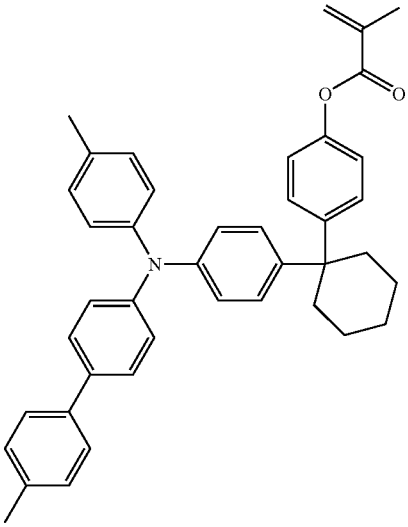

-continued
NO. 93
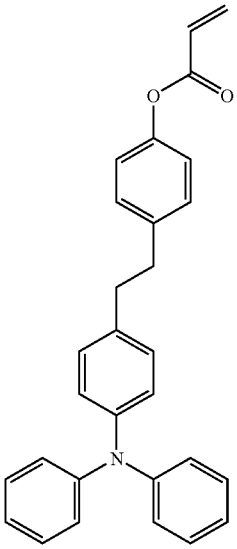
NO. 94
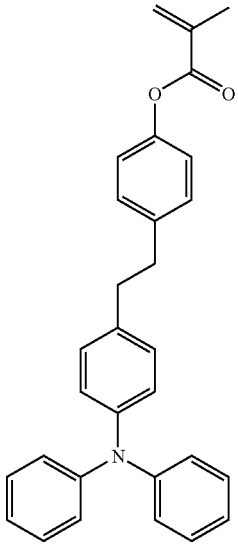
NO. 95
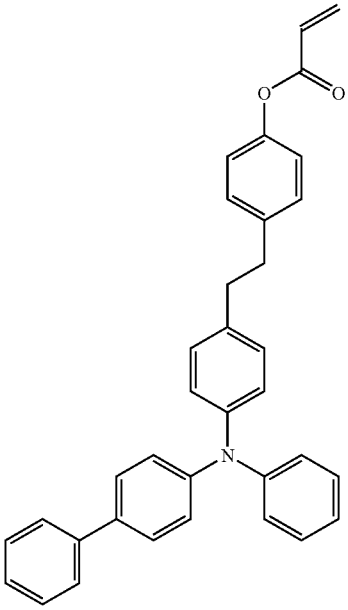
NO. 96
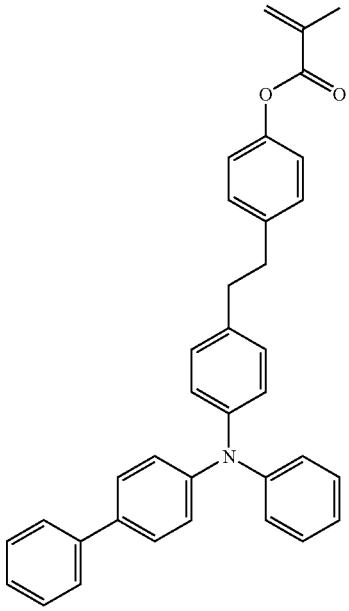

-continued
NO. 97
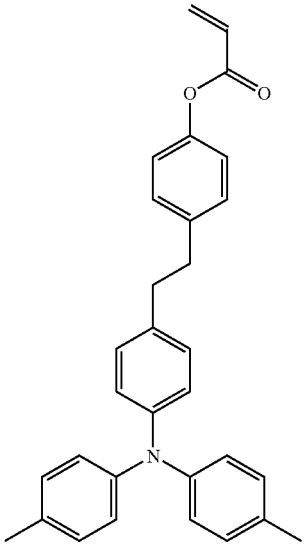
NO. 98
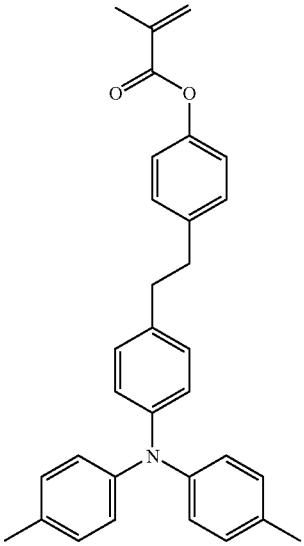
NO. 99
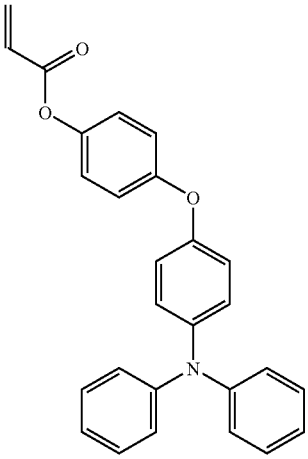
NO. 100
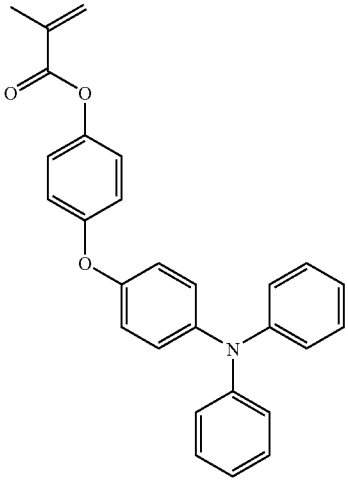
NO. 101
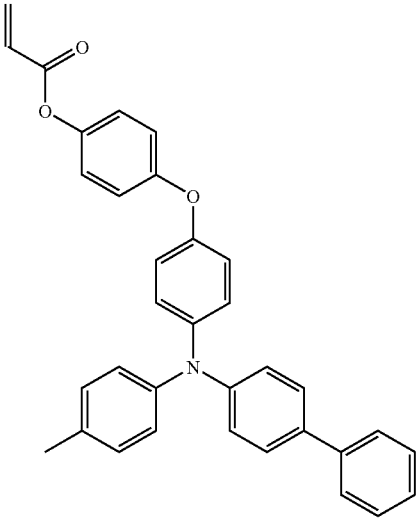
NO. 102
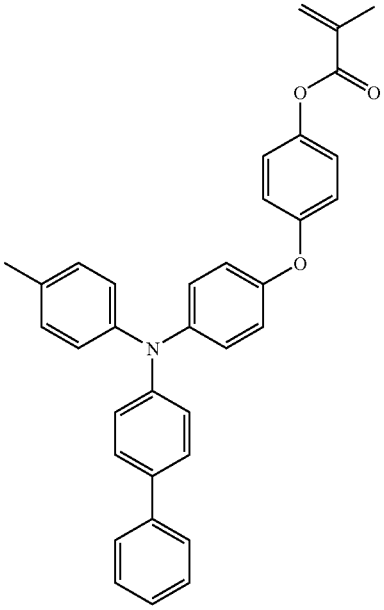

-continued
NO. 103
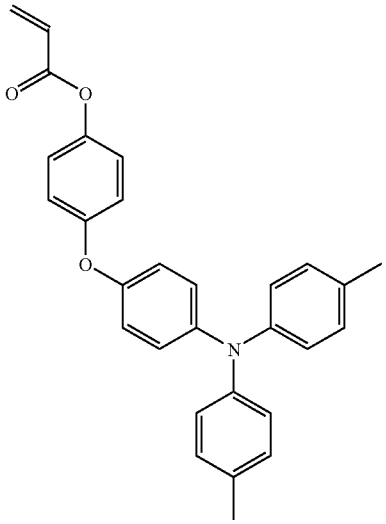
NO. 104
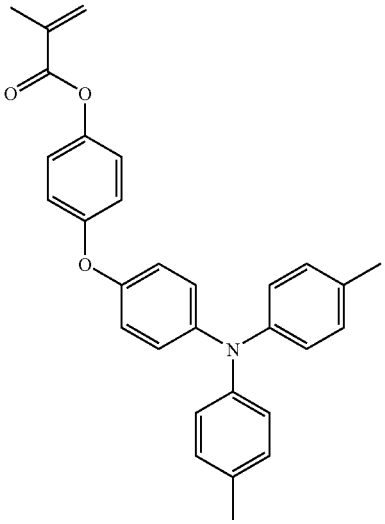
NO. 105
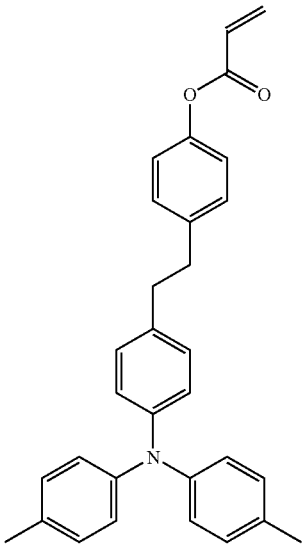
NO. 106
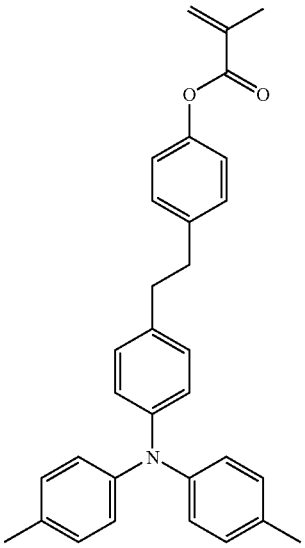
NO. 107
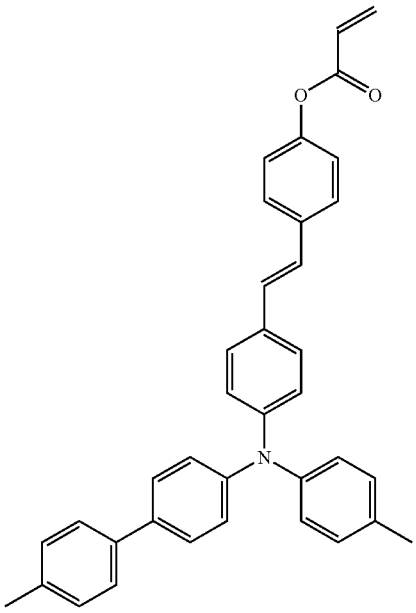
NO. 108
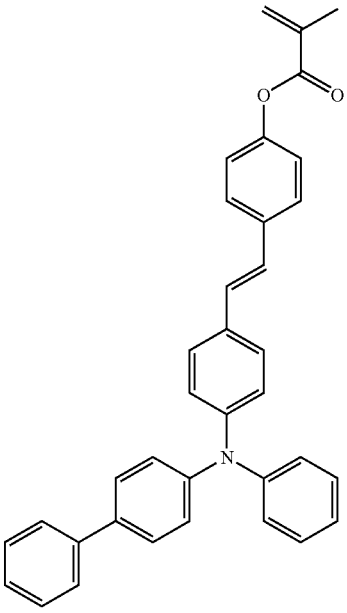

-continued
NO. 109
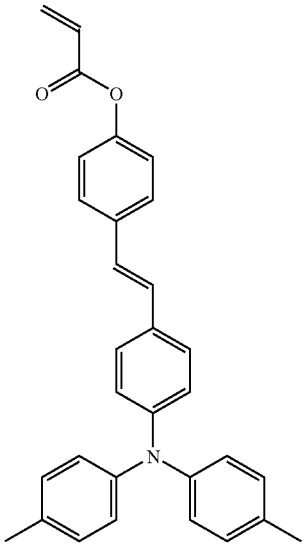
NO. 110
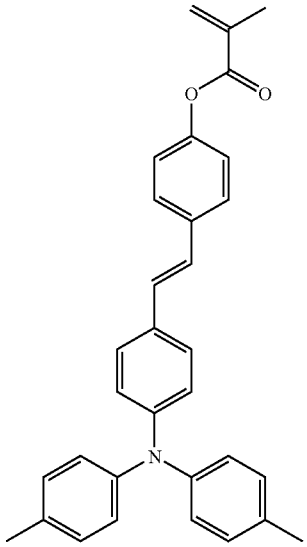
NO. 111
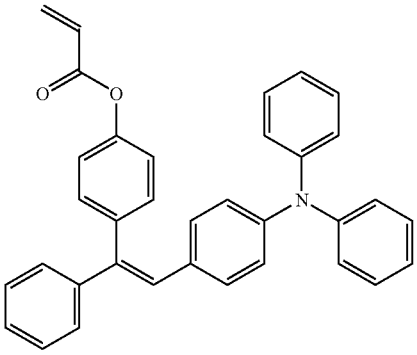
NO. 112
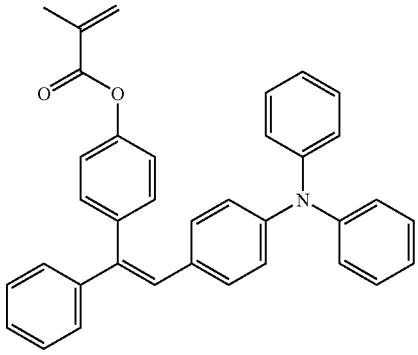
NO. 113
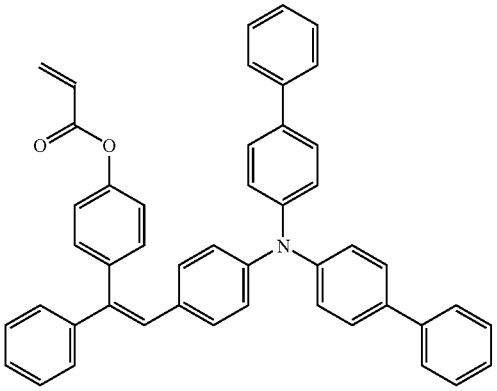
NO. 114
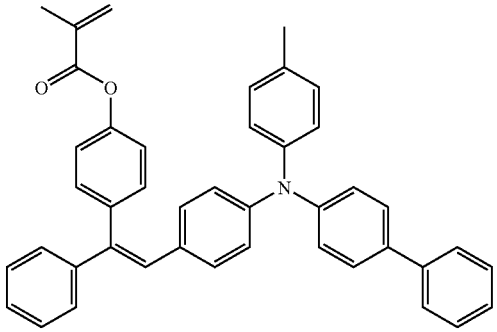

-continued
NO. 115
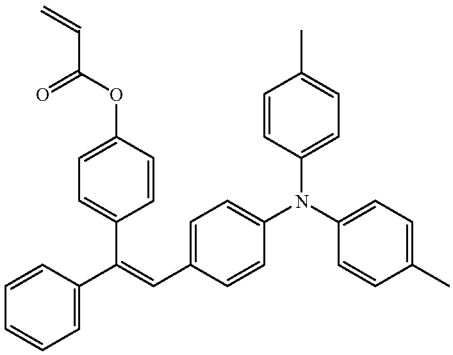
NO. 116
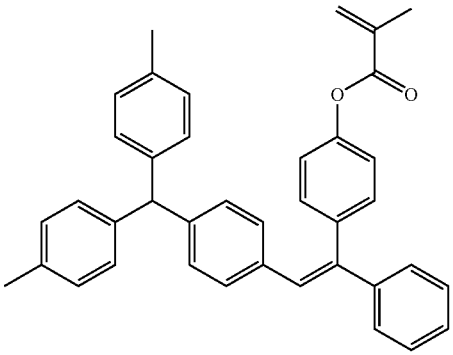
NO. 117
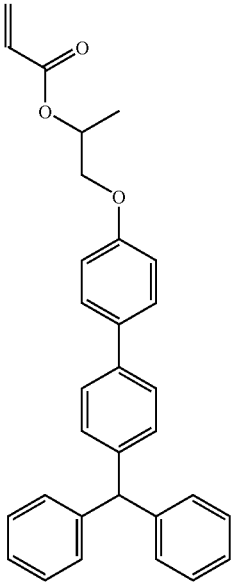
NO. 118
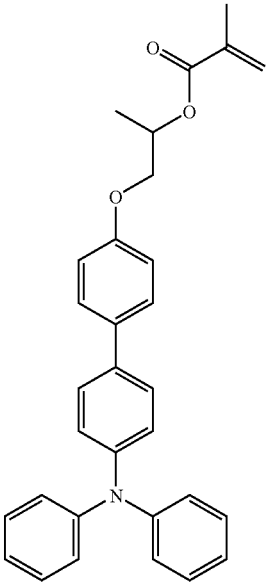
NO. 119
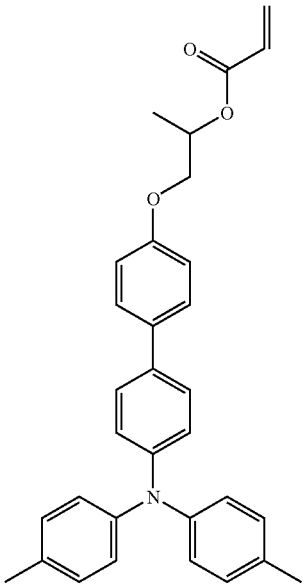
NO. 120
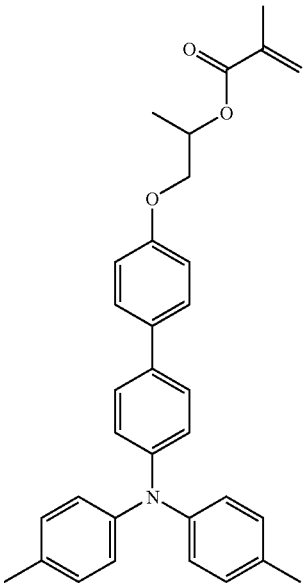

-continued
NO. 121
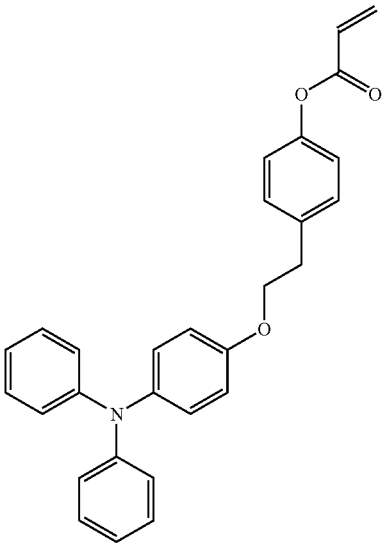
NO. 122
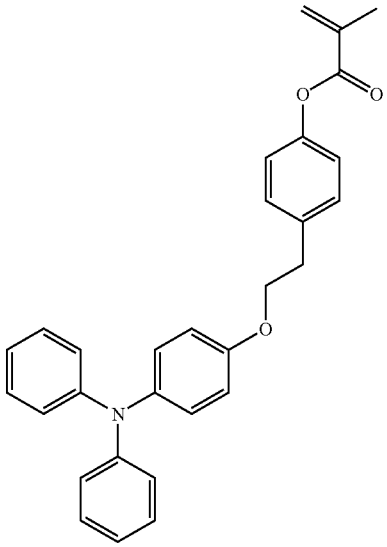
NO. 123
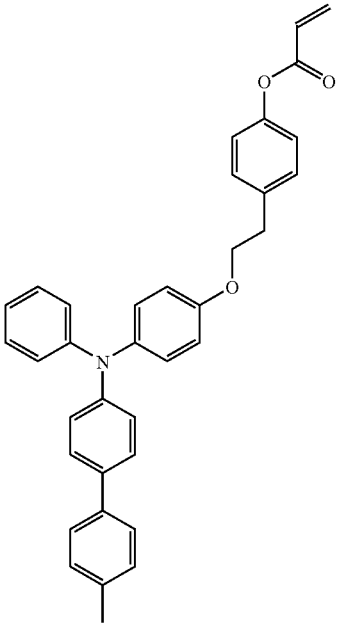
NO. 124
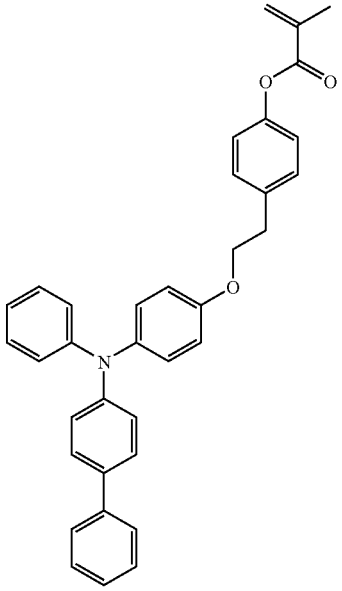

-continued
NO. 125
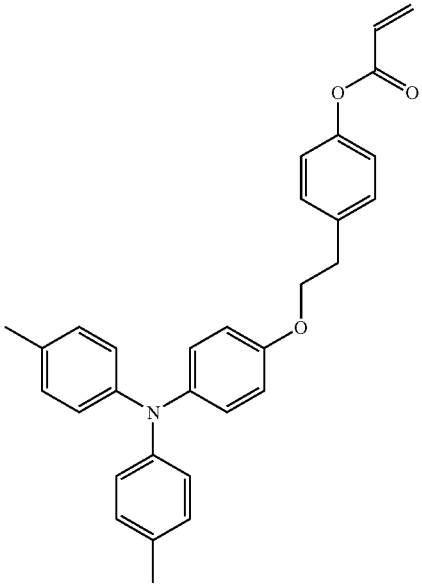
NO. 126
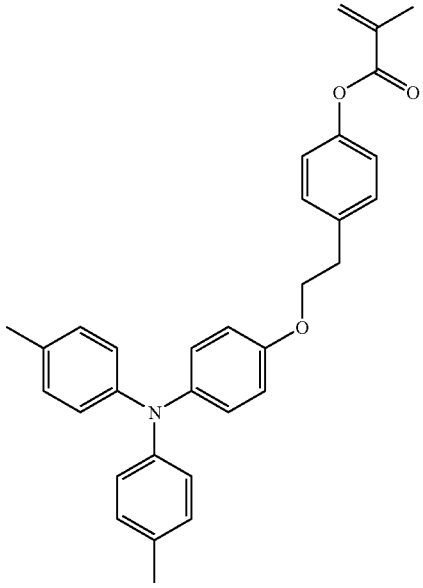
NO. 127
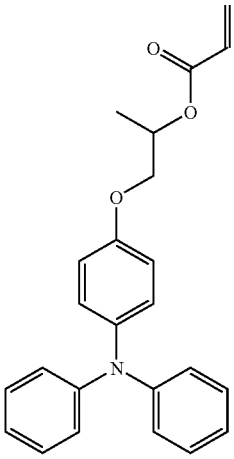
NO. 128
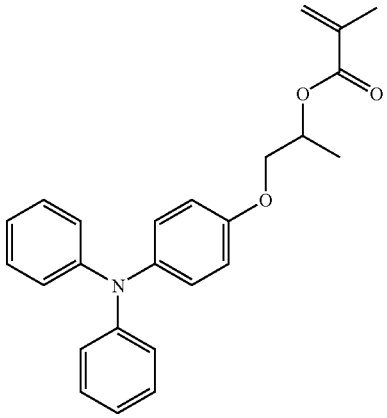
NO. 129
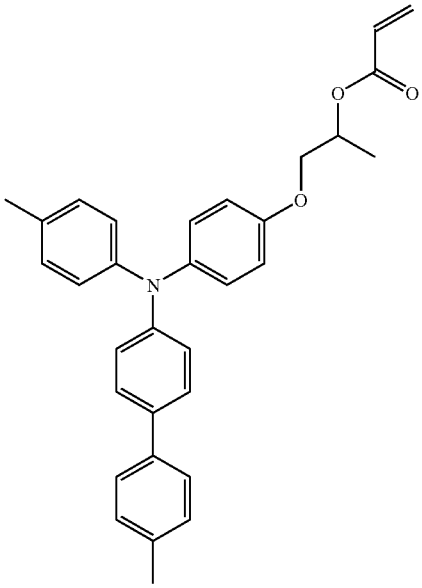
NO. 130
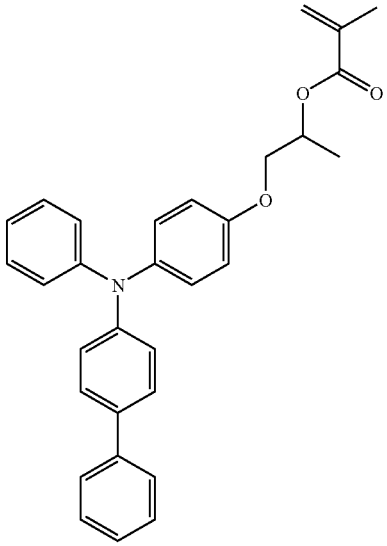

-continued
NO. 131
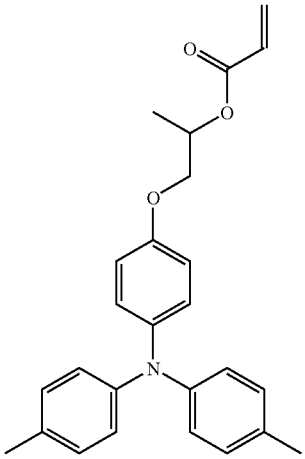
NO. 132
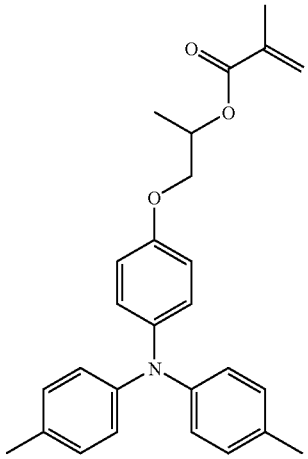
NO. 133
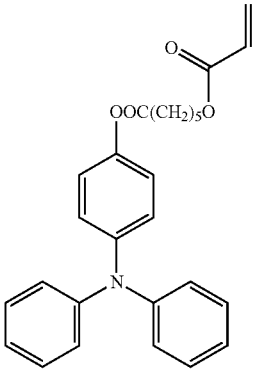
NO. 134
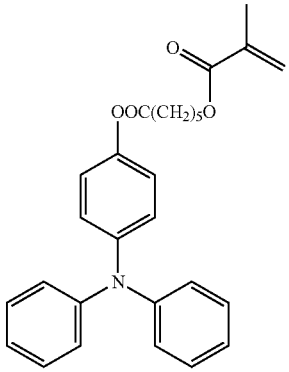
NO. 135
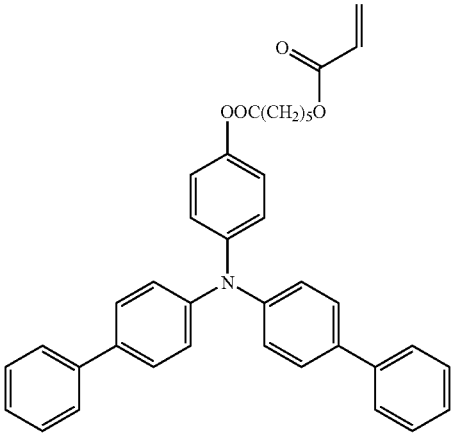
NO. 136
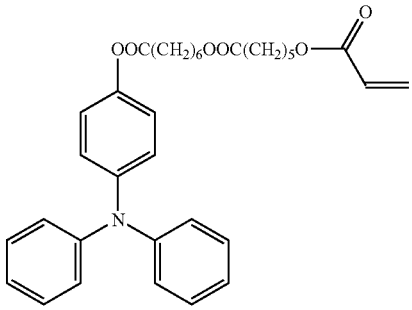

-continued
NO. 137
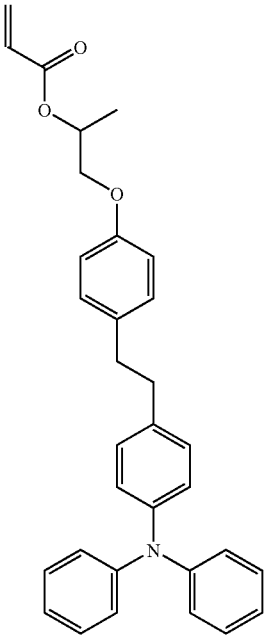
NO. 138
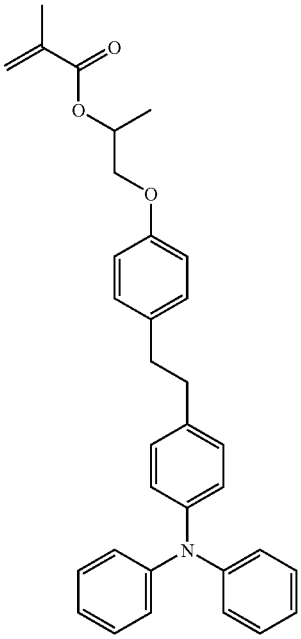
NO. 139
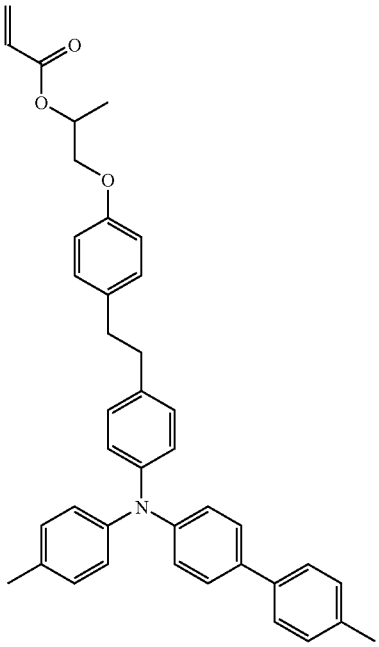
NO. 140
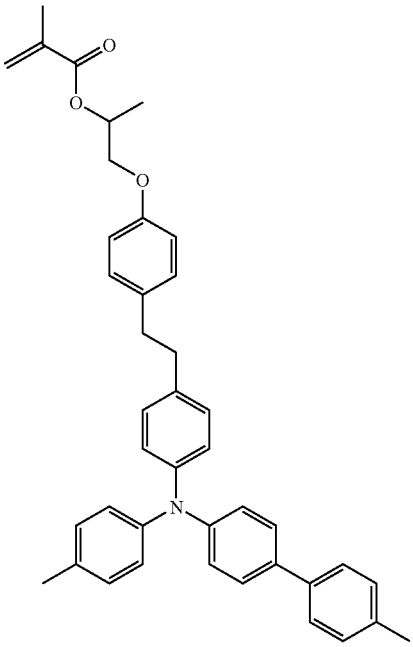
NO. 141
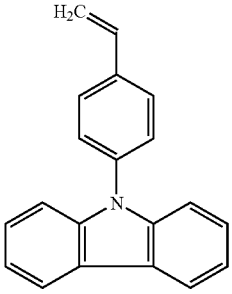

-continued
NO. 142
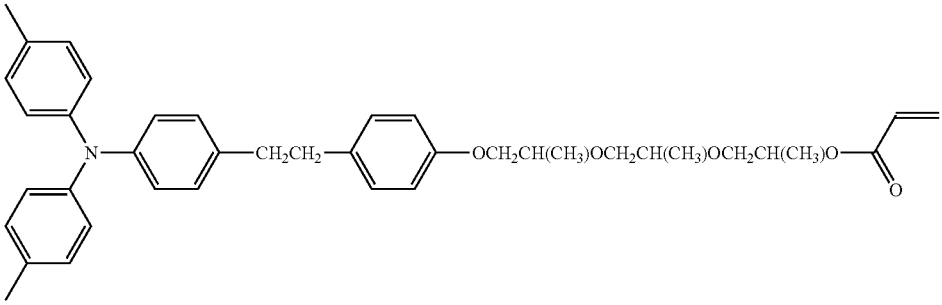
NO. 143
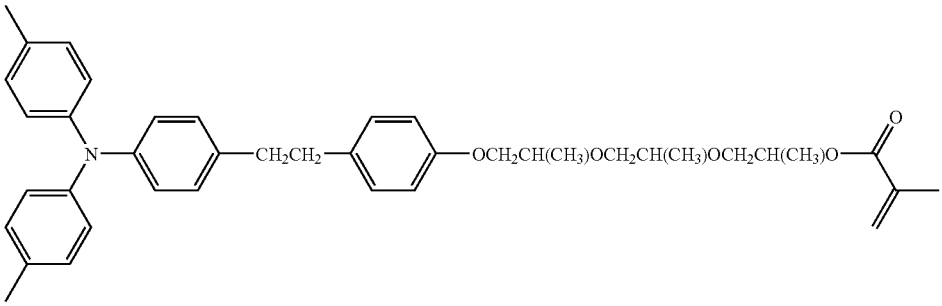
NO. 144
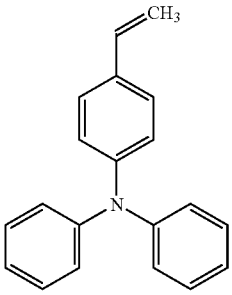
NO. 145
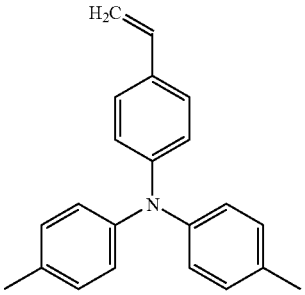
NO. 146
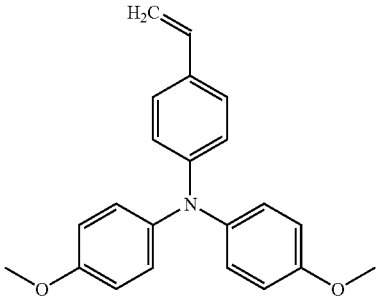
NO. 147
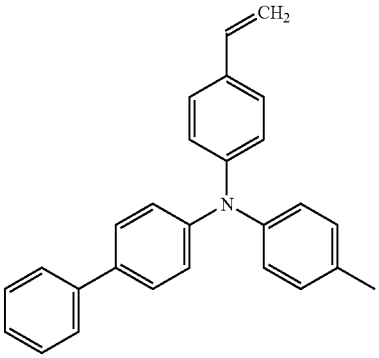
NO. 148
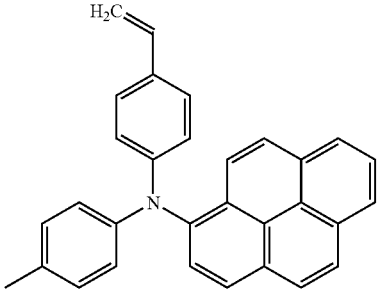
NO. 149
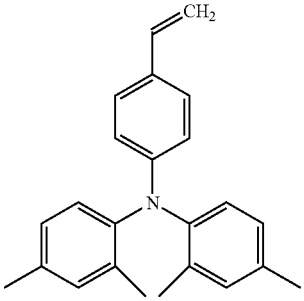

-continued
NO. 150
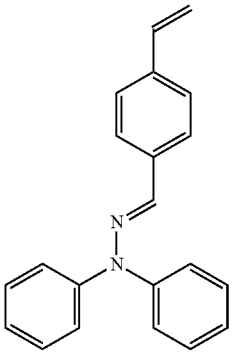
NO. 151
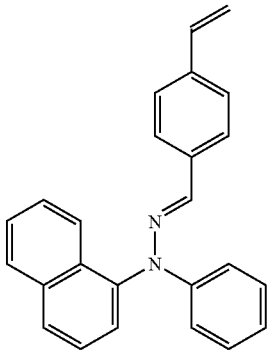
NO. 152
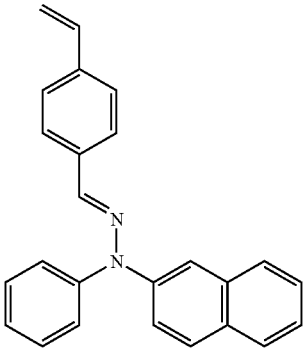
NO. 153
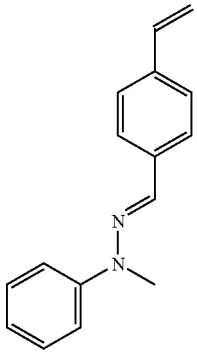
NO. 154
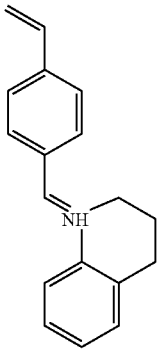
NO. 155
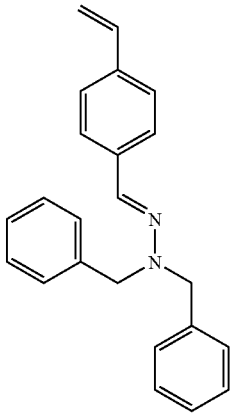
NO. 156
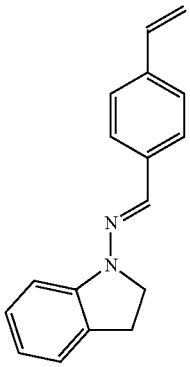
NO. 157
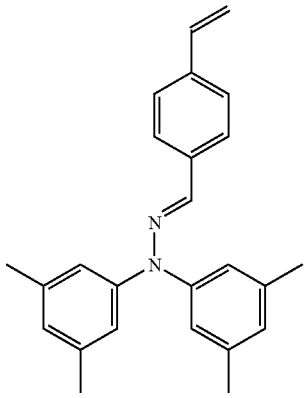

-continued
NO.. 158
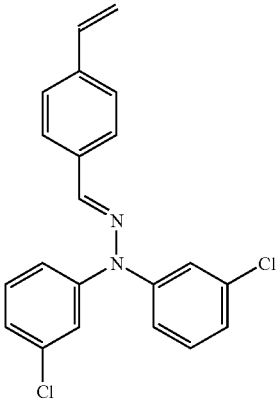
NO. 159
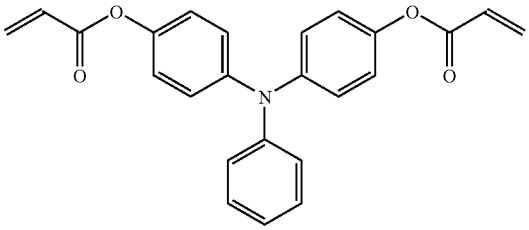
NO. 160
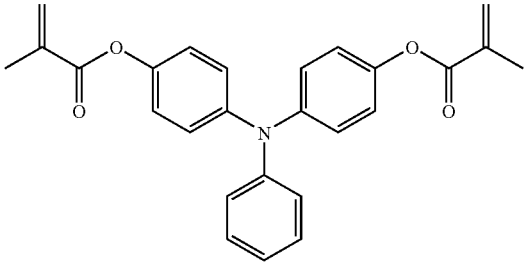
NO. 161
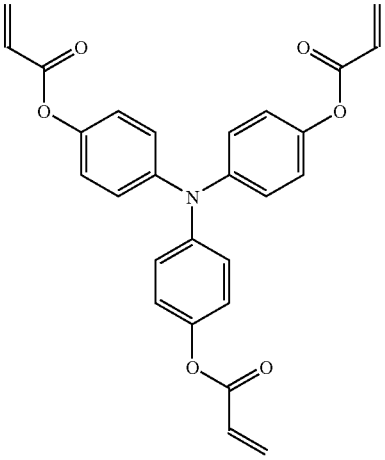
NO. 162
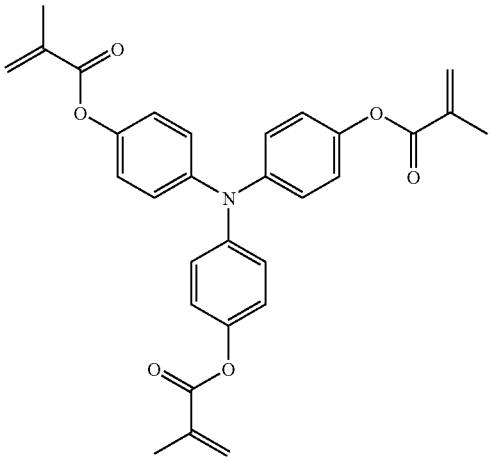
NO. 163
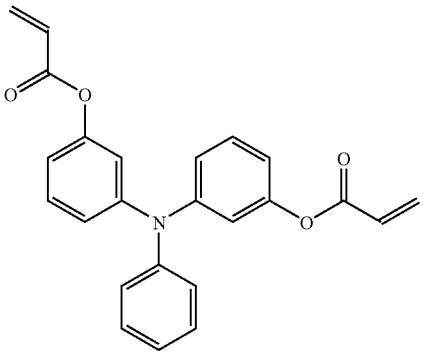

-continued
NO. 164
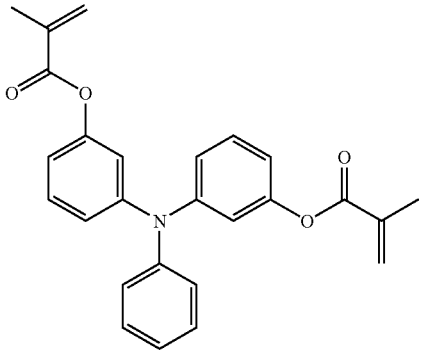
NO. 165
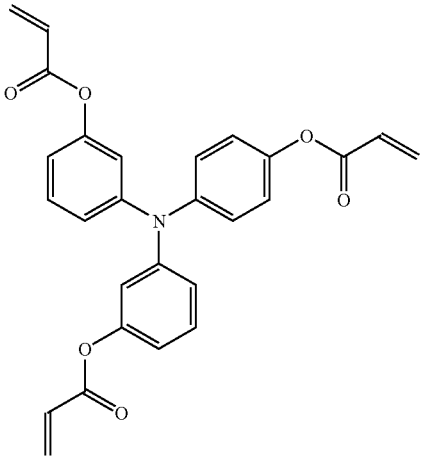
NO. 166
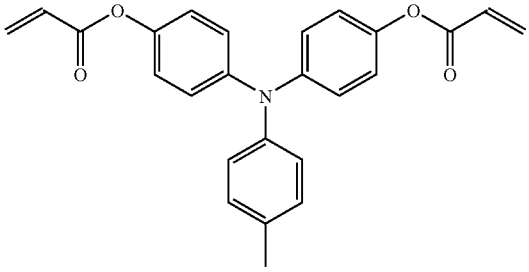
NO. 167
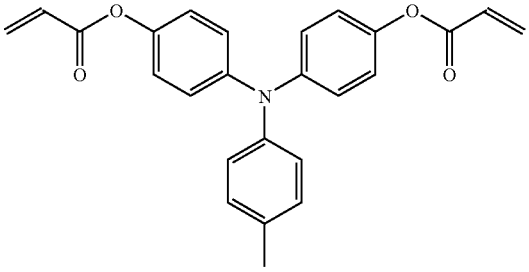
NO. 168
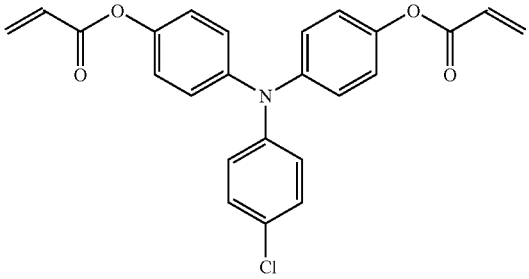
NO. 169
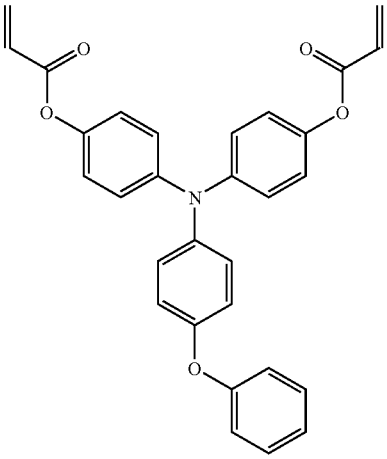

-continued
NO. 170
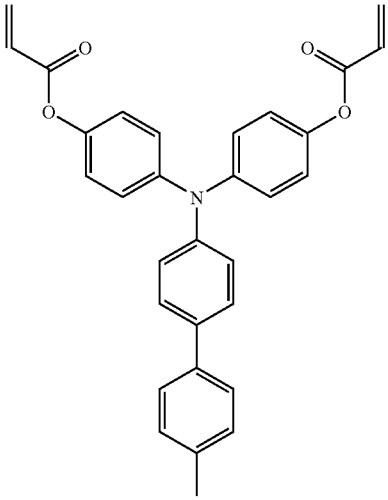
NO. 171
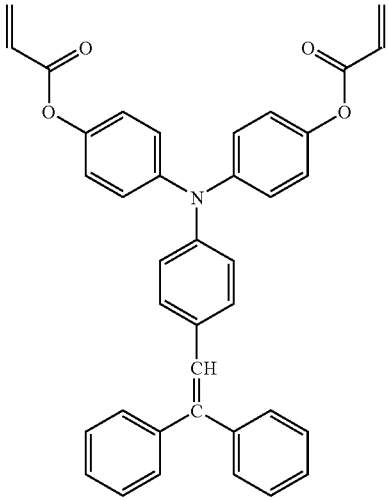
NO. 172
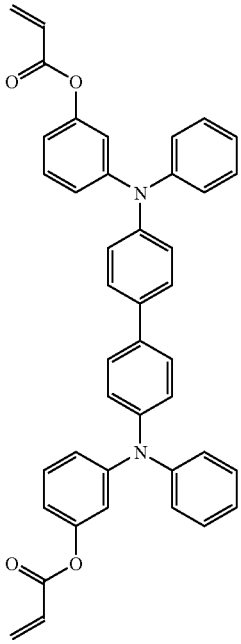
NO. 173
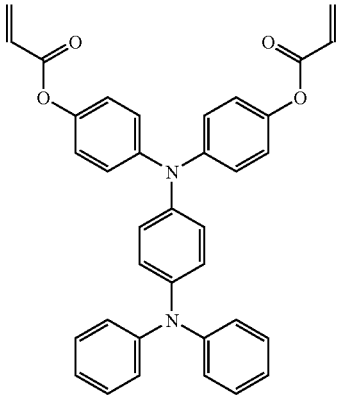

-continued
NO. 174
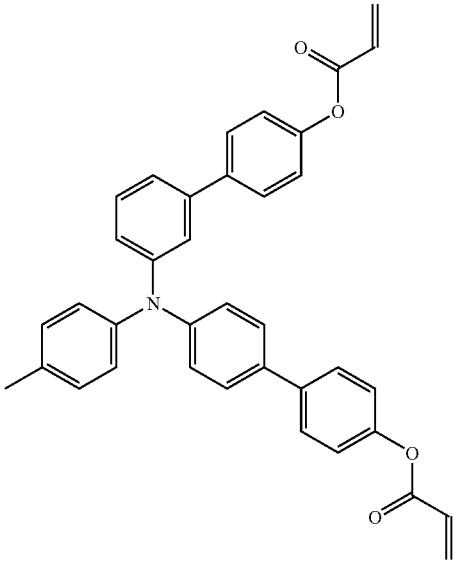
NO. 175
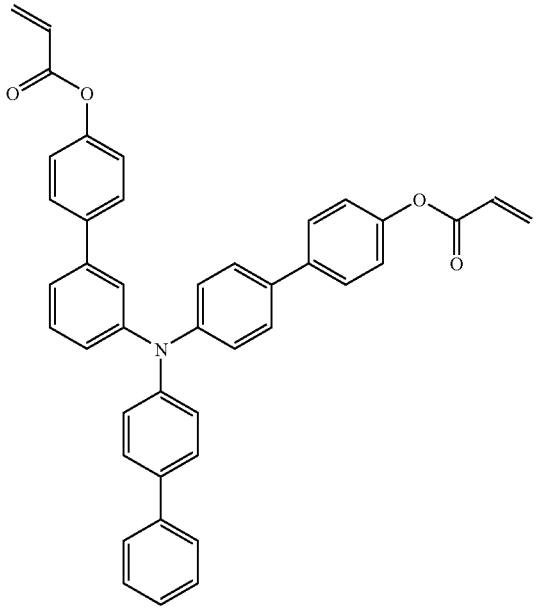
NO. 176
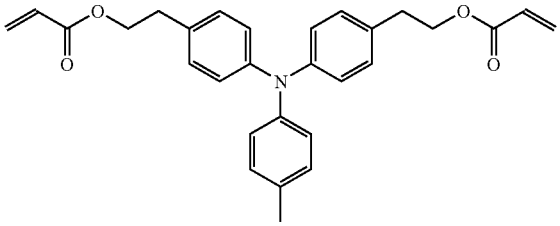
NO. 177
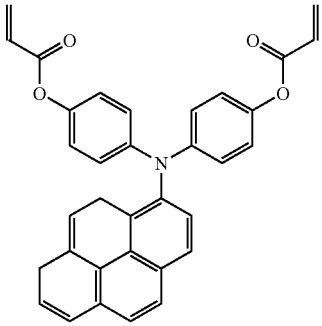
NO. 178
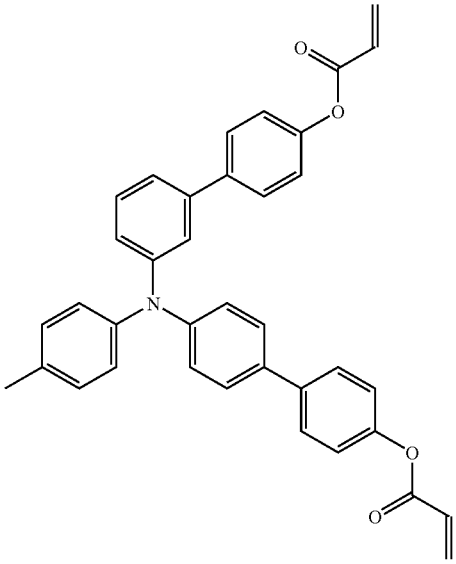

-continued
NO. 179
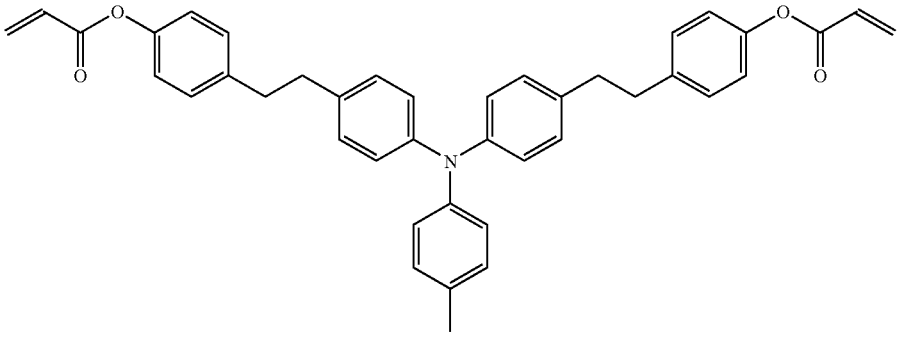
NO. 180
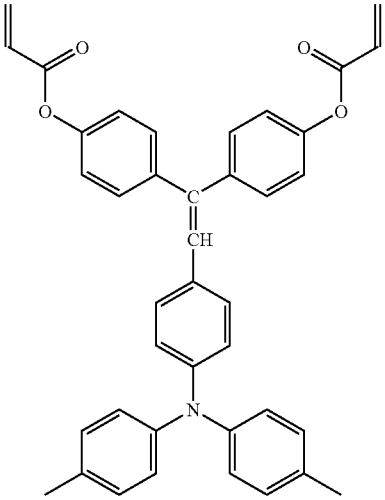
NO. 181
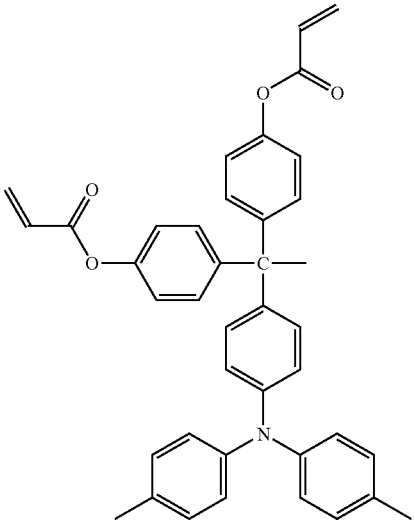
NO. 182
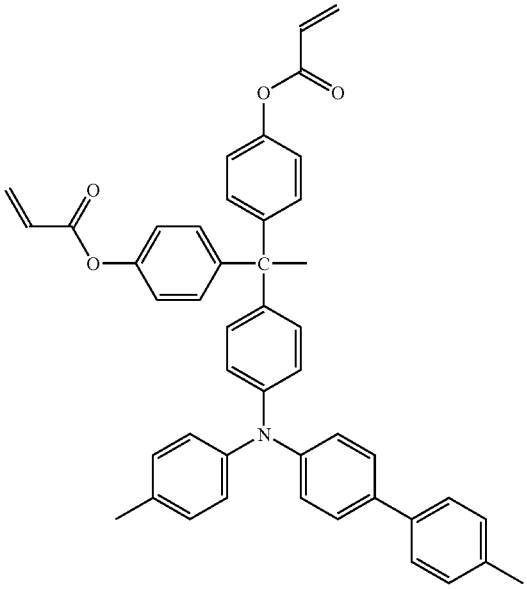

-continued

NO. 183

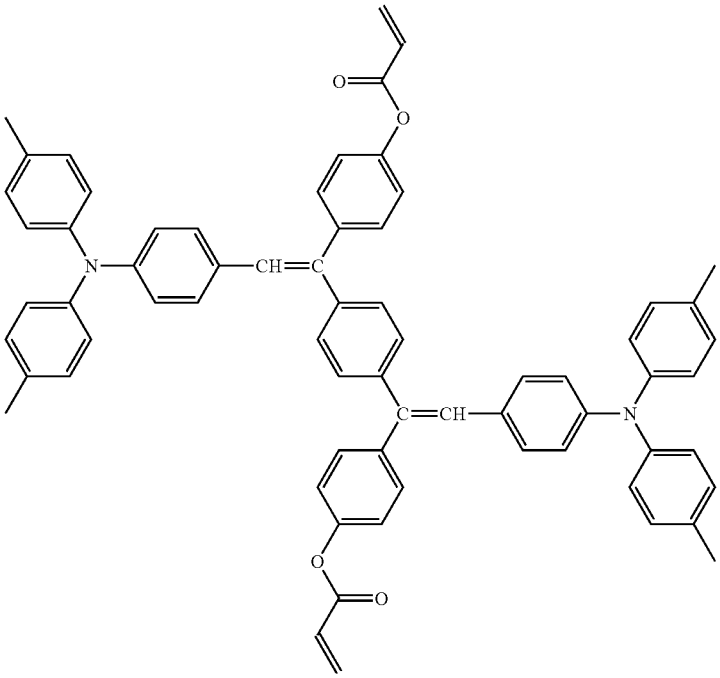

NO. 184

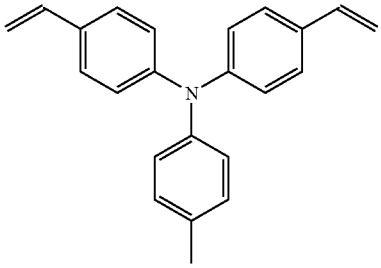

NO. 185

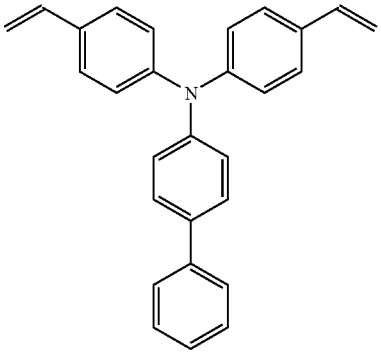

The radical polymerizable compound having a charge transporting structure for use in the present invention is essential for imparting a charge transportability to the crosslinked surface layer, and is preferably included therein in an mount of 20 to 80% by weight, and more preferably from 30 to 70% by weight based on total weight thereof. When less than 20% by weight, the crosslinked surface layer cannot maintain the charge transportability, a sensitivity of the resultant photoreceptor deteriorates and a residual potential thereof increases in repeated use. When greater than 80% by weight, a content of the tri- or more functional monomer having no charge transportable structure decreases and the crosslinked density deteriorates, and therefore the resultant photoreceptor does not have a high abrasion resistance. Although it depends on a required abrasion resistance and electrical properties, in consideration of a balance therebetween, a content of the monofunctional radical polymerizable compound having a charge transportable structure is most preferably from 30 to 70% by weight.

The crosslinked surface layer of the present invention is formed by preparing a solution (coating liquid) including at least a tri- or more functional radical polymerizable monomer having no charge transportable structure and a radical polymerizable compound having a charge transportable structure, coating and drying the solution, and hardening (crosslinking) the solution. Besides these, the coating liquid can include a monofunctional and bifunctional radical polymerizable monomer, a functional monomer and a radical polymerizable oligomer as well to control a viscosity of the surface layer when coated, reduce a stress of thereof, impart a low surface free energy thereto and reduce friction coefficient thereof. Known radical polymerizable monomers and oligomers can be used.

Specific examples of the monofunctional radical monomer include 2-ethylhexylacrylate, 2-hydroxyethylacrylate, 2-hydroxypropylacrylate, tetrahydrofurfurylacrylate, 2-ethylhexylcarbitolacrylate, 3-methoxybutylacrylate, benzylacrylate, cyclohexylacrylate, isoamylacrylate, isobutylacrylate, methoxytriethyleneglycolacrylate, phenoxytetraethyleneglycolacrylate, cetylacrylate, isostearylacrylate, stearylacrylate, styrene monomer, etc.

Specific examples of the bifunctional radical monomer include 1,3-butanediolacrylate, 1,4-butanedioldiacrylate, 1,4-butanedioldimethacrylate, 1,6-hexanedioldiacrylate, 1,6-hexanedioldimethacrylate, diethyleneglycoldiacrylate, neopentylglycoldiacrylate, EO-modified bisphenol A diacrylate, EO-modified bisphenol F diacrylate, etc.

Specific examples of the functional monomer include octafluoropentylacrylate, 2-perfluorooctylethylacrylate, 2-perfluorooctylethylmethacrylate, 2-perfluoroisononylethylacrylate, etc., wherein a fluorine atom is substituted; vinyl monomers having a polysiloxane group having a siloxane repeat unit of from 20 to 70 disclosed in Japanese Published Examined Patent Application Nos. 5-60503 and 6-45770, such as acryloylpolydimethylsiloxaneethyl, methacryloylpolydimethylsiloxaneethyl, acryloylpolydimethylsiloxanepropyl, acryloylpolydimethylsiloxanebutyl and diacryloylpolydimethylsiloxanediethyl; acrylate; and methacrylate.

Specific examples of the radical polymerizable oligomer includes epoxyacrylate oligomers, urethaneacrylate oligomers and polyetseracrylate oligomers.

However, when the crosslinked surface layer includes a large amount of the radical polymerizable monomer and radical polymerizable oligomer having one or two functional groups, the three-dimensional crosslinked bonding density thereof substantially deteriorates, resulting in deterioration of the abrasion resistance thereof. Therefore, the surface layer of the present invention preferably includes the monomers and oligomers in an amount not greater than 50 parts by weight, and more preferably not greater than 30 parts by weight per 100 parts by weight of the radical polymerizable monomer having three or more functional groups.

The crosslinked surface layer of the present invention is formed by preparing a solution (coating liquid) including at least a tri- or more functional radical polymerizable monomer having no charge transportable structure and a monofunctional radical polymerizable compound having a charge transportable structure, coating and drying the solution, and hardening (crosslinking) the solution. The coating liquid may optionally a polymerization initiator such as a heat polymerization initiator and a photopolymerization initiator to effectively proceed the crosslinking reaction.

Specific examples of the heat polymerization initiator include peroxide initiators such as 2,5-dimethylhexane-2,5-dihydrooxide, dicumylperoxide, benzoylperoxide, t-butylcumylperoxide, 2,5-dimethyl-2,5-di(peroxybenzoyl)hexyne-3, di-t-butylbeloxide, t-butylhydrobeloxide, cumenehydrobeloxide and lauroylperoxide; and azo initiators such as azobisisobutylnitrile, azobiscyclohexanecarbonitrile, azobisisomethylbutyrate, azobisisobutylamidinehydrorchloride and 4,4'-azobis-4-cyanovaleric acid.

Specific examples of the photopolymerization initiator include acetone or ketal photopolymerization initiators such as diethoxyacetophenone, 2,2-dimethoxy-1,2-diphenylethane-1-one, 1-hydroxy-cyclohexyl-phenyl-ketone, 4-(2-hydroxyethoxy)phenyl-(2-hydroxy-2-propyl)ketone, 2-benzyl-2-dimethylamino-1-(4-molpholinophenyl)butanone-1,2-hydroxy-2-methyl-1-phenylpropane-1-one and 1-phenyl-1,2-propanedion-2-(o-ethoxycarbonyl)oxime; benzoinether photopolymerization initiators such as benzoin, benzoinmethylether, benzomethylether, benzoinisobutylether and benzoinisopropylether; benzophenone photopolymerization initiators such as benzophenone, 4-hydroxybenzophenone, o-benzoylmethylbenzoate, 2-benzoylnaphthalene, 4-benzoylviphenyl, 4-benzoylphenylether, acrylated benzophenone and 1,4-benzoylbenzene; thioxanthone photo polymerization initiators such as 2-isopropylthioxanthone, 2-chlorothioxanthone, 2,4-dimethylthioxanthone, 2,4-diethylthioxanthone and 2,4-dichlorothioxanthone; and other photopolymerization initiators such as ethylanthraquinone, 2,4,6-trimethylbenzoyldiphenylphosphineoxide, 2,4,6-trimethylbenzoyldiphenylethoxyphosphineoxide, bis(2,4,6-trimethylbenzoyl)phenylphosphineoxide, bis(2,4-dimethoxybenzoyl)-2,4,4-trimethylpentylphosphineoxide, methylphenylglyoxyester, 9,10-phenanthrene, acridine compounds, triazine compounds and imidazole compounds. Further, a material having a photo polymerizing effect can be used alone or in combination with the above-mentioned photopolymerization initiators. Specific examples of the materials include triethanolamine, methyldiethanol amine, 4-dimethylaminoethylbenzoate, 4-dimethylaminoisoamylbenzoate, ethyl(2-dimethylamino) benzoate and 4,4-dimethylaminobenzophenone.

These polymerization initiators can be used alone or in combination. The crosslinked surface layer of the present invention preferably includes the polymerization initiators in an amount of 0.5 to 40 parts by weight, and more preferably from 1 to 20 parts by weight per 100 parts by weight of the radical polymerizable compounds.

Further, the coating liquid may optionally include various additives such as plasticizers (to soften a stress and improve adhesiveness thereof), leveling agents and low-molecular-weight charge transport materials without a radical reactivity. Known additives can be used, and specific examples of the plasticizers include plasticizers such as dibutylphthalate and dioctylphthalate used in typical resins. The content thereof is preferably not greater than 20% by weight, and more preferably not greater than 10% based on total weight of solid contents of the coating liquid. Specific examples of the leveling agents include silicone oil such as dimethylsilicone oil and methylphenylsilicone oil; and polymers and oligomers having a perfluoroalkyl group in the side chain. The content thereof is preferably not greater than 3% by weight.

The crosslinked surface layer of the present invention is formed by coating a coating liquid including the tri- or more functional radical polymerizable monomer having no charge transportable structure and the radical polymerizable compound having a charge transportable structure with a spray and hardening upon application of external energy. The coating liquid is diluted with a solvent, e.g., alcohols such as methanol, ethanol, propanol and butanol; ketones such as acetone, methyl ethyl ketone, methyl isobutyl ketone and cyclohexanone; esters such as ethylacetate and butylacetate; ethers such as tetrahydrofuran, dioxane and propylether; halogens such as dichloromethane, dichloroethane, trichloroethane and chlorobenzene; aromatics such as benzene, toluene and xylene; and cellosolves such as methylcellosolve, ethylcellosolve and cellosolve acetate. These solvents can be used alone or in combination. The dilution rate thereof depends on solubility of the constituents and thickness of the layer, but preferably from 5 to 40% by weight in terms of controlling the spray droplet diameter.

In the present invention, after the coating liquid is coated to form the crosslinked surface layer, an external energy is applied thereto for hardening the layer to form the crosslinked surface layer. The external energy includes a heat, a light and a radiation. A heat energy is applied to the layer from the coated side or from the substrate using air, a gaseous body such as nitrogen, a steam, a variety of heating media, infrared or an electromagnetic wave. The heating temperature is preferably from 100 to 170° C. When less than 100° C., the reaction is slow in speed and is not completely finished. When greater than 170° C., the reaction nonuniformly proceeds and a large distortion appears in the crosslinked surface layer. To uniformly proceed the hardening reaction, after heated at comparatively a low temperature less than 100° C., the reaction is effectively completed at not less than 100° C. Specific examples of the light energy include UV irradiators such as high pressure mercury lamps and metal halide lamps having an emission wavelength of UV light; and a visible light source adaptable to absorption wavelength of the radical polymerizable compounds and photopolymerization initiators. An irradiation light quantity is preferably from 50 to 1,000 mW/cm$^2$. When less than 50 mW/cm$^2$, the hardening reaction takes time. When greater than 1,000 mW/cm$^2$, the reaction nonuniformly proceeds and the crosslinked surface layer has a large surface roughness. The radiation energy includes a radiation energy using an electron beam. Among these energies, the heat and light energies are effectively used because of their simple reaction speed controls and simple apparatuses.

Figure 3A:
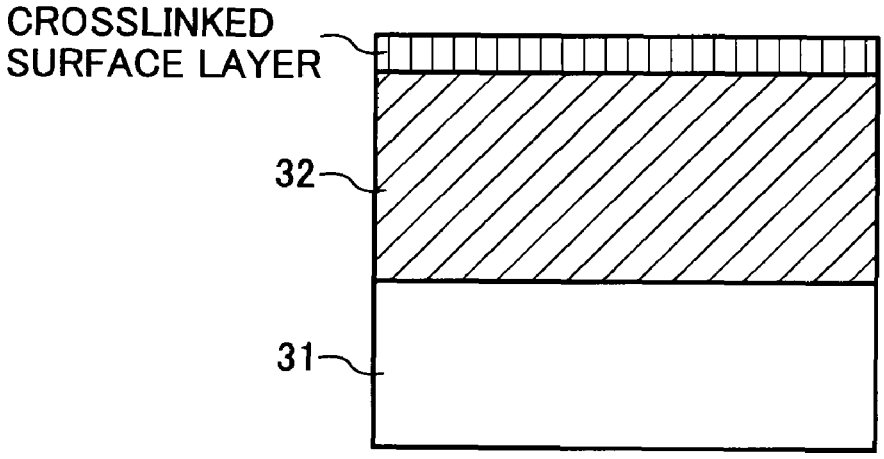
FIG. 3A is a cross-sectional view illustrating an embodiment of layer composition of the electrophotographic photoreceptor of the present invention.
Figure 3B:
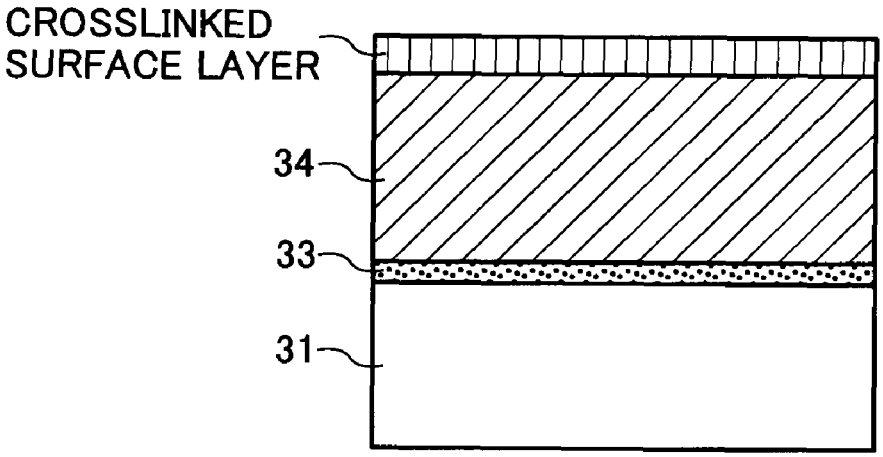
FIG. 3B is a cross-sectional view illustrating another embodiment of layer composition of the electrophotographic photoreceptor of the present invention.

FIG. 3A is a cross-sectional view illustrating an embodiment of layer composition of the electrophotographic photoreceptor of the present invention, wherein a crosslinked surface layer is overlaid on a single-layered photoreceptor formed of a photosensitive layer (32) having both a charge generation function and charge transport function and overlying an electroconductive substrate (31). FIG. 3B is a cross-sectional view illustrating another embodiment of layer composition of the electrophotographic photoreceptor of the present invention, wherein a crosslinked surface layer is overlaid on a multilayered photoreceptor formed of a charge generation layer (33) having a charge generation function and a charge transport layer (34) having a charge transport function, and which are overlying an electroconductive substrate (31).

Suitable materials for use as the electroconductive substrate (31) include materials having a volume resistance not greater than $10^{10}$ Ω·cm. Specific examples of such materials include plastic cylinders, plastic films or paper sheets, on the surface of which a metal such as aluminum, nickel, chromium, nichrome, copper, gold, silver, platinum and the like, or a metal oxide such as tin oxides, indium oxides and the like, is deposited or sputtered. In addition, a plate of a metal such as aluminum, aluminum alloys, nickel and stainless steel and a metal cylinder, which is prepared by tubing a metal such as the metals mentioned above by a method such as impact ironing or direct ironing, and then treating the surface of the tube by cutting, super finishing, polishing and the like treatments, can also be used as the substrate. Further, endless belts of a metal such as nickel and stainless steel, which have been disclosed in Japanese Published Unexamined Patent Application No. 52-36016, can also be used as the substrate (31).

Furthermore, substrates, in which a coating liquid including a binder resin and an electroconductive powder is coated on the substrates mentioned above, can be used as the substrate (31).

Specific examples of such an electroconductive powder include carbon black, acetylene black, powders of metals such as aluminum, nickel, iron, Nichrome, copper, zinc, silver and the like, and metal oxides such as electroconductive tin oxides, ITO and the like. Specific examples of the binder resin include known thermoplastic resins, thermosetting resins and photo-crosslinking resins, such as polystyrene, styrene-acrylonitrile copolymers, styrene-butadiene copolymers, styrene-maleic anhydride copolymers, polyesters, polyvinyl chloride, vinyl chloride-vinyl acetate copolymers, polyvinyl acetate, polyvinylidene chloride, polyarylates, phenoxy resins, polycarbonates, cellulose acetate resins, ethyl cellulose resins, polyvinyl butyral resins, polyvinyl formal resins, polyvinyl toluene, poly-N-vinyl carbazole, acrylic resins, silicone resins, epoxy resins, melamine resins, urethane resins, phenolic resins, alkyd resins and the like resins. Such an electroconductive layer can be formed by coating a coating liquid in which an electroconductive powder and a binder resin are dispersed in a solvent such as tetrahydrofuran, dichloromethane, methyl ethyl ketone, toluene and the like solvent, and then drying the coated liquid.

In addition, substrates, in which an electroconductive resin film is formed on a surface of a cylindrical substrate using a heat-shrinkable resin tube which is made of a combination of a resin such as polyvinyl chloride, polypropylene, polyesters, polyvinylidene chloride, polyethylene, chlorinated rubber and TEFLON (registered trademark), with an electroconductive material, can also be preferably used as the substrate (31).

Next, the photosensitive layer will be explained. The photosensitive layer may be a single-layered or a multilayered. The multilayered photosensitive layer is formed of a charge generation layer having a charge generation function and a charge transport layer having a charge transport function. The single-layered photosensitive layer is a layer having both the charge generation function and charge transport function.

Hereinafter, the multilayered photosensitive layer and single-layered photosensitive layer will be explained respectively.

The charge generation layer (CGL) (33) is mainly formed of a charge generation material, and optionally includes a binder resin. Suitable charge generation materials include inorganic materials and organic materials.

Specific examples of the inorganic charge generation materials include crystalline selenium, amorphous selenium, selenium-tellurium alloys, selenium-tellurium-halogen alloys, selenium-arsenicalloys, amorphous silicon, etc. The amorphous silicon includes a dangling bond terminated with a hydrogen atom or a halogen atom, a doped boron atom, a doped phosphorus atom, etc.

Specific examples of the organic charge generation materials include known materials, for example, phthalocyanine pigments such as metal phthalocyanine and metal-free phthalocyanine, azulenium pigments, squaric acid methine pigments, azo pigments having a carbazole skeleton, azo pigments having a triphenylamine skeleton, azo pigments having a diphenylamine skeleton, azo pigments having a dibenzothiophene skeleton, azo pigments having a fluorenone skeleton, azo pigments having an oxadiazole skeleton, azo pigments having a bisstilbene skeleton, azo pigments having a distyryloxadiazole skeleton, azo pigments having a distyrylcarbazole skeleton, perylene pigments, anthraquinone pigments, polycyclic quinone pigments, quinoneimine pigments, diphenyl methane pigments, triphenyl methane pigments, benzoquinone pigments, naphthoquinone pigments, cyanine pigments, azomethine pigments, indigoid pigments, bisbenzimidazole pigments, etc. These charge generation materials can be used alone or in combination.

Specific examples of the binder resin optionally used in the CGL (33) include polyamide resins, polyurethane resins, epoxy resins, polyketone resins, polycarbonate resins, silicone resins, acrylic resins, polyvinyl butyral resins, polyvinyl formal resins, polyvinyl ketone resins, polystyrene resins, poly-N-vinylcarbazole resins, polyacrylamide resins, and the like resins. These resins can be used alone or in combination. In addition, a charge transport polymer material can also be used as the binder resin in the CGL besides the above-mentioned binder resins. Specific examples thereof include polymer materials such as polycarbonate resins, polyester resins, polyurethane resins, polyether resins, polysiloxane resins and acrylic resins having an arylamine skeleton, a benzidine skeleton, a hydrazone skeleton, a carbazole skeleton, a stilbene skeleton, a pyrazoline skeleton, etc.; and polymer materials having polysilane skeleton.

Specific examples of the former polymer materials include charge transport polymer materials disclosed in Japanese Published Unexamined Patent Applications Nos. 01-001728, 01-009964, 01-013061, 01-019049, 01-241559, 04-011627, 04-175337, 04-183719, 04-225014, 04-230767, 04-320420, 05-232727, 05-310904, 06-234838, 06-234839, 06-234840, 06-234839, 06-234840, 06-234841, 06-236051, 06-295077, 07-056374, 08-176293, 08-208820, 08-211640, 08-253568, 08-269183, 09-062019, 09-043883, 09-71642, 09-87376, 09-104746, 09-110974, 09-110976, 09-157378, 09-221544, 09-227669, 09-235367, 09-241369, 09-268226, 09-272735, 09-302084, 09-302085, 09-328539, etc.

Specific examples of the latter polymer materials include polysilylene polymers disclosed in Japanese Published Unexamined Patent Applications Nos. 63-285552, 05-19497, 05-70595, 10-73944, etc.

The CGL (33) can also include a low-molecular-weight charge transport material.

The low-molecular-weight charge transport materials include positive hole transport materials and electron transport materials.

Specific examples of the electron transport materials include electron accepting materials such as chloranil, bromanil, tetracyanoethylene, tetracyanoquinodimethane, 2,4,7-trinitro-9-fluorenone, 2,4,5,7-tetranitro-9-fluorenone, 2,4,5,7-tetranitro-xanthone, 2,4,8-trinitrothioxanthone, 2,6,8-trinitro-4H-indeno[1,2-b]thiophene-4-one, 1,3,7-trinitrobenzothiophene-5,5-dioxide, diphenoquinone derivatives, etc. These electron transport materials can be used alone or in combination.

Specific examples of the positive hole transport materials include electron donating materials such as oxazole derivatives, oxadiazole derivatives, imidazole derivatives, monoarylamines derivatives, diarylamine derivatives, triarylamine derivatives, stilbene derivatives, α-phenylstilbene derivatives, benzidine derivatives, diarylmethane derivatives, triarylmethane derivatives, 9-styrylanthracene derivatives, pyrazoline derivatives, divinyl benzene derivatives, hydrazone derivatives, indene derivatives, butadiene derivatives, pyrene derivatives, bisstilbene derivatives, enamine derivatives, and other known materials. These positive hole transport materials can be used alone or in combination.

Suitable methods for forming the charge generation layer (33) are broadly classified into a vacuum thin film forming method and a solvent dispersion casting method.

Specific examples of the former vacuum thin film forming method include a vacuum evaporation method, a glow discharge decomposition method, an ion plating method, a sputtering method, a reaction sputtering method, CVD (chemical vapor deposition) methods, etc. A layer of the above-mentioned inorganic and organic materials can be formed by these methods.

The casting method for forming the charge generation layer typically includes the following steps:

(1) preparing a coating liquid by mixing one or more inorganic or organic charge generation materials mentioned above with a solvent such as tetrahydrofuran, dioxane, dioxolan, toluene, dichloromethane, monochlorobenzene, dichloroethane, cyclohexanone, cyclopentanone, anisole, xylene, methyl ethyl ketone, acetone, ethyl acetate, butyl acetate, etc., optionally with a binder resin and a leveling agent such as a dimethylsilicone oil and methylphenyl silicone oil, and then dispersing the materials with a ball mill, an attritor, a sand mill, beads mill, etc. to prepare a CGL coating liquid;

(2) coating the CGL coating liquid, which is diluted if necessary, on a substrate by a method such as dip coating, spray coating, bead coating and ring coating; and (3) drying the coated liquid to form a CGL.

The thickness of the CGL is preferably from 0.01 to 5 μm, and more preferably from 0.05 to 2 μm.

The charge transport layer (CTL) (34) is a layer having a charge transportability, and is formed by coating the CGL (33) with a coating liquid wherein a charge transport material having a charge transportability and a binder resin are dispersed in a proper solvent to form a coated layer thereon, and drying the coated layer.

Specific examples of the charge transport materials include electron transport materials, positive hole transport materials and charge transport polymer materials used in the CGL (33). Particularly, the charge transport polymer materials are effectively used to reduce a solution of a lower layer when a surface layer is coated thereon.

Specific examples of the binder resins include thermoplastic or thermosetting resins such as a polystyrene resin, a styrene-acrylonitrile copolymer, a styrene-butadiene copolymer, a styrene-maleic anhydride copolymer, a polyester resin, a polyvinylchloride resin, a vinylchloride-vinylacetate copolymer, a polyvinylacetate resin, a polyvinylidenechloride resin, a polyarylate resin, a phenoxy resin, a polycarbonate resin, a cellulose acetate resin, an ethylcellulose resin, a polyvinylbutyral resin, a polyvinylformal resin, a polyvinyltoluene resin, a poly-N-vinylcarbazole resin, an acrylic resin, a silicone resin, an epoxy resin, a melamine resin, a urethane resin, a phenol resin and an alkyd resin.

The CTL preferably includes the charge transport material in an amount of from 20 to 300 parts by weight, and more preferably from 40 to 150 parts by weight per 100 parts by weight of the binder resin. However, the charge transport polymer material can be used alone or in combination with the binder resin.

Specific examples of a solvent used for coating the CTL include the solvents used for coating the CGL (33), and particularly the solvents solving the charge transport material and binder resin well are preferably used. These solvents can be used alone or in combination. The CTL can be formed by the same coating methods used for coating the CGL (33).

The CTL may optionally include a plasticizer and a leveling agent.

Specific examples of the plasticizer include plasticizers for typical resins, such as dibutylphthalate and dioctylphthalate, and the content thereof is preferably from 0 to 30 parts by weight per 100 parts by weight of the binder resin.

Specific examples of the leveling agents include silicone oil such as dimethyl silicone oil and methylphenyl silicone oil; and polymers or oligomers having a perfluoroalkyl group in the side chain, and the content thereof is preferably from 0 to 1 part by weight per 100 parts by weight of the binder resin.

The CTL preferably has a thickness of from 5 to 40 μm, and more preferably from 10 to 30 μm.

The crosslinked surface layer is formed by coating the CTL (34) with a coating liquid including the above-mentioned radical polymerizable compositions of the present invention to form a coated layer thereon, and crosslinking and hardening the coated layer with an external energy such as an irradiated UV light energy.

The single-layered photosensitive layer (32) has both a charge generation function and a charge transport function, and is formed by dissolving or dispersing a charge generation material having charge generatability, a charge transport material having charge transportability and a binder resin in a proper solvent, and coating and drying the resultant solution or dispersion. A plasticizer, a leveling agent, etc. can optionally be added thereto. The method of dispersing the charge generation material, the charge generation material, the charge transport material, the plasticizer and the leveling agent are mentioned above in the CGL (33) and the CTL (34). The binder resin used in the CTL (34) and the CGL (33) can be used. In addition, the charge transport polymer material can effectively be used in terms of decreasing incorporation of the constituents of the lower photosensitive layer in the crosslinked surface layer. The underlayer of the photosensitive layer preferably has a thickness of from 5 to 30 μm, and more preferably from 10 to 25 μm.

The crosslinked surface layer is formed by coating the single-layered photosensitive layer (32) with a coating liquid including the above-mentioned radical polymerizable compositions of the present invention to form a coated layer thereon, and crosslinking and hardening the coated layer with an external energy such as an irradiated UV light energy. The crosslinked surface layer preferably has a thickness of from 5 to 20 μm, and more preferably from 5 to 10 μm. When thinner than 5 μm, the durabilities of the resultant photoreceptors differentiate.

The single-layered photosensitive layer preferably includes a charge generation material in an amount of from 1 to 30% by weight, a binder resin of from 20 to 80% by weight and a charge transport material of from 10 to 70% by weight based on total weight thereof.

The photoreceptor of the present invention can have an intermediate layer between the crosslinked surface layer and the photosensitive layer when the crosslinked surface layer overlies the photosensitive layer. The intermediate layer prevents components of the lower photosensitive layer from mixing in the crosslinked surface layer to avoid a hardening reaction inhibition and concavities and convexities thereof. In addition, the intermediate layer can improve the adhesiveness between the crosslinked surface layer and photosensitive layer.

The intermediate layer includes a resin as a main component. Specific examples of the resin include polyamides, alcohol-soluble nylons, water-soluble polyvinyl butyral, polyvinyl butyral, polyvinyl alcohol, etc. The intermediate layer can be formed by one of the above-mentioned known coating methods. The intermediate layer preferably has a thickness of from 0.05 to 2 μm.

The photoreceptor of the present invention may have an undercoat layer between the substrate (31) and photosensitive layer. The undercoat layer includes a resin as a main component. Since a photosensitive layer is typically formed on the undercoat layer by coating a liquid including an organic solvent, the resin in the undercoat layer preferably has good resistance to general organic solvents. Specific examples of such resins include water-soluble resins such as polyvinyl alcohol resins, casein and polyacrylic acid sodium salts; alcohol soluble resins such as nylon copolymers and methoxymethylated nylon resins; and thermosetting resins capable of forming a three-dimensional network such as polyurethane resins, melamine resins, alkyd-melamine resins, epoxy resins and the like. The undercoat layer may include a fine powder of metal oxides such as titanium oxide, silica, alumina, zirconium oxide, tin oxide and indium oxide to prevent occurrence of moiré in the recorded images and to decrease residual potential of the photoreceptor.

The undercoat layer can also be formed by coating a coating liquid using a proper solvent and a proper coating method similarly to those for use in formation of the photosensitive layer mentioned above. The undercoat layer may be formed using a silane coupling agent, titanium coupling agent or a chromium coupling agent. In addition, a layer of aluminum oxide which is formed by an anodic oxidation method and a layer of an organic compound such as polyparaxylylene (parylene) or an inorganic compound such as SiO, $SnO_2$, $TiO_2$, ITO or $CeO_2$ which is formed by a vacuum evaporation method is also preferably used as the undercoat layer. Besides these materials, known materials can be used. The thickness of the undercoat layer is preferably from 0 to 5 μm.

In the present invention, an antioxidant can be included in each of the layers, i.e., the crosslinked surface layer, charge generation layer, charge transport layer, undercoat layer and intermediate layer to improve the stability to withstand environmental conditions, namely to avoid decrease of photosensitivity and increase of residual potential.

Specific examples of the antioxidant for use in the present invention include the following compound.

(Phenolic Compounds)

2,6-di-t-butyl-p-cresol, butylated hydroxyanisole, 2,6-di-t-butyl-4-ethylphenol, n-octadecyl-3-(4'-hydroxy-3',5'-di-t-butylphenol), 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidenebis-(3-methyl-6-t-butylphenol), 1,1,3-tris-(2-methyl-4-hydroxy-5-t-butylphenyl)butane, 1,3,5-trimethyl-2,4,6-tris(3,5-di-t-butyl-4-hydroxybenzyl)benzene, tetrakis-[methylene-3-(3',5'-di-t-butyl-4'-hydroxyphenyl)propionate]methane, bis[3,3'-bis(4'-hydroxy-3'-t-butylphenyl)butyric acid]glycol ester, tocophenol compounds, etc.

(Paraphenylenediamine Compounds)

N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, N,N'-dimethyl-N,N'-di-t-butyl-p-phenylenediamine, etc.

(Hydroquinone Compounds)

2,5-di-t-octylhydroquinone, 2,6-didodecylhydroquinone, 2-dodecylhydroquinone, 2-dodecyl-5-chlorohydroquinone, 2-t-octyl-5-methylhydroquinone, 2-(2-octadecenyl)-5-methylhydroquinone, etc.

(Organic Sulfur-Containing Compounds)

Dilauryl-3,3'-thiodipropionate, distearyl-3,3'-thiodipropionate, ditetradecyl-3,3'-thiodipropionate, etc.

(Organic Phosphorus-Containing Compounds)

Triphenylphosphine, tri(nonylphenyl)phosphine, tri(dinonylphenyl)phosphine, tricresylphosphine, tri(2,4-dibutylphenoxy)phosphine, etc.

These compounds are known as antioxidants for rubbers, plastics, fats, etc., and marketed products thereof can easily be obtained.

Each of the layers preferably includes the antioxidant in an amount of from 0.01 to 10% by weight based on total weight thereof.

Next, the image forming method and image forming apparatus of the present invention will be explained in detail, referring to the drawings.

The image forming method and image forming apparatus of the present invention include a photoreceptor having a smooth transporting crosslinked surface layer having a low surface energy, wherein the photoreceptor is charged and irradiated with an image wise light to form an electrostatic latent image thereon; the electrostatic latent image is developed to form a toner image; the toner image is transferred onto an image bearer (transfer sheet) and fixed thereon; and a surface of the photoreceptor is cleaned.

The process is not limited thereto in such a method as to directly transfer an electrostatic latent image onto a transfer sheet and develop the electrostatic latent image thereon.

Figure 4:
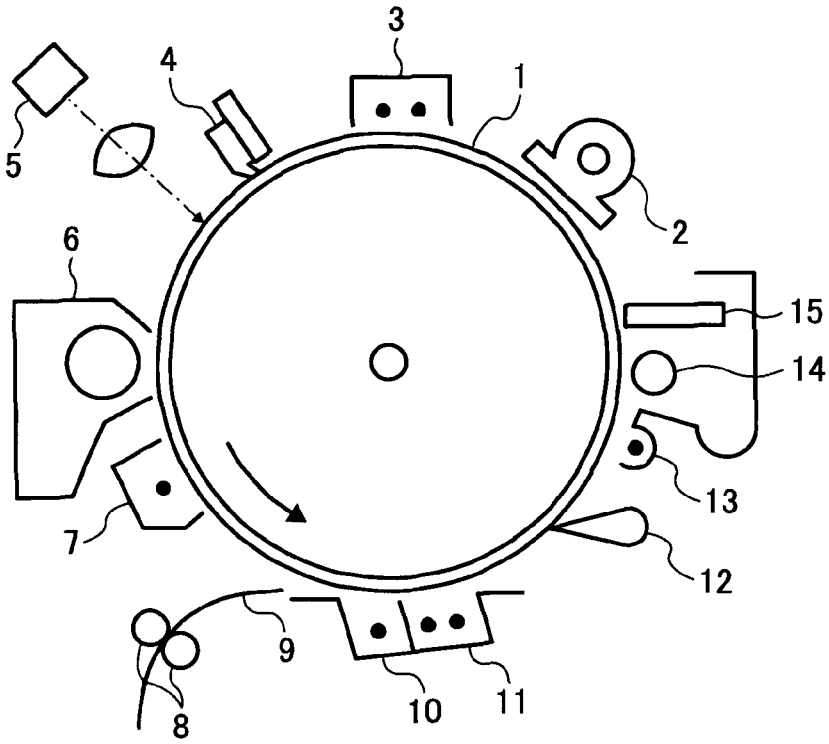
FIG. 4 is a schematic view illustrating a partial cross-section of an embodiment of the image forming apparatus of the present invention.

FIG. 4 is a schematic view illustrating a partial cross-section of an embodiment of the image forming apparatus of the present invention. A charger (3) is used to uniformly charge a photoreceptor (1). Specific examples of the charger include known chargers such as a corotron device, a scorotron device, a solid state charger, a needle electrode device, a roller charging device and an electroconductive brush device.

Contact chargers or non-contact chargers can be used in the present invention. The contact chargers include a charging roller, a charging brush, a charging blade, etc. directly contacting a photoreceptor. The non-contact chargers include, e.g., a charging roller located close to a photoreceptor with a gap not longer than 200 μm therebetween. When the gap is too long, the photoreceptor is not stably charged. When too short, the charging member, e.g., a charging roller is contaminated with a toner remaining on the photoreceptor. Therefore, the gap preferably has a length of from 10 to 200 μm, and more preferably from 10 to 100 μm.

Next, an imagewise light irradiator (5) is used to form an electrostatic latent image on the photoreceptor (1). Suitable light sources thereof include typical light emitters such as a fluorescent lamp, a tungsten lamp, a halogen lamp, a mercury lamp, a sodium lamp, a light emitting diode (LED), a laser diode (LD), a light source using electroluminescence (EL), etc. In addition, to obtain light having a desired wave length range, filters such as a sharp-cut filter, a band pass filter, a near-infrared cutting filter, a dichroic filter, an interference filter and a color temperature converting filter can be used.

Next, a developing unit (6) is used to visualize an electrostatic latent image formed on the photoreceptor (1). The developing methods include a one-component developing method and a two-component developing method using a dry toner; and a wet developing method using a wet toner. When the photoreceptor positively or negatively charged is exposed to imagewise light, an electrostatic latent image having a positive or negative charge is formed on the photoreceptor. When the latent image having a positive charge is developed with a toner having a negative charge, a positive image can be obtained. In contrast, when the latent image having a positive charge is developed with a toner having a positive charge, a negative image can be obtained.

Next, a transfer charger (10) is used to transfer a toner image visualized on the photoreceptor onto a transfer sheet (9). A pre-transfer charger (7) may be used to perform the transfer better. Suitable transferees include a transferer charger, an electrostatic transferer using a bias roller, an adhesion transferer, a mechanical transferer using a pressure and a magnetic transferer. The above-mentioned chargers can be used for the electrostatic transferer.

Next, a separation charger (11) and a separation pick (12) are used to separate the transfer sheet (9) from the photoreceptor (1). Other separation means include an electrostatic absorption induction separator, a side-edge belt separator, a tip grip conveyor, a curvature separator, etc. The above-mentioned chargers can be used for the separation charger (11).

Next, a fur brush (14) and a cleaning blade (15) are used to remove a toner left on the photoreceptor after transferred therefrom. A pre-cleaning charger (13) may be used to perform the cleaning more effectively. Other cleaners include a web cleaner, a magnet brush cleaner, etc., and these cleaners can be used alone or in combination.

Figure 5:
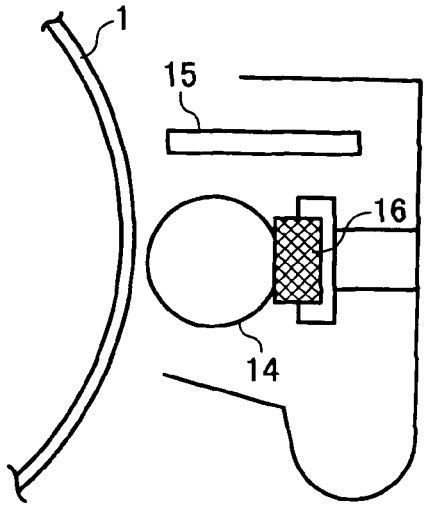
FIG. 5 is a schematic view illustrating a cross-section of a lubricant applicator in the image forming apparatus of the present invention.

The image forming apparatus of the present invention may include a lubricant applicator. Recent image forming apparatuses are using a toner having a small particle diameter and the shape of a sphere to produce high-quality images. Such a toner easily scrapes through a cleaning blade when cleaned, and therefore the hardness of a rubber of the cleaning blade and contact pressure thereof cannot but be strengthened. Although the photoreceptor of the present invention having high abrasion resistance is not abraded more with such a mechanical stress, the friction with the cleaning blade causes a squeal a damaged edge thereof. In the present invention, a combination of the photoreceptor and the lubricant applicator included in the image forming apparatus of the present invention can maintain a low friction coefficient therebetween and eliminate the problem of the cleaning blade. Any methods of applying a lubricant can be used, and as shown in FIG. 5, the lubricant applicator of the present invention presses a solid lubricant (16) having the shape of a stick to a cleaning fur brush (14) such that the lubricant adheres thereto. Further, the fur brush (14) contacts a photoreceptor (1) so as to apply the lubricant thereto. The lubricant is not necessarily a solid, may be a liquid, a powder or a semi-paste, and is not particularly limited if applicable on the surface of a photoreceptor and satisfying the electrophotographic properties. Specific examples of the lubricant include, but are not limited to, metallic salts such as zinc stearate, barium stearate, aluminum stearate and calcium stearate; waxes such as carnauba, lanoline and Japan wax; and lubricant oils such as silicone oil. The metallic salts, particularly zinc stearate, aluminum stearate and calcium stearate are preferably used because they are easily processed to have the shape of a stick and applicable.

Next, a discharger is optionally used to remove a latent image in the photoreceptor. The discharger includes a discharge lamp (2) and a discharger, and the above-mentioned light sources and chargers can be used respectively.

Known means can be used for an original reading process, a paper feeding process, a fixing process, a paper delivering process, etc.

Figure 6:
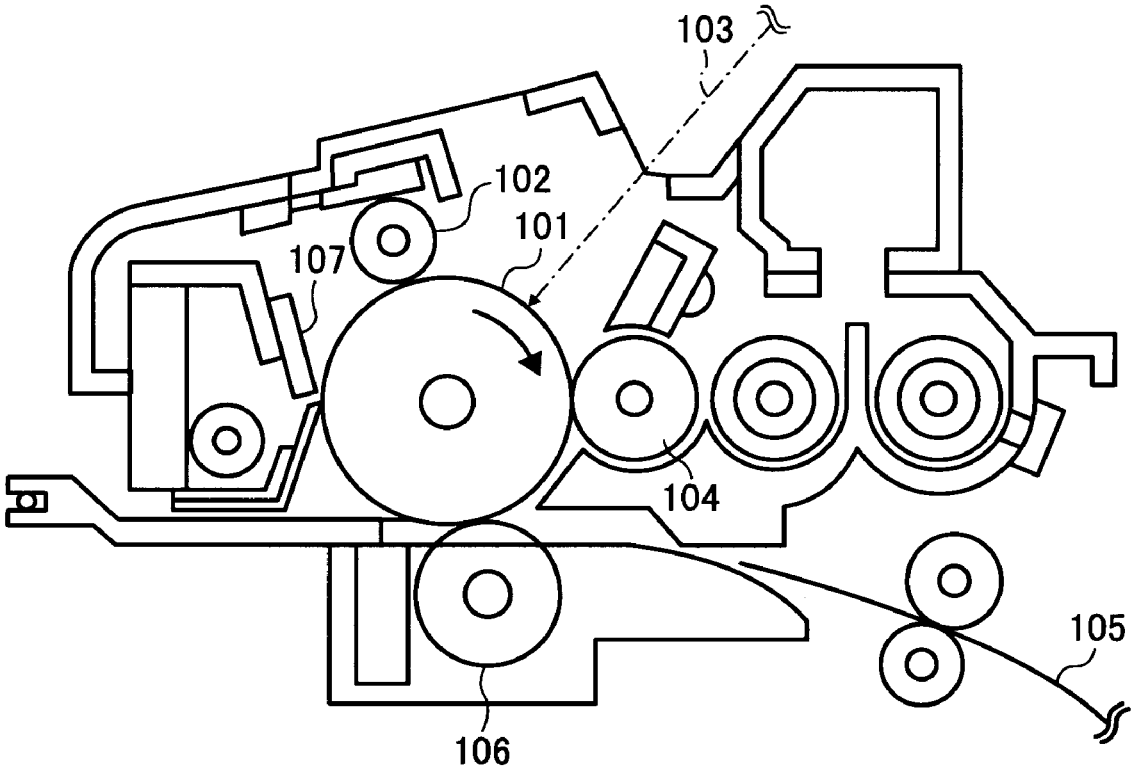
FIG. 6 is a schematic view illustrating a cross-section of an embodiment of the process cartridge of the present invention.

The above-mentioned image forming unit may be fixedly set in a copier, a facsimile or a printer. However, the image forming unit may be detachably set therein as a process cartridge. FIG. 6 is a schematic view illustrating an embodiment of the process cartridge of the present invention.

The process cartridge means an image forming unit (or device) which includes a photoreceptor (101) and at least one of a charger (102), an image developer (104), a transferer (106), a cleaner (107) and a discharger (not shown).

While the photoreceptor (101) rotates in a direction indicated by an arrow, the photoreceptor (101) is charged by the charger (102) and irradiated by an irradiator (103) to form an electrostatic latent image relevant to imagewise light thereon. The electrostatic latent image is developed by the image developer (104) with a toner to form a form a toner image, and the toner image is transferred by the transferer (106) onto a transfer sheet (105) to be printed out. Next, a surface of the photoreceptor after the toner image is transferred is cleaned by the cleaner (107), discharged by a discharger (not shown) and these processes are repeated again.

The present invention provides a process cartridge for image forming apparatus, including a photoreceptor having a smooth charge transportable crosslinked surface layer, and at least one of s charger, an image developer, a transferer, a cleaner and a discharger.

As is apparent from the explanations mentioned above, the electrophotographic photoreceptor of the present invention can widely be used in electrophotography applied fields such as a laser beam printer, a CRT printer, a LED printer, a liquid crystal printer and a laser engraving.

<Synthesis Example of a Radical Polymerizable Compound Having a Charge Transportable Structure>

The compound having a charge transporting structure of the present invention is synthesized by, e.g., a method disclosed in Japanese Patent No. 3164426. The following method is one of the examples thereof.

(1) Synthesis of a Hydroxy Group Substituted Triarylamine Compound Having the Following Formula B 113.85 g (0.3 mol) of a methoxy group substituted triarylamine compound having the formula A, 138 g (0.92 mol) of sodium iodide and 240 ml of sulfolane were mixed to prepare a mixture. The mixture was heated to have a temperature of 60° C. in a nitrogen stream.

A

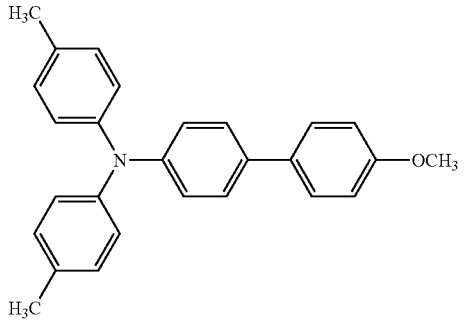

99 g (0.91 mol) of trimethylchlorosilane were dropped therein for 1 hr and the mixture was stirred for 4 hrs at about 60° C. About 1.5 L of toluene were added thereto and the mixture was cooled to have a room temperature, and repeatedly washed with water and an aqueous solution of sodium carbonate. Then, a solvent removed therefrom and refined by a column chromatographic process using silica gel as an absorption medium, and toluene and ethyl acetate (20-to-1) as a developing solvent. Cyclohexane was added to the thus prepared buff yellow oil to separate a crystal out. Thus, 88.1 g (yield of 80.4%) of a white crystal having the following formula B and a melting point of from 64.0 to 66.0° C. was prepared.

B

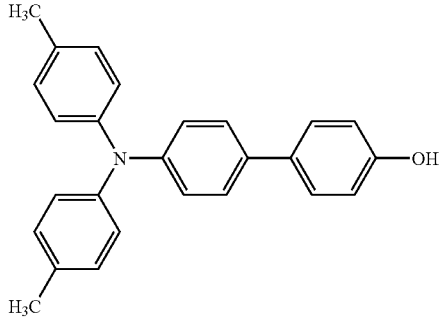

| Elemental Analysis Value (%) | | | |
|---|---|---|---|
| | C | H | N |
| Found value | 85.06 | 6.41 | 3.73 |
| Calculated value | 85.44 | 6.34 | 3.83 |

(2) A Triarylamino Group Substituted Acrylate Compound (Compound No. 54)

82.9 g (0.227 mol) of the hydroxy group substituted triarylamine compound having the formula B prepared in (1) were dissolved in 400 ml of tetrahydrofuran to prepare a mixture, and an aqueous solution of sodium hydrate formed of 12.4 g of NaOH and 100 mil of water was dropped therein in a nitrogen stream. The mixture was cooled to have a temperature of 5° C., and 25.2 g (0.272 mol) of chloride acrylate was dropped therein for 40 min. Then, the mixture was stirred at 5° C. for 3 hrs. The mixture was put in water and extracted with toluene. The extracted liquid was repeatedly washed with water and an aqueous solution of sodium carbonate. Then, a solvent removed therefrom and refined by a column chromatographic process using silica gel as an absorption medium and toluene as a developing solvent. N-hexane was added to the thus prepared colorless oil to separate a crystal out. Thus, 80.73 g (yield of 84.8%) of a white crystal of the compound No. 54 having a melting point of from 117.5 to 119.0° C. was prepared.

| Elemental Analysis Value (%) | | | |
|---|---|---|---|
| | C | H | N |
| Found value | 83.13 | 6.01 | 3.16 |
| Calculated value | 83.02 | 6.00 | 3.33 |

(3) Synthesis Example of an Acrylic Acid Ester Compound (i) Preparation of diethyl 2-hydroxybenzylphosphonate 38.4 g of 2-hydroxybenzylalcohol from TOKYO KASEI KOGYO Co., Ltd. and 80 ml of o-xylene were put in a reaction reservoir having a mixer, a thermometer and a dropping funnel. Under a nitrogen stream, 62.8 g of triethyl phosphite were slowly dropped therein at 80° C., and the reaction therein is further performed for 1 hr at the same temperature. Then, the produced ethanol, o-xylene and unreacted triethyl phosphite were removed from the reaction by reduced-pressure distillation to prepare 66 g of 2-diethylhydroxybenzylphosphonate at a yield of 90%, having a boiling point of 120.0° C./1.5 mm Hg.

(ii) Preparation of 2-hydroxy-4'-(di-para-tolylamino)stilbene 14.8 g of kalium-tert-butoxide and 50 ml of tetrahydrofuran were put in a reaction reservoir having a mixer, a thermometer and a dropping funnel. Under a nitrogen stream, a solution wherein 9.90 g of the diethyl 2-hydroxybenzylphosphonate and 5.44 g of 4-(di-para-tolylamino)benzaldehyde were dissolved in tetrahydrofuran was slowly dropped therein at a room temperature, and the reaction therein is further performed for 2 hrs at the same temperature. Then, water was added therein while cooling the reaction product with water, a hydrochloric acid solution having a normal concentration of 2 was added therein to acidize the reaction product, and the tetrahydrofuran was removed by an evaporator to extract a crude product with toluene. The toluene phase was washed with water, a sodium hydrogen carbonate solution and a saturated saline in this order, and magnesium sulfate was further added thereto to dehydrate the toluene phase. After filtered, the toluene was removed therefrom to prepare an oily crude product, and the oily crude product was further column-refined with silica gel to crystallize 5.09 g of 2-hydroxy-4'-(di-para-tolylamino)stilbene in hexane at a yield of 72%, having a boiling point of 136.0 to 138.0° C.

(iii) Preparation of 4'-(di-para-tolylamino)stilbene-2-ylacrylate 14.9 g of the 2-hydroxy-4'-(di-para-tolylamino)stilbene. 100 ml of tetrahydrofuran and 21.5 g of sodium hydrogen carbonate solution having a concentration of 12% were put in a reaction reservoir having a mixer, a thermometer and a dropping funnel. Under a nitrogen stream, 5.17 g of chloride acrylate was dropped therein for 30 min at 5° C., and the reaction therein is further performed for 3 hrs at the same temperature. The reaction liquid was put in water, extracted with toluene, condensed and column-refined with silica gel to prepare a crude product. The crude product was recrystallized with ethanol to prepare 13.5 g of a yellow needle crystal 4'-(di-para-tolylamino)stilbene-2-ylacrylate (Exemplified Compound No. 2) at a yield of 79.8%, having a boiling point of 104.1 to 105.2° C. The elemental analysis thereof is as follows.

| Elemental Analysis Value (%) | | | |
|---|---|---|---|
| | C | H | N |
| Found value | 83.46 | 6.06 | 3.18 |
| Calculated value | 83.57 | 6.11 | 3.14 |

2-hydroxybenzylesterphosphonate derivatives and various amino-substituted benzaldehyde derivatives are reacted with each other to synthesize many 2-hydroxystilbene derivatives, and various esteracrylate compounds can be synthesized when the 2-hydroxystilbene derivatives are acrylated or methacrylated.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

An undercoat coating liquid, a charge generation coating liquid and charge transport coating liquid, which have the following formulations, were coated and dried in this order on an aluminum cylinder having a diameter of 100 mm to form an undercoat layer 3.0 μm thick, a charge generation layer 0.2 μm thick, a charge transport layer 20 μm thick thereon.

Undercoat Layer Coating Liquid

| | |
|---|---|
| Alkyd resin<br>(BEKKOZOL 1307-60-EL from Dainippon Ink & Chemicals, Inc.) | 6 |
| Melamine resin<br>(SUPER BEKKAMIN G-821-60 from Dainippon Ink & Chemicals, Inc.) | 4 |
| Titanium dioxide powder | 40 |
| Methyl ethyl ketone | 50 |

CGL coating liquid

| | |
|---|---|
| Titanylphthalocyanine pigment<br>having the following formula (I): | 15 |

-continued (I)

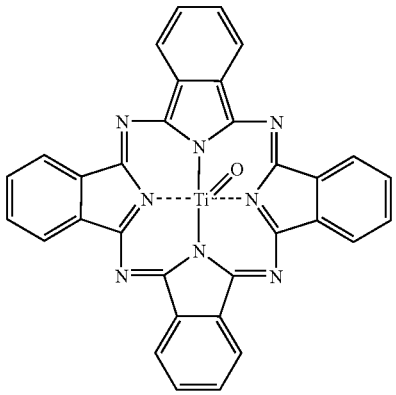

| | |
|---|---|
| Polyvinylbutyral<br>BX-1 from Sekisui Chemical Co., Ltd. | 10 |
| 2-butanone | 280 |

CTL Coating Liquid

| | |
|---|---|
| Bisphenol Z Polycarbonate<br>(Panlite TS-2050 from TEIJIN CHEMICALS LTD.) | 10 |
| Charge transport material<br>having the following formula (II): | 7 |

(II)

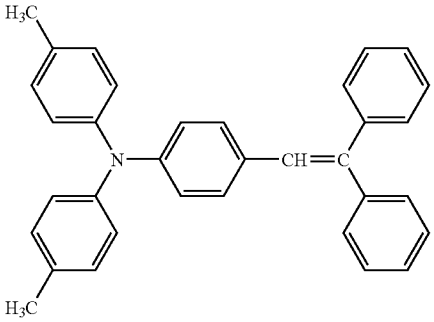

| | |
|---|---|
| Tetrahydrofuran | 100 |
| 1% tetrahydrofuran solution<br>of silicone oil<br>(KF50-100CS from Shin-Etsu Chemical Industry Co., Ltd.) | 0.2 |

The charge transport layer was further coated with a crosslinked surface layer coating liquid having the following formulation by a spray coating method using a spray gun.

Crosslinked Surface Layer Coating Liquid

| | |
|---|---|
| Monofunctional radical polymerizable compound<br>having a charge transportable structure<br>(Above-exemplified compound No. 54 having a molecular weight of 419) | 10 |
| Trifunctional radical polymerizable monomer<br>having no charge transportable structure<br>(Trimethylolpropanetriacrylate KAYARAD TMPTA having a molecular weight of 296 from NIPPON KAYAKU CO., LTD.) | 10 |
| Photopolymerization initiator<br>(IRGACURE 184 having a molecular weight of 204 from Nippon Kayaku Co., Ltd.) | 1 |
| Tetrahydrofuran<br>having a boiling point of 66° C. and a saturated vapor pressure of 176 mm Hg/25° C. | 120 |

The spray gun was PC308 from OLYMPOS, and which sprayed to form a surface layer having a thickness of 10 μm at 20° C. and 50% RH under the following spray coating conditions.

Discharge amount: 0.17 ml/s

Atomization pressure: 1.5 kgf/cm$^2$

Distance between nozzle and substrate: 50 mm

Spray gun traveling speed: 3.5 mm/s

Rotation number of substrate: 100 rpm

Droplet diameter: 7.0 μm

The substrate was irradiated with UV light after coated while rotated at 30 rpm with a UV lamp system from FUSION, using a metal halide lamp under the following conditions to harden the surface layer.

Distance between lamp and substrate: 50 mm

Irradiation intensity: 1,000 mW/cm$^2$

Irradiation time: 30 sec

After irradiated, the substrate was dried at 90° C. for 10 min to form the crosslinked surface layer having a thickness of 10 μm thereon. Thus, an electrophotographic photoreceptor of the present invention was prepared.

Example 2

The procedure for preparation of the electrophotographic photoreceptor in Example 1 was repeated to prepare an electrophotographic photoreceptor except for changing the spray coating conditions as follows.

Atomization pressure: 1.0 kgf/cm$^2$

Droplet diameter: 8.8 μm

Example 3

The procedure for preparation of the electrophotographic photoreceptor in Example 1 was repeated to prepare an electrophotographic photoreceptor except for changing the spray coating conditions as follows.

Discharge amount: 0.10 ml/s

Atomization pressure: 3.5 kgf/cm$^2$

Spray gun traveling speed: 2.0 mm/s

Droplet diameter: 6.6 μm

Example 4

The procedure for preparation of the electrophotographic photoreceptor in Example 1 was repeated to prepare an electrophotographic photoreceptor except for replacing the spray gun with A100 from Meiji-Machine Co., Ltd. and changing the spray coating conditions as follows.

Discharge amount: 0.17 ml/s

Atomization pressure: 1.0 kgf/cm$^2$

Distance between nozzle and substrate: 80 mm

Droplet diameter: 6.6 μm

Example 5

The procedure for preparation of the electrophotographic photoreceptor in Example 4 was repeated to prepare an electrophotographic photoreceptor except for changing the spray coating conditions as follows.

Discharge amount: 0.10 ml/s

Atomization pressure: 2.0 kgf/cm$^2$

Distance between nozzle and substrate: 100 mm

Spray gun traveling speed: 2.0 mm/s

Droplet diameter: 2.1 μm

Example 6

The procedure for preparation of the electrophotographic photoreceptor in Example 4 was repeated to prepare an electrophotographic photoreceptor except for changing the spray coating conditions as follows.

Atomization pressure: 1.5 kgf/cm$^2$

Droplet diameter: 6.5 μm

Example 7

The procedure for preparation of the electrophotographic photoreceptor in Example 6 was repeated to prepare an electrophotographic photoreceptor except for changing the monofunctional radical polymerizable compound having a charge transportable structure in the crosslinked surface layer coating liquid to above-exemplified compound No. 109 having a molecular weight of 445, the solvent therein to acetone having a boiling point of 56° C. and a saturated vapor pressure of 181.7 mm Hg/20° C. and the droplet diameter to 6.1 μm.

Example 8

The procedure for preparation of the electrophotographic photoreceptor in Example 1 was repeated to prepare an electrophotographic photoreceptor except for changing the trifunctional radical polymerizable monomer having no charge transportable structure in the crosslinked surface layer coating liquid to a material having the following formula and the droplet diameter to 7.9 μm.

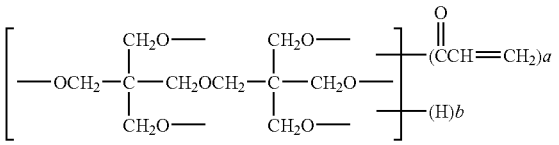

Dipentaerythritolhexaacrylate (Mixture of Hexaacrylate a=5 and b=1, and Pentaacrylate a=6 and b=0)

KAYARAD DPHA from Nippon Kayaku Co., Ltd. having 5 functional groups and 6 functional groups (1:1)

Example 9

The procedure for preparation of the electrophotographic photoreceptor in Example 1 was repeated to prepare an electrophotographic photoreceptor except for changing the trifunctional radical polymerizable monomer having no charge transportable structure in the crosslinked surface layer coating liquid to a material having the following formula (caprolactone-modified dipentaerythritolhexaacrylate KAYARAD DPCA-120 from Nippon Kayaku Co., Ltd. having 6 function groups), the solvent therein to a mixed solvent including 100 parts of tetrahydrofuran and 2 parts of an one having a boiling point of 155° C. and a saturated vapor pressure of 100 mm Hg/20° C. and the droplet diameter to 8.4 μm.

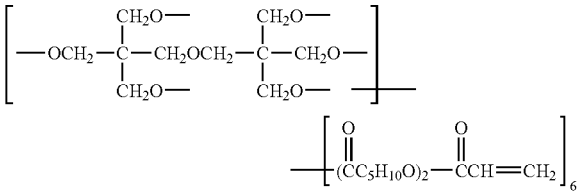

Example 10

The procedure for preparation of the electrophotographic photoreceptor in Example 1 was repeated to prepare an electrophotographic photoreceptor except for changing the photopolymerization initiator in the crosslinked surface layer coating liquid to the following heat polymerization initiator and heating the coated liquid at 150° C. for 30 min with an air forced oven after coated, and the droplet diameter to 8.4 μm.

2,2-bis(4,4-di-t-buylper0xycycloheaxy)propane (Perkadox 12-EB20 from Kayaku Akzo Corp.)

Comparative Example 1

The procedure for preparation of the electrophotographic photoreceptor in Example 1 was repeated to prepare an electrophotographic photoreceptor except for changing the spray coating conditions as follows.

Discharge amount: 0.30 ml/s
Spray gun traveling speed: 6.4 mm/s
Droplet diameter: 15.2 μm Comparative Example 2

The procedure for preparation of the electrophotographic photoreceptor in Example 1 was repeated to prepare an electrophotographic photoreceptor except for changing the spray coating conditions as follows.

Discharge amount: 0.40 ml/s
Atomization pressure: 1.0 kgf/cm$^2$
Spray gun traveling speed: 8.0 mm/s
Droplet diameter: 18.5 μm Comparative Example 3

The procedure for preparation of the electrophotographic photoreceptor in Example 1 was repeated to prepare an electrophotographic photoreceptor except for changing the spray coating conditions as follows.

Atomization pressure: 0.75 kgf/cm$^2$
Droplet diameter: 12.2 μm

Comparative Example 4

The procedure for preparation of the electrophotographic photoreceptor in Example 4 was repeated to prepare an electrophotographic photoreceptor except for changing the spray coating conditions as follows.

Atomization pressure: 0.75 kgf/cm$^2$
Spray gun traveling speed: 3.8 mm/s
Droplet diameter: 11.5 μm Comparative Example 5

The procedure for preparation of the electrophotographic photoreceptor in Example 4 was repeated to prepare an electrophotographic photoreceptor except for changing the spray coating conditions as follows.

Discharge amount: 0.25 ml/s
Atomization pressure: 0.50 kgf/cm$^2$
Spray gun traveling speed: 4.5 mm/s
Droplet diameter: 14.9 μm Comparative Example 6

The procedure for preparation of the electrophotographic photoreceptor in Example 4 was repeated to prepare an electrophotographic photoreceptor except for changing the spray coating conditions as follows.

Discharge amount: 0.30 ml/s
Atomization pressure: 0.50 kgf/cm$^2$
Distance between nozzle and substrate: 50 mm
Spray gun traveling speed: 4.5 mm/s
Droplet diameter: 21.3 μm Comparative Example 7

The procedure for preparation of the electrophotographic photoreceptor in Example 1 was repeated to prepare an electrophotographic photoreceptor except for coating the crosslinked surface layer by a ring coat method.

Comparative Example 8

The procedure for preparation of the electrophotographic photoreceptor in Example 1 was repeated to prepare an electrophotographic photoreceptor except for not forming the crosslinked surface layer and making the CTL 28 μm thick.

Each of the photoreceptors prepared in Examples 1 to 10 and Comparative Examples 1 to 8 was installed in imagio MF7070 from Ricoh Company, Ltd., which was modified to exclude the developing unit and transfer belt. The photoreceptor was fatigued by being charged and discharged for 24 hrs at an irradiated part potential of −800 V. Further, A4-size 100,000 images were produced by imagio Neo 1050Pro equipped with the photoreceptor. The irradiated part potentials before and after 100,000 images were produced were measured. The abrasion amount were measured and the last image was evaluated after 100,000 images were produced. The abrasion amount was a difference of thickness of the photoreceptor before and after 100,000 images were produced, which was measured by an eddy-current film thickness measurer from Fischer Instruments K.K. The results are shown in Table 1.

TABLE 1

| | Droplet | Irradiated Part Potential (−V) | | Abrasion | |
|---|---|---|---|---|---|
| | diameter (μm) | Initial | After 100,000 | amount (μm) | Image |
| Example 1 | 7.0 | 130 | 170 | 0.41 | Good |
| Example 2 | 8.8 | 145 | 180 | 0.47 | Good |

TABLE 1-continued

| | Droplet diameter (μm) | Irradiated Part Potential (−V) Initial | After 100,000 | Abrasion amount (μm) | Image |
|---|---|---|---|---|---|
| Example 3 | 3.6 | 125 | 165 | 0.37 | Good |
| Example 4 | 9.2 | 150 | 180 | 0.52 | Good |
| Example 5 | 2.1 | 125 | 160 | 0.34 | Good |
| Example 6 | 6.5 | 125 | 160 | 0.53 | Good |
| Example 7 | 6.1 | 140 | 180 | 0.38 | Good |
| Example 8 | 7.9 | 135 | 170 | 0.50 | Good |
| Example 9 | 8.4 | 145 | 180 | 0.48 | Good |
| Example 10 | 7.5 | 140 | 185 | 0.51 | Good |
| Comparative Example 1 | 15.2 | 155 | 200 | 0.74 | Image density deteriorated |
| Comparative Example 2 | 18.5 | 160 | 210 | 0.80 | Image density deteriorated |
| Comparative Example 3 | 12.2 | 155 | 190 | 0.77 | Image density slightly deteriorated |
| Comparative Example 4 | 11.5 | 150 | 190 | 0.62 | Image density slightly deteriorated |
| Comparative Example 5 | 14.9 | 155 | 200 | 0.76 | Image density deteriorated |
| Comparative Example 6 | 21.3 | 170 | 220 | 0.84 | Image density deteriorated |
| Comparative Example 7 | — | 170 | 230 | 1.05 | Image density deteriorated |
| Comparative Example 8 | — | 120 | 150 | 3.05 | Good |

The photoreceptors in Examples 1 to 10 did not increase the irradiated part potential much even after producing 100,000 images, and did not deteriorate in image density. In addition, the photoreceptors in Examples 1 to 10 improved in abrasion resistance. The photoreceptor in Comparative Example 8 had good irradiated part potential and produced quality images even after producing 100,000 images, but was abraded much and cannot be expected to have high durability.

Example 11

The photoreceptor in Example 1 was fatigued by being charged and discharged for 24 hrs at an irradiated part potential of −800 V. Instead of imagio Neo 1050Pro, the photoreceptor was installed in an image forming apparatus having an applicator automatically applying zinc stearate to its cleaning blade having 1.5 times contact pressure to the photoreceptor, and 100,000 (A4) images were produced thereby. There was no poor cleaning of the photoreceptor, quality images were produced and no damage of the cleaning blade even after producing 100,000 images. The abrasion amount was 0.47 μm and did not increase.

Example 12

The procedure for evaluation in Example 11 was repeated except for replacing the zinc stearate to aluminum stearate. There was no poor cleaning of the photoreceptor, quality images were produced and no damage of the cleaning blade even after producing 100,000 images. The abrasion amount was 0.49 μm and did not increase.

Example 13

The procedure for evaluation in Example 11 was repeated except for replacing the zinc stearate to calcium stearate. There was no poor cleaning of the photoreceptor, quality images were produced and no damage of the cleaning blade even after producing 100,000 images. The abrasion amount was 0.49 μm and did not increase.

Therefore, the method of preparing an electrophotographic photoreceptor, comprising forming a photosensitive layer on an electroconductive substrate; and forming a surface layer on the photosensitive layer, wherein the surface layer is formed by a spray coating comprising a spray droplet having an average diameter ($D_{50}$) not greater than 10 μm of the present invention has good electrical properties and high durability, and maintains producing quality images.

Further, an image forming process, an image forming apparatus and a process cartridge therefor using the photoreceptor of the present invention have high performances and high reliabilities.

This application claims priority and contains subject matter related to Japanese Patent Application No. 2006-319985 filed on Nov. 28, 2006, the entire contents of which are hereby incorporated by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A method of preparing an electrophotographic photoreceptor, comprising:

forming a photosensitive layer overlying an electroconductive substrate; and forming a surface layer overlying the photosensitive layer, wherein the surface layer has a thickness of from 5 to 10 μm and is formed by a spray coating comprising a spray droplet having an average diameter (D50) of from 2.1 to 3.6 μm from a spray gun having a nozzle traveling at a speed which is not greater than 10 mm/s wherein the surface layer is a crosslinked surface layer wherein the surface layer comprises:

a tri- or more functional radical polymerizable monomer having no charge transportable structure; and a radical polymerizable compound having a charge transportable structure, and wherein the surface layer is hardened with heat or light to form a crosslinked surface layer.

2. The method of claim 1, further comprising:

hardening the surface layer with heat or light.

3. The method of preparing an electrophotographic photoreceptor of claim 1, wherein the charge transportable structure is a member selected from the group consisting of triarylamine structures, hydrazone structures, pyrazoline structures and carbazole structures.

4. The method of preparing an electrophotographic photoreceptor of claim 1, wherein the charge transportable structure is a triarylamine structure.

5. The method of preparing an electrophotographic photoreceptor of claim 1, wherein the radical polymerizable compound is a member selected from the group consisting of acryloyloxy groups and methacryloyloxy groups.

6. The method of preparing an electrophotographic photoreceptor of claim 1, wherein the radical polymerizable compound is monofunctional.

7. The method of preparing an electrophotographic photoreceptor of claim 1, wherein the tri- or more functional radical polymerizable monomer is a member selected from the group consisting of tri- or more functional acryloyloxy groups and tri- or more functional methacryloyloxy groups.

8. The method of preparing an electrophotographic photoreceptor of claim 1, wherein the surface layer further comprises a heat polymerization initiator or a photopolymerization initiator.

9. The method of preparing an electrophotographic photoreceptor of claim 1, wherein the photosensitive layer comprises:

a charge generation layer located overlying the electroconductive substrate; and a charge transport layer located overlying the charge generation layer.

10. The method of preparing an electrophotographic photoreceptor of claim 1, wherein a cylindrical substrate is used as a photoreceptor substrate, said cylindrical substrate rotates, a spray gun nozzle travels in an axial direction of said cylindrical substrate to coat said substrate, a distance from said spray gun nozzle to said cylindrical substrate is from 20 mm to 100 mm, said spray gun nozzle travels at a speed which is not greater than 3.5 mm/s and said cylindrical substrate rotates at a speed not less than 80 rpm.

* * * * *